US012653248B2

(12) United States Patent
Krawchuk

(10) Patent No.: US 12,653,248 B2
(45) Date of Patent: Jun. 16, 2026

(54) CONVERTIBLE INFANT APPAREL

(71) Applicant: Little Beings Holdings Pty Ltd, Zetland (AU)

(72) Inventor: Hana-Lia Krawchuk, Maroubra (AU)

(73) Assignee: Little Beings Holdings Pty Ltd, Zetland (AU)

( * ) Notice: Subject to any disclaimer, the term of this patent is extended or adjusted under 35 U.S.C. 154(b) by 0 days.

(21) Appl. No.: 18/089,449

(22) Filed: Dec. 27, 2022

(65) Prior Publication Data

US 2024/0206565 A1 Jun. 27, 2024

(51) Int. Cl.
*A41B 13/08* (2006.01)

(52) U.S. Cl.
CPC ..... *A41B 13/08* (2013.01)

(58) Field of Classification Search
CPC ..... A41B 13/06; A41B 13/08; A41B 13/005
See application file for complete search history.

(56) References Cited

U.S. PATENT DOCUMENTS 1,956,813 A 5/1934 Stephenson
2,225,884 A 12/1940 Parks
2,429,168 A 10/1947 Padgett
2,462,165 A * 2/1949 Condon ..... A41B 13/06 2/69.5
2,469,556 A * 5/1949 Jacobson ..... A41B 13/005 2/69.5
2,578,323 A * 12/1951 Sillaway ..... A41B 13/06 2/69.5
2,579,276 A 12/1951 Schworm
2,621,336 A * 12/1952 Wendroff ..... A41B 13/005 2/227
2,675,557 A 4/1954 Kempner, Jr.
(Continued)

FOREIGN PATENT DOCUMENTS

AU 2004200438 A1 8/2005
AU 2010212430 A1 1/2011
(Continued)

OTHER PUBLICATIONS

Woombie Grow With Me Swaddle, https://www.amazon.com/Woombie-Grow-Baby-Swaddle-Convertible/dp/B07DKVDZDC?th=1.

(Continued)

*Primary Examiner* — Sally Haden
(74) *Attorney, Agent, or Firm* — Bookoff McAndrews, PLLC

(57) ABSTRACT

In accordance with this disclosure, an article of infant apparel may comprise a bodice portion; a pair of wing portions attached to each side of the bodice portion; and a pair of closures, each closure located at a junction between the bodice portion and one of the pair of wing portions. In a first configuration, the pair of closures may be open, and each of the wing portions may be expanded, such that the wing portions extend laterally from opposite sides of the bodice portion and define a portion of an outer perimeter of the article of infant apparel. In a second configuration, the pair of closures may be closed, and each of the wing portions may be collapsed into and retained within the bodice portion by a respective closure, such that the junction defines a portion of an outer perimeter of the article of infant apparel.

9 Claims, 32 Drawing Sheets

(56) References Cited

U.S. PATENT DOCUMENTS

| | | | | |
|---|---|---|---|---|
| 2,738,512 | A * | 3/1956 | Winer | A41B 13/005 2/72 |
| 3,259,126 | A | 7/1966 | Greiert | |
| D269,474 | S | 6/1983 | Mundy | |
| 4,611,353 | A | 9/1986 | Als et al. | |
| 5,131,096 | A * | 7/1992 | Olson | A41D 11/00 2/69.5 |
| 5,226,193 | A * | 7/1993 | Chen | A47G 9/083 2/69.5 |
| D380,589 | S | 7/1997 | Westman | |
| 5,722,094 | A | 3/1998 | Ruefer | |
| D400,688 | S | 11/1998 | Federspiel | |
| 6,058,508 | A | 5/2000 | Honeysuckle | |
| 6,247,178 | B1 * | 6/2001 | Bilda | A41D 15/04 2/73 |
| D457,288 | S | 5/2002 | Westman | |
| 7,076,819 | B2 | 7/2006 | Trani et al. | |
| 7,111,344 | B2 | 9/2006 | French | |
| 7,181,789 | B2 | 2/2007 | Gatten | |
| 7,587,769 | B1 | 9/2009 | McDermott | |
| D606,282 | S | 12/2009 | Chen | |
| 7,673,354 | B2 | 3/2010 | Fader | |
| 8,191,189 | B1 | 6/2012 | Spell | |
| 8,225,422 | B1 * | 7/2012 | McSparron | A41B 13/005 2/69.5 |
| D669,659 | S | 10/2012 | Barski | |
| 8,607,364 | B2 | 12/2013 | Barski | |
| 8,943,615 | B2 | 2/2015 | Howard et al. | |
| 8,943,625 | B2 | 2/2015 | Gotel et al. | |
| 9,119,423 | B2 | 9/2015 | Gotel et al. | |
| 9,131,734 | B2 | 9/2015 | Daugherty et al. | |
| 9,179,711 | B2 | 11/2015 | Krawchuk | |
| D801,629 | S | 11/2017 | Cook | |
| 10,104,916 | B2 * | 10/2018 | Barski | A41B 13/06 |
| D851,362 | S | 6/2019 | Barski | |
| 10,455,865 | B2 | 10/2019 | Barski | |
| 10,568,364 | B2 | 2/2020 | Villarreal | |
| D883,613 | S | 5/2020 | Damir et al. | |
| 10,736,362 | B2 | 8/2020 | Giveans | |
| D901,131 | S | 11/2020 | Krawchuk | |
| 11,044,951 | B2 | 6/2021 | Mercy | |
| D924,540 | S | 7/2021 | Lynch et al. | |
| D929,700 | S | 9/2021 | Dzodzo | |
| 11,147,319 | B2 | 10/2021 | Karp et al. | |
| 11,178,915 | B2 | 11/2021 | Parker | |
| 11,191,307 | B2 | 12/2021 | Geraghty | |
| 11,357,268 | B2 | 6/2022 | Krawchuk | |
| D964,694 | S * | 9/2022 | Krawchuk | D2/745 |
| D983,488 | S | 4/2023 | Zhang | |
| D990,823 | S | 7/2023 | Krawchuk | |
| D993,573 | S | 8/2023 | Zhu | |
| D1,007,103 | S | 12/2023 | Huang | |
| D1,007,814 | S | 12/2023 | Walker | |
| D1,014,904 | S | 2/2024 | Dutfield et al. | |
| 11,903,428 | B2 | 2/2024 | Zeidman | |
| 2003/0131411 | A1 | 7/2003 | Gibson | |
| 2005/0120459 | A1 | 6/2005 | McConnell et al. | |
| 2005/0150047 | A1 | 7/2005 | Trani et al. | |
| 2005/0210585 | A1 | 9/2005 | French | |
| 2006/0016005 | A1 | 1/2006 | Roda | |
| 2006/0064794 | A1 * | 3/2006 | Howard | A41B 13/065 2/69 |
| 2006/0150330 | A1 | 7/2006 | Gatten | |
| 2009/0064390 | A1 | 3/2009 | Beiring et al. | |
| 2009/0099632 | A1 * | 4/2009 | Krier | A41D 13/1272 607/108 |
| 2009/0282599 | A1 | 11/2009 | Comerford | |
| 2011/0179546 | A1 | 7/2011 | Millette et al. | |
| 2011/0180079 | A1 | 7/2011 | Krawchuk | |
| 2012/0125347 | A1 | 5/2012 | Soileau | |
| 2012/0151654 | A1 | 6/2012 | Chopak et al. | |
| 2012/0284922 | A1 | 11/2012 | Gangan et al. | |
| 2012/0311762 | A1 | 12/2012 | Aiken et al. | |
| 2013/0139290 | A1 * | 6/2013 | Barski | A41B 13/06 2/69.5 |
| 2013/0269080 | A1 | 10/2013 | Parker | |
| 2013/0333113 | A1 | 12/2013 | Gotel et al. | |
| 2014/0068834 | A1 | 3/2014 | Skinner | |
| 2015/0000036 | A1 | 1/2015 | Krawchuk | |
| 2015/0335853 | A1 | 11/2015 | Orewiler et al. | |
| 2015/0342263 | A1 | 12/2015 | Taylor | |
| 2018/0007976 | A1 | 1/2018 | Lager | |
| 2018/0228222 | A1 | 8/2018 | Barski et al. | |
| 2018/0332902 | A1 | 11/2018 | Damir et al. | |
| 2019/0191785 | A1 | 6/2019 | Vincent | |
| 2019/0208831 | A1 | 7/2019 | Joshi | |
| 2019/0254355 | A1 | 8/2019 | Griffin | |
| 2019/0297954 | A1 | 10/2019 | Damir et al. | |
| 2020/0146370 | A1 | 5/2020 | Bortone | |
| 2020/0196685 | A1 | 6/2020 | Williams | |
| 2021/0007420 | A1 | 1/2021 | Gangan et al. | |
| 2021/0022414 | A1 | 1/2021 | Shekhani | |
| 2021/0030076 | A1 | 2/2021 | Lee | |
| 2021/0259329 | A1 | 8/2021 | Kiik-Miley et al. | |

FOREIGN PATENT DOCUMENTS

| | | | |
|---|---|---|---|
| AU | 2011100230 | A4 | 4/2011 |
| AU | 2011200705 | B2 | 9/2011 |
| CA | 188580 | | 4/2021 |
| CN | 2302668 | Y | 1/1999 |
| CN | 201150266 | Y | 11/2008 |
| CN | 104507338 | A | 4/2015 |
| CN | 304680265 | | 6/2018 |
| CN | 305225392 | S | 6/2019 |
| CN | 214803918 | U | 11/2021 |
| EM | 008786677-0001 | | 12/2021 |
| GB | 2515400 | A | 12/2014 |
| GB | 9003002005 | | 2/2016 |
| JP | 1591469 | S | 11/2017 |
| JP | D1653969 | S | 3/2020 |
| JP | D1703716 | S | 1/2022 |
| KR | 30-0879807 | | 11/2016 |
| KR | 30-0883249 | | 11/2016 |
| KR | 30-1118757 | | 7/2021 |
| KR | 30-1176998 | | 8/2022 |
| KR | 30-1177261 | | 8/2022 |
| KR | 30-1185527 | | 10/2022 |
| NL | 1029033 | C2 | 6/2007 |
| TW | 181544 | | 3/2017 |
| TW | D188959 | S | 3/2018 |
| WO | 2007098558 | A1 | 9/2007 |
| WO | 2020051641 | A1 | 3/2020 |

OTHER PUBLICATIONS

Woombie Convertible Swaddle, https://woombie.com/convertible-woombie-beep-beep-6.html.

Nested Bean Zen One Classic, https://www.nestedbean.com/products/zen-one-classic?variant=30333153804391&campaignid=13873035329&adgroupid=126001063658&adid=533136971513&gclid=EAlalQobChMIz7G83tKd9AIVB5flCh19Dg76EAQYBiABEgK5dfD_BWE.

Australian Search Information Statement issued on Sep. 24, 2010, in Australian Patent Application No. 2010212430 (3 pages, in English).

Woombie, Swaddle Snuggle Sleep, http://www.thewoombie.com.au.

Ergopouch, Healthy Sleeping, http://ergopouch.com.au/swaddle.html.

Australian Office Action issued on Sep. 24, 2010, in Australian Patent Application No. 2010212430 (6 pages, in English).

Chinese Office Action issued on Jun. 13, 2016 in counterpart Chinese Patent Application No. 201680077762.9 (12 pages, in Chinese with English translation).

Extended European Search Report issued on Jun. 21, 2013 in counterpart European Patent Application No. 10793413.5 (3 pages, in English).

(56) References Cited

OTHER PUBLICATIONS

Extended European Search Report issued on Feb. 1, 2018 in counterpart European Patent Application No. 1207995.6 (8 pages, in English).
International Search Report issued on Aug. 23, 2010 in counterpart International Patent Application No. PCT/AU2010/000800 (4 pages, in English).
International Search Report issued on Feb. 3, 2017 in counterpart International Patent Application No. PCT/IB2016/001652 (5 pages, in English).
Patent Trial and Appeal Board. *Nested Bean, Inc.* v. *Big Beings USA Pty Ltd. and LB Online & Export PTY Ltd., d/b/a Love to Dream Online and Exports*. Jan. 24, 2022. Judgment. (71 pages, in English).
Australian Office Action issued on Dec. 1, 2010 in counterpart Australian Patent Application No. 2010212430 (3 pages, in English).
Chinese Office Action issued on Jan. 7, 2020 in counterpart Chinese Patent Application No. 201680077762.9 (7 pages, in Chinese with English Translation).
Chinese Office Action issued on Mar. 23, 2020 in counterpart Chinese Patent Application No. 201680077762.9 (12 pages, in Chinese with English translation).
Chinese Notification of Reexamination issued on Jan. 5, 2022 in counterpart Chinese Application No. 201680077762.9 (15 pages, in Chinese with English translation).
Blair, "Sudden infant death syndrome: problems, progress and possibilities" Arch Dis Child 2002; 86:453-455, vol. 86, Jun. 1, 2002.
Summa Health, "Summa Uses Developmental Care with Premature Babies" PR Newswire, Oct. 22, 1998.
Brown, Louise, "Persistent crying isn't colic" Toronto Star, Feb. 16, 1993.
Bregje E. van Slewen, el. al, Swaddling: A Systematic Review, 120:4 Pediatrics e1097 (Oct. 4, 2007) ("Swaddling: A Systematic Review").
E A Mitchell, et. al, Dummies and the Sudden Infant Death Syndrome, 68 Archives of Disease in Childhood, 501 (1993) ("Dummies and the Sudden Infant Death Syndrome.").
Barbara A. Hotelling, Newborn Capabilities: Parent Teaching Is a Necessity, 13:4 J. of Perinatal Edu. 43 (Fall 2004).
Joint Status Report for Dec. 9, 2020; Patent infringement suit re: U.S. Pat. No. 9,179,711; Civil Action No. 20-cv-10101-IT; United States District Court District of Massachusetts; *Big Beings USA Pty Ltd, and LB Online & Export Pty Ltd d/b/a Love To Dream Online and Exports* (Plaintiffs) V. *Nested Bean, Inc.* (Defendant).
Inter Partes Review of U.S. Pat. No. 9,179,711 B2; Case IPR2020-01234; *Nested Bean, Inc.* {Petitioner) *v. Big Beings USA Pty Ltd and LB Online & Export Pty Ltd d/b/a Love To Dream Online and Exports* (Patent Owner) (copy not provided).
Merriam-Webster definition of "Resilient"; www.merriam-webster.com/dictionary/resilient; accessed Jun. 30, 2012.
Duomiaomiao Baby Transition Swaddle Blanket, [online]; [published to the internet on Dec. 29, 2023]; [retrieved rom the internet on May 23, 2024]; URL:https://www.amazon.com/dp/BOC R5Q6W54?encoding= U TF8&ref=cm_sw_r cp_ud_dp _80YEAZR6BDSYH4JDHC73&ref_ =cm_sw_r_cp_ud_dp_80 . . . (6 pages). (Year: 2023).
Love To Dream I Transition Bag Lite, [online]; [review published to the internet on Dec. 4, 2019]; [retrieved rom the internet on May 23, 2024]; URL: https://lovetodream.com/us-en/all-products/swaddle-uptm-transition-bag-original-1 0-tog?v=2461. (5 pages). (Year: 2019).
Love to Dream Swaddle Up Transition Swaddle, [online]; [published to the internet on Oct. 27, 2017]; [retrieved rom the internet on May 23, 2024]; URL:https://www.amazon.com/dp/B0081 GIYTE?encoding=UTF8&psc=1 & ref=cm_sw_r_cp_ud_dp_KE6EZ7N7D3BDP4BAMYN4&ref_ =cm_sw_r_cp_ud_ . . . (8 pages). (Year: 2017).
Woombie Grow with Me Air Baby Convertible Swaddle Blanket, [online]; [published to the internet on Mar. 8, 2021]; [retrieved rom the internet on May 23, 2024]; URL: https://www.amazon.com/Woombie-Convertible-Swaddle-Blanket-Wearable/dp/B08ZD RJ7RV?ref_=ast_sto_dp&th=1&psc=1. (8 pages). (Year: 2021).
Non-Final Office Action in U.S. Appl. No. 29/873,652, dated Jul. 31, 2024 (26 pages).

* cited by examiner

CONVERTIBLE INFANT APPAREL

TECHNICAL FIELD

The present disclosure relates generally to convertible infant apparel, including convertible swaddling garments.

BACKGROUND

A natural startle reflex is seen in infants from birth to around 6 months of age. When the startle reflex is triggered (for example, by loud noise, sudden movement, or light), infants throw back their heads, extend their arms outward at the shoulder and straighten them, and then pull their arms back in toward their bodies. If triggered while an infant is sleeping, the startle reflex may wake him/her. Swaddling techniques attempt to suppress the startle reflex to prevent the startle reflex from waking up the infant. Traditional infant swaddles wrap an infant tightly so as to compress the infant's arms against its body, thereby inhibiting movements associated with the startle reflex. Such swaddles often hold infants' arms in place by their sides or across their torsos.

Non-nutritive sucking (e.g., sucking on a pacifier or on the hands) can have a soothing effect on infants. Traditional swaddling techniques may inhibit an infant's ability to engage in self-soothing via non-nutritive sucking. Further, some infants may prefer to sleep with their arms raised and may try to fight against a swaddle that maintains the arms in an "arms-down" position, i.e., across the torso or down by their sides. Some infant garments include features that allow an infant to engage in non-nutritive sucking while still inhibiting the startle reflex. For example, the SWADDLE UP garment from Love to Dream allows an infant to adopt an "arms-up" position, in which the infant can non-nutritively suck on his/her hands through the fabric of the garment. However, different positions may be appropriate for an infant at different times or under different circumstances. Further, parents may want to try both an "arms-up" and an "arms-down" swaddle to determine which swaddle type their infant prefers. Therefore, a need exists for convertible infant apparel, such as convertible swaddling garments, that allow alternatively for arms-up and arms-down swaddling.

SUMMARY

In accordance with this disclosure, an article of infant apparel may comprise a bodice portion; a pair of wing portions, wherein each wing portion of the pair of wing portions is attached to a side of the bodice portion; and a pair of closures, each closure located at a junction between the bodice portion and one of the pair of wing portions. In a first configuration, the pair of closures may be open, and each of the wing portions may be expanded, such that the wing portions extend laterally from opposite sides of the bodice portion and define a portion of an outer perimeter of the article of infant apparel. In a second configuration, the pair of closures may be closed, and each of the wing portions may be collapsed into and retained within the bodice portion by a respective closure, such that the junction defines a portion of an outer perimeter of the article of infant apparel.

Any of the articles of infant apparel disclosed herein may include any of the following features, alone or in any combination. A width of the article of infant apparel at a widest portion of the wing portions may be at least approximately 10% greater than a width of the bodice portion. A widest portion of the article of infant apparel across the wing portions in the first configuration may be between approximately 20% and approximately 50% greater than a width of the bodice portion of the article of infant apparel in the second configuration. The closure may include at least one of a zipper, a snap, a button, or hook-and-loop material. The article may further comprise a waist portion; and a lower portion. In the first configuration, an outer perimeter of the wing portion may be continuous with an outer perimeter of the waist portion and the lower portion. Each wing portion may include an upper portion and a lower portion. In the first configuration, the upper portion may extend further laterally from a respective side of the bodice portion than the lower portion does, and the wing portion may taper inward from the upper portion to the lower portion. Each of the wing portions may extend from a first junction end to a second junction end on a respective side of the bodice portion. Each of the pair of closures may extend from the first junction end to the second junction end on the respective side of the bodice portion. In the first configuration, a width of each wing portion at a widest point may be at least approximately 10% of a width of the bodice portion.

In another example, an article of infant apparel may comprise an upper portion configured to at least partially receive a torso of an infant. In a first configuration, the upper portion may have a first width, such that the upper portion is configured to retain arms of the infant in a hand-raised and elbow-bent position within the upper portion. In a second configuration, the upper portion may have a second width, smaller than the first width, such that the upper portion is configured to retain the arms of the infant across a torso of the infant or down by the sides of the infant.

Any of the articles described herein may include any of the following features, alone or in any combination. The upper portion may include a central bodice portion. In the first configuration, the upper portion may include two wing portions, each wing portion extending from an opposite side of the bodice portion. In the second configuration, each of the two wing portions may be retained within the bodice portion by a closure. The article of infant apparel may further comprise a pair of closures, each closure extending along where a wing portion attaches to the bodice portion. In the second configuration, each of the two wing portions may be detached from the bodice portion, and each of the two closures may be closed to retain the arms of the infant within the article of infant apparel. In a third configuration, each of the two wing portions may be detached from the bodice portion, and each of the two closures may be opened to allow the arms of the infant to extend outside of the article of infant apparel. A width of a widest portion of the upper portion in the first configuration may be at least approximately 10% larger than a width of the widest portion of the upper portion in the second configuration.

In a further example, an article of infant apparel may comprise: a bodice portion and a wing portion. In a first configuration, the wing portion may be expanded, such that the wing portion extends laterally from a side of the bodice portion and is configured to receive an arm of an infant and to retain the arm of the infant in an arm-up position. In a second configuration, the wing portion may be contracted within the bodice portion or detached from the bodice portion, such that the bodice portion is configured to receive and retain the arm of the infant in an arm-down position.

Any of the articles of infant apparel disclosed herein may include any of the following features. In the first configuration, the wing portion may be configured to retain the arm of the infant in a hand-raised and elbow-bent position within the wing portion. In the first configuration, a width of the article of infant apparel at a widest portion of the wing portions may be at least approximately 6.5% greater than a width of the bodice portion. In the second configuration, the bodice portion may be configured to retain the arm of the infant across a torso of the infant or pointing downward. The article of infant apparel may further comprise a closure configured to transition the article of infant apparel clothing from the first configuration to the second configuration. The closure may be open in the first configuration and closed in the second configuration. The wing portion is a first wing portion, and the article of infant apparel may further comprise a second wing portion. In a first configuration, each wing portion may be expanded, such that each wing portion extends laterally from opposite sides of the bodice portion and is configured to receive an arm of an infant and to retain the arm of the infant in an arms-up position. In a second configuration, each wing portion may be contracted within the bodice portion or detached from the bodice portion, such that the bodice portion is configured to receive and retain the arms of the infant in an arms-down position.

Other objects, features, and advantages of the present disclosure will become apparent from the following detailed description. It should be understood, however, that the detailed description and the examples, while indicating exemplary embodiments of the present disclosure, are given by way of illustration only, since various changes and modifications within the spirit and scope of the invention will become apparent to those skilled in the art from this detailed description.

The singular forms "a," "an," and "the" include plural reference unless the context dictates otherwise. The terms "approximately" and "about" refer to being nearly the same as a referenced number or value. As used herein, the terms "approximately," about," "substantially," "generally," or the like should be understood to encompass ±10% of a specified amount or value, unless otherwise specified. The use of the term "or" in the claims and specification is used to mean "and/or" unless explicitly indicated to refer to alternatives only or the alternatives are mutually exclusive, although the disclosure supports a definition that refers to only alternatives and "and/or." Both the foregoing general description and the following detailed description are exemplary and explanatory only and are not restrictive of the features, as claimed. As used herein, the terms "comprises," "comprising," "including," "having," or other variations thereof, are intended to cover a non-exclusive inclusion such that a process, method, article, or apparatus that comprises a list of elements does not include only those elements, but may include other elements not expressly listed or inherent to such a process, method, article, or apparatus. Additionally, the term "exemplary" is used herein in the sense of "example," rather than "ideal." In addition, the term "between" used in describing ranges of values is intended to include the minimum and maximum values described herein.

The terms and expressions which have been employed are used as terms of description and not of limitation, and there is no intention that in the use of such terms and expressions of excluding any equivalents of the features shown and described or portions thereof, but it is recognized that various modifications are possible within the scope of the disclosure claimed.

BRIEF DESCRIPTION OF THE DRAWINGS

The following drawings form part of the present specification and are included to further demonstrate certain aspects of the present disclosure. The disclosure may be better understood by reference to one or more of these drawings in combination with the detailed description of exemplary embodiments presented herein.

DETAILED DESCRIPTION

Disclosed herein are items/articles of infant swaddle apparel (i.e., garments or clothing) that are configured to be transitioned between multiple configurations for use in different swaddling positions. The garments described herein may have first configurations, in which the garments include wing portions. In the first configurations, the garments may receive and retain arms of infants in an "arms-up" or "hands-raised" swaddling position. The garments also may have second configurations, in which the wing portions are tucked within bodice portions of the garments or are detached from the garment. In the second configurations, the infants' arms may be positioned in the garments in a "traditional" swaddling position, with their arms retained across their bodies or down at their sides (i.e., pointing downward). Some aspects disclosed herein also may have a third configuration, in which wing portions are removed to reveal openings of the bodice that allow an infant's arms to pass therethrough so that the arms are not retained within the garment. Thus, the disclosed garments may facilitate adopting different swaddling positions at different times, using the same garment. The disclosed garments may thus enable caregivers to avoid purchasing multiple garments for use during different life stages of their infant or depending on their infant's swaddling preference.

As used herein, the terms top, bottom, up, down, left, and right refer to directions of FIGS. 1A, 2A, 3A, 4A, 5A, 6A, 7A, 8A, 9A, 10A-10D, and 11A-11F. As used herein, the term "width" refers to a left/right direction of the aforementioned figures, and the term "height" refers to an up/down direction of the aforementioned figures. The term "depth" refers to a direction into/out of the page of the aforementioned figures. Unless otherwise specified, the garments/articles described herein may be symmetrical along a vertical line running through a center of the garments disclosed herein. Thus, although a left or right side of the garments may be described, the description may apply equally to an opposite side of the garments, but in mirror image. Similarly, although a reference label may be included only on one side of a figure, the same reference number applies to both a left and right side of the garments depicted in the Figures, unless otherwise stated. However, it will be appreciated that various aspects of the garments described herein may be arranged in any suitable combination, such as an asymmetrical arrangement. Any aspect of any of the garments/articles described herein may be combined with any aspect of any other garment/article described herein or with any aspect of any other garments/articles that are known or become known in the future.

Figure 1B:
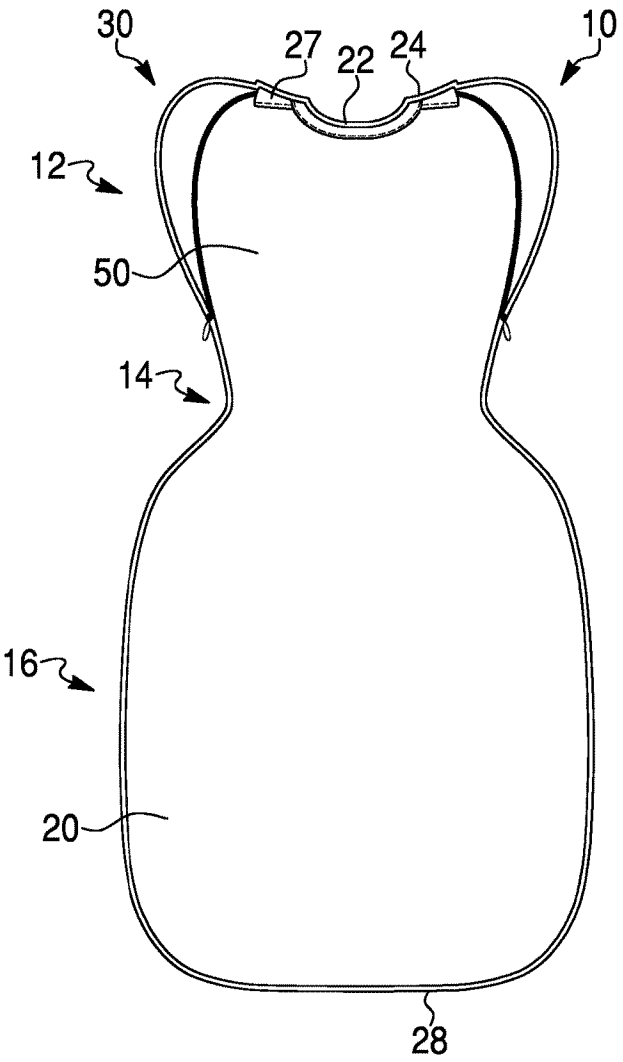
FIGS. 1A-1G depict various views of an exemplary infant garment in a first configuration.
Figure 1A:
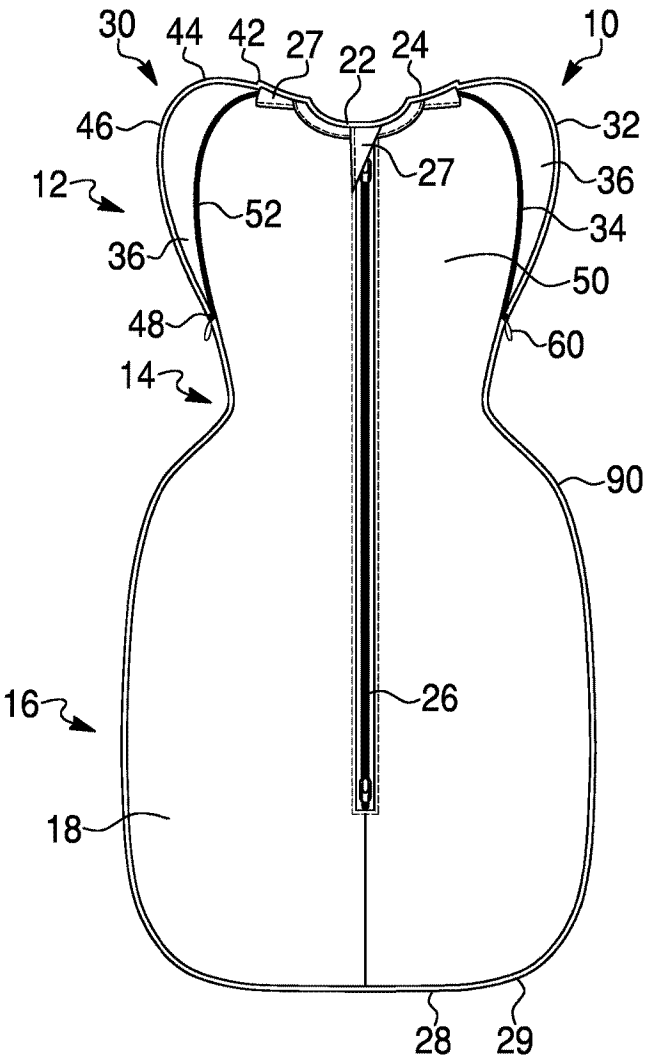
Figure 1D:
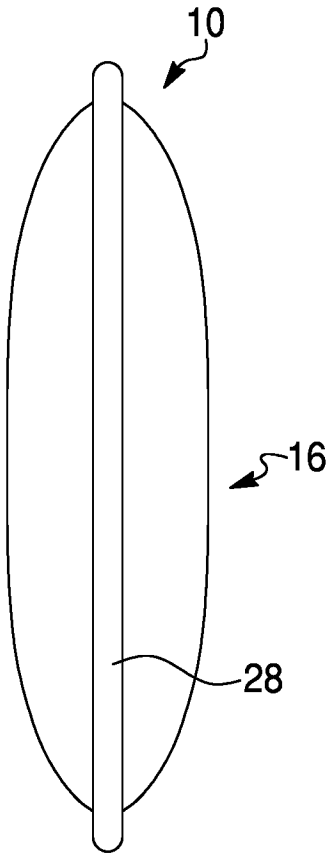
Figure 1C:
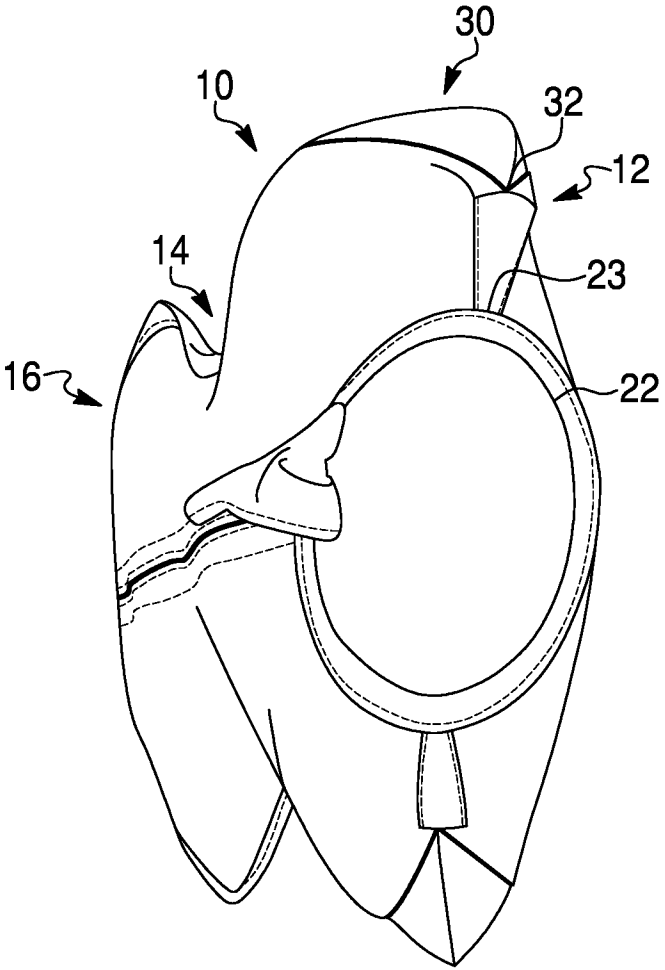
Figure 1F:
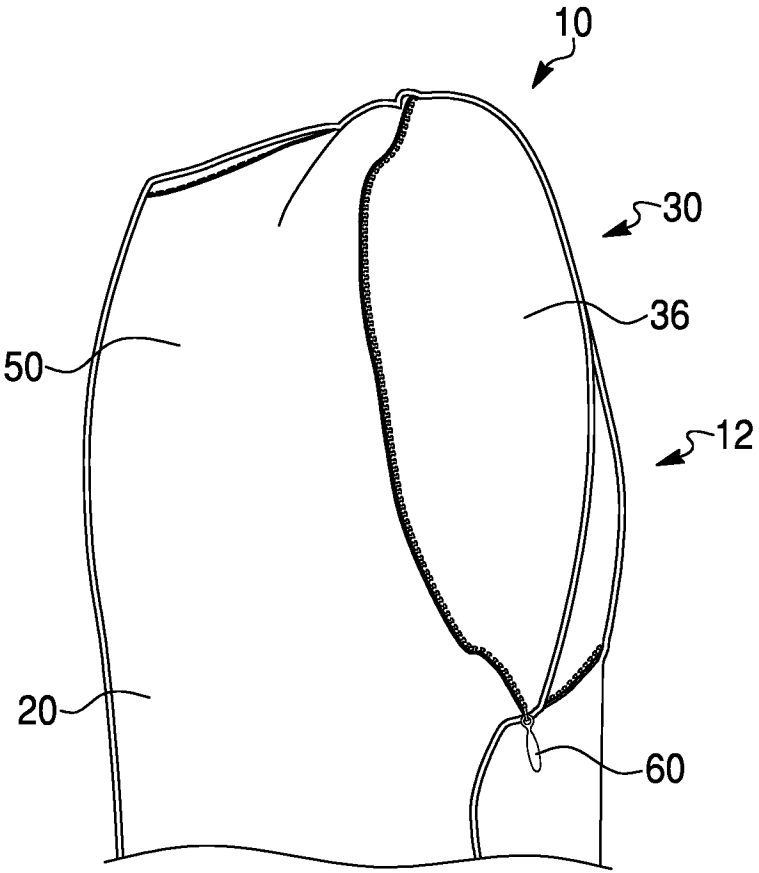
Figure 1E:
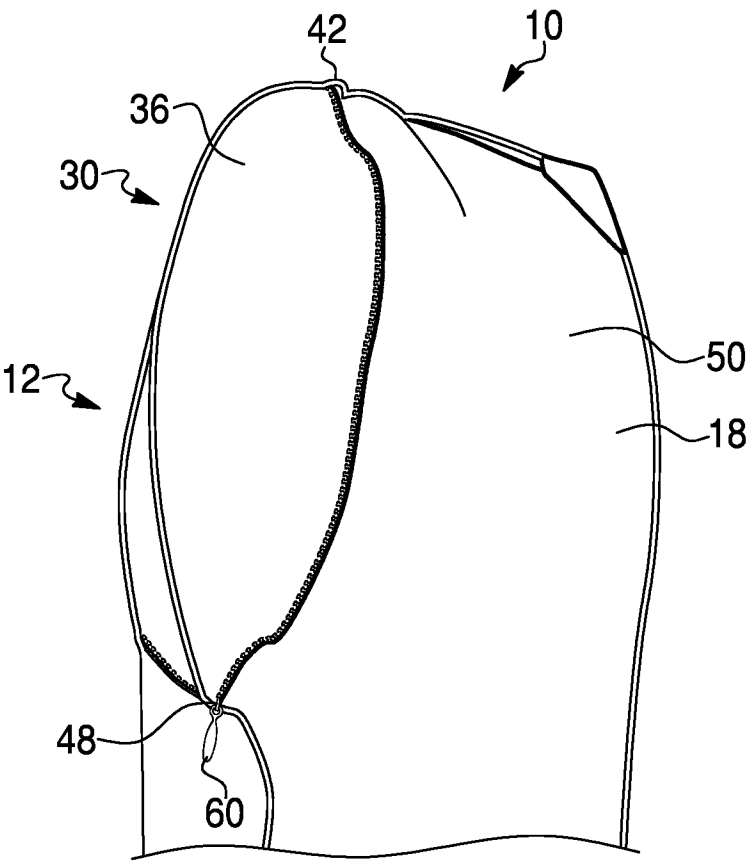
Figure 1G:
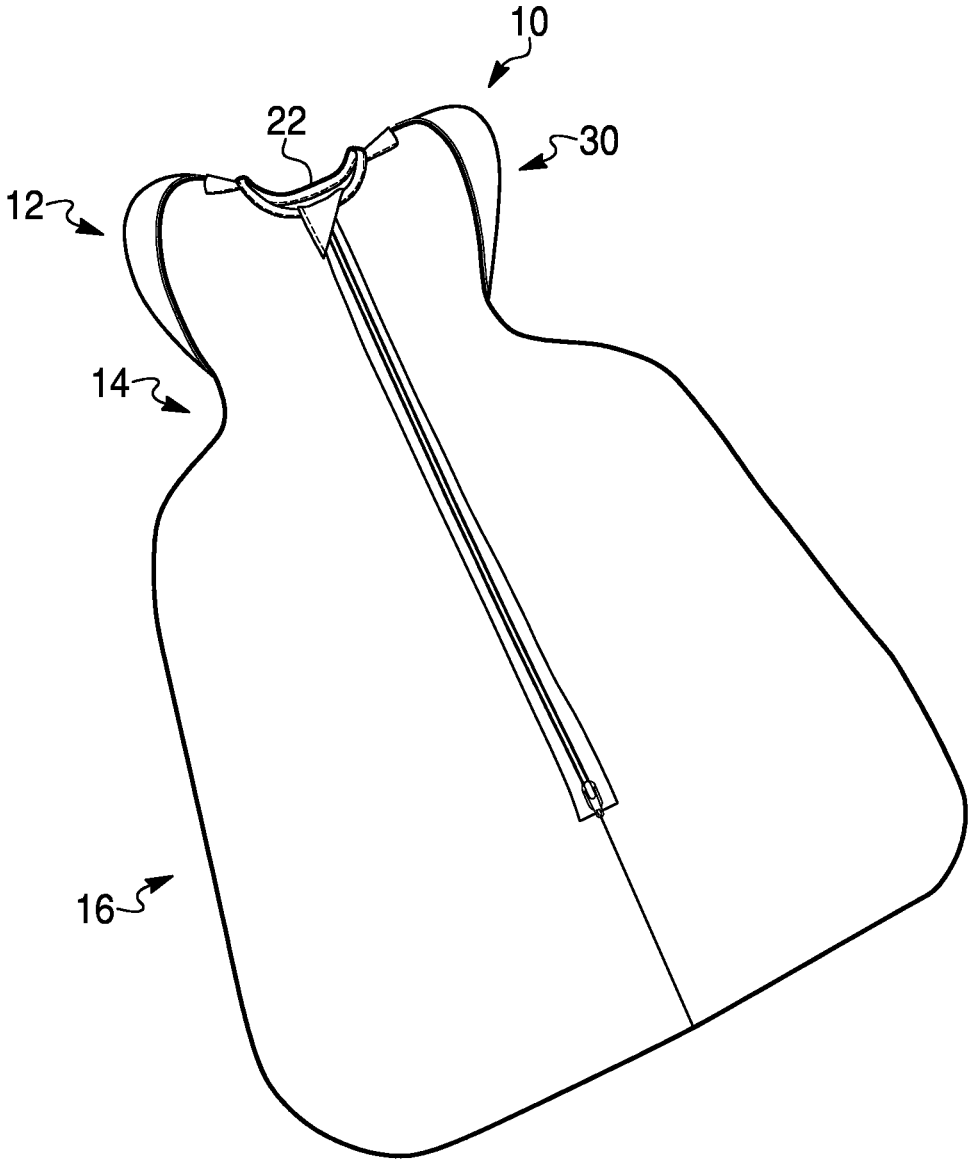
Figure 2B:
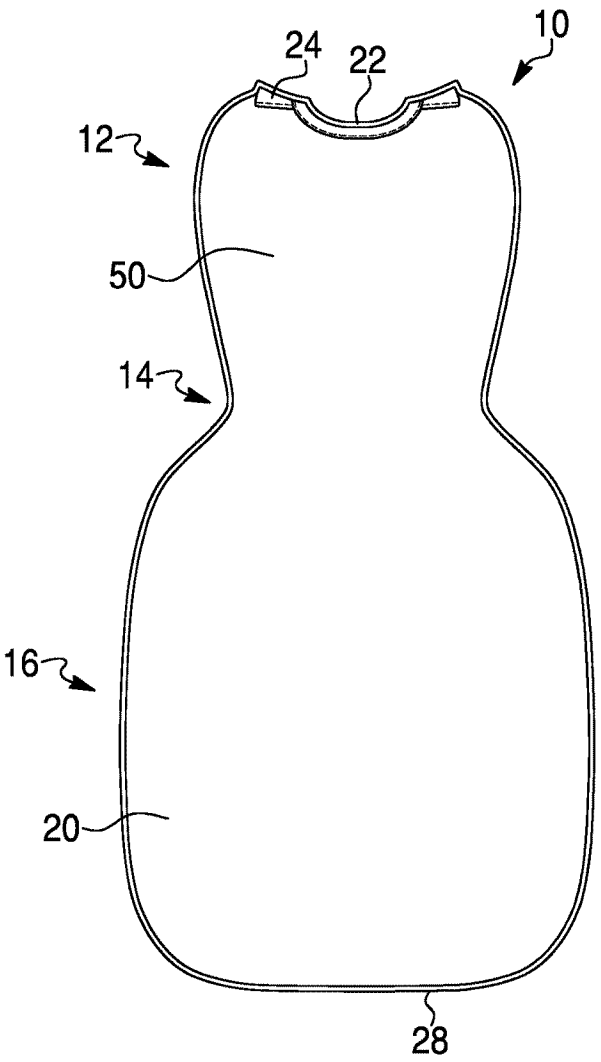
FIGS. 2A-2G depict various views of the exemplary infant garment of FIGS. 1A-1G in a second configuration.
Figure 2A:
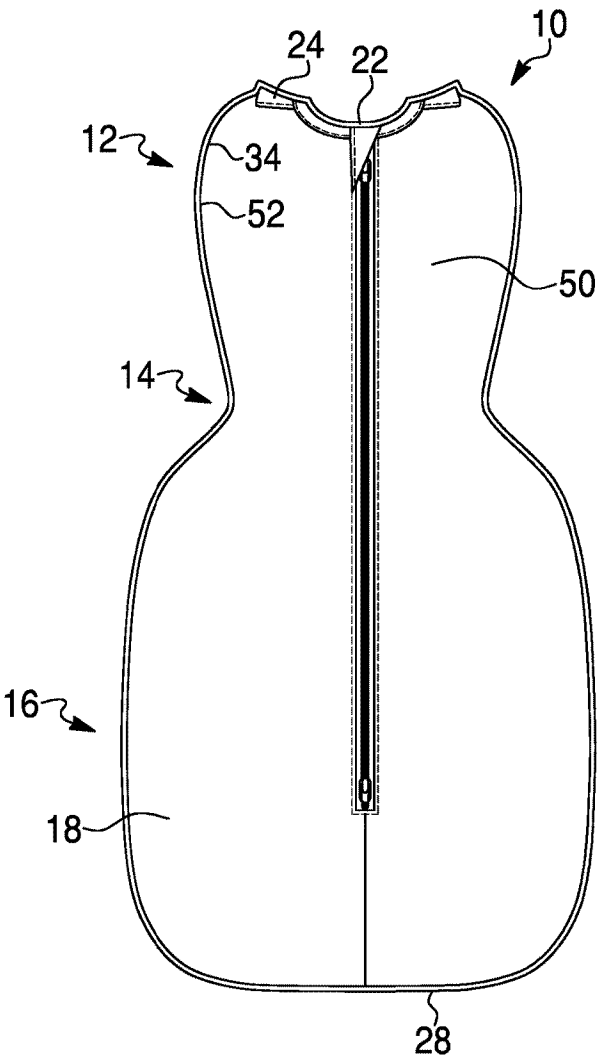
Figure 2D:
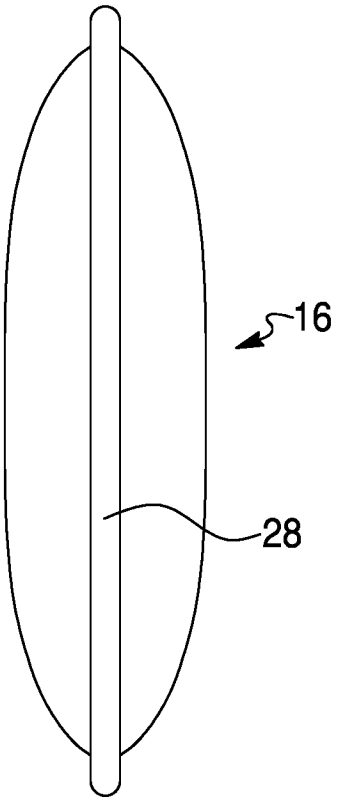
Figure 2C:
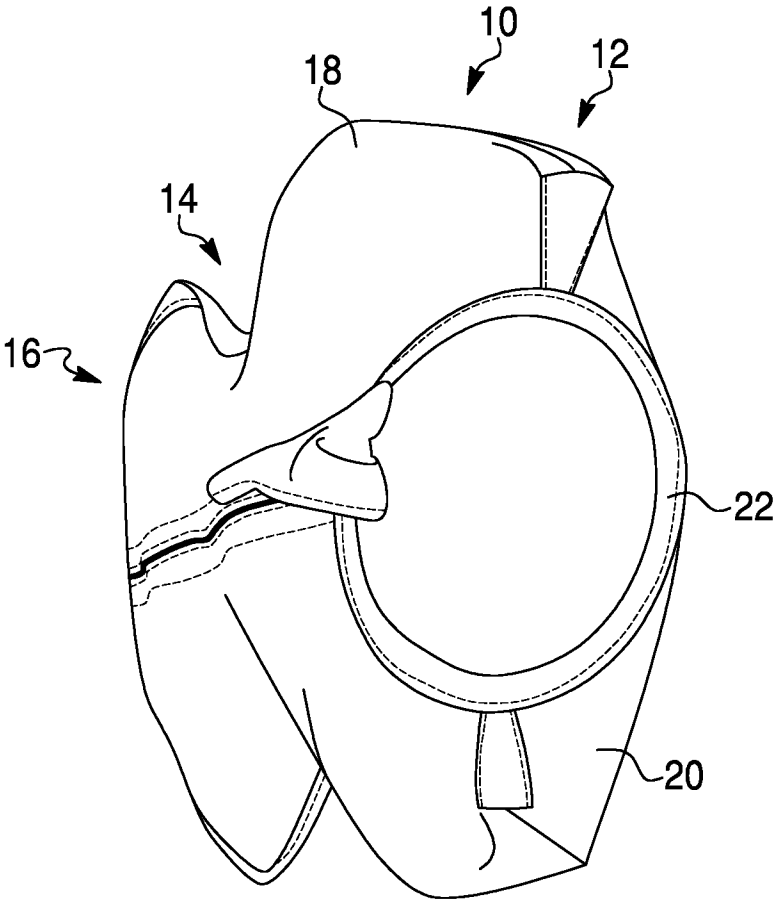
Figure 2F:
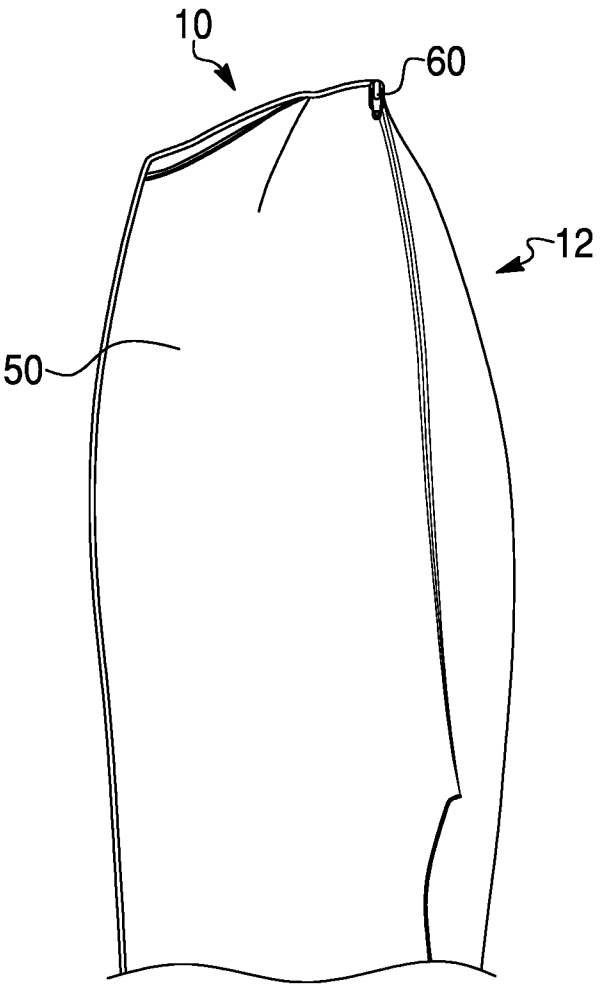
Figure 2E:
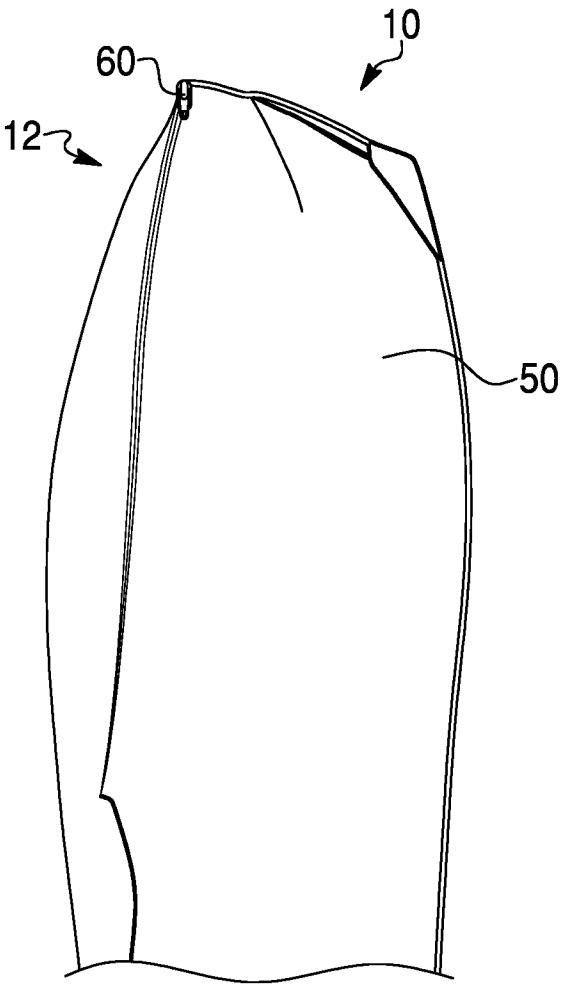
Figure 2G:
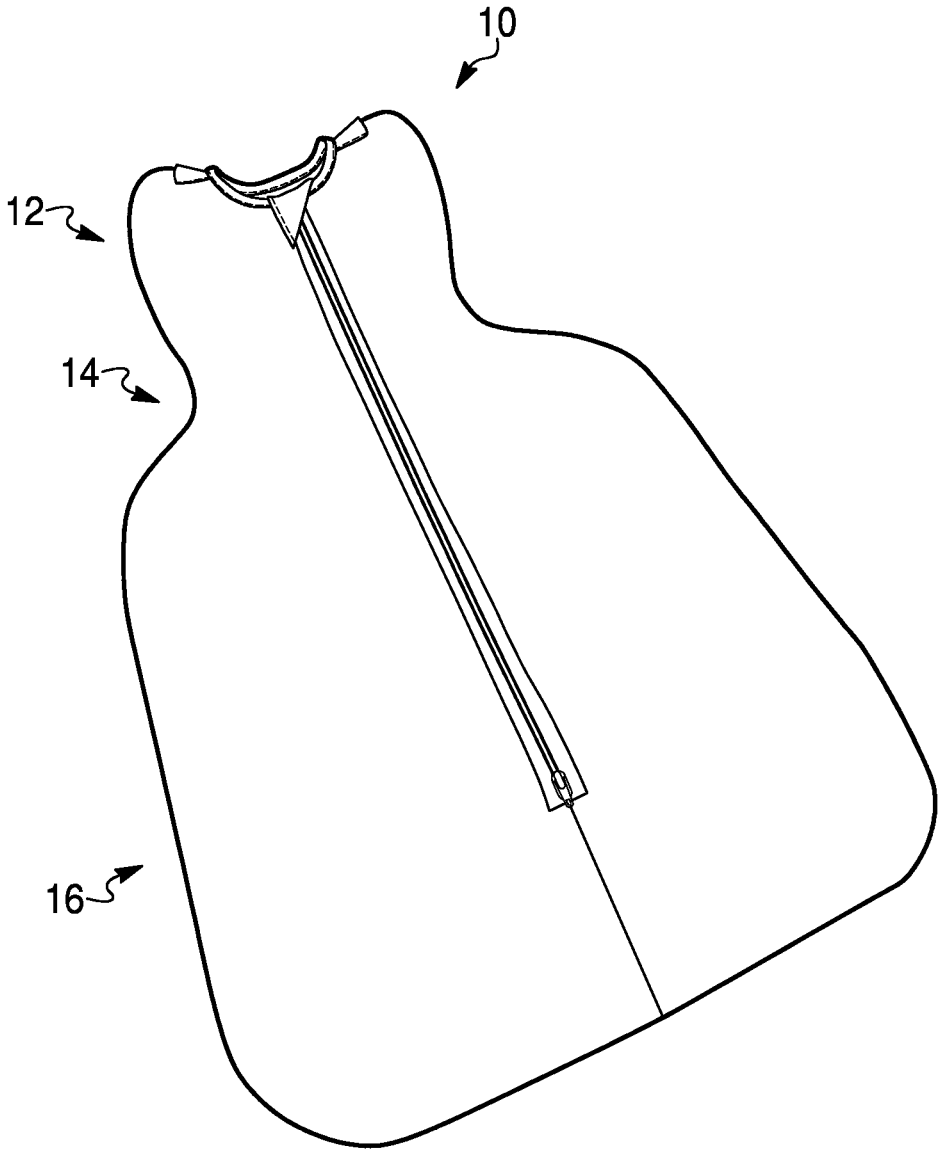
Figure 3B:
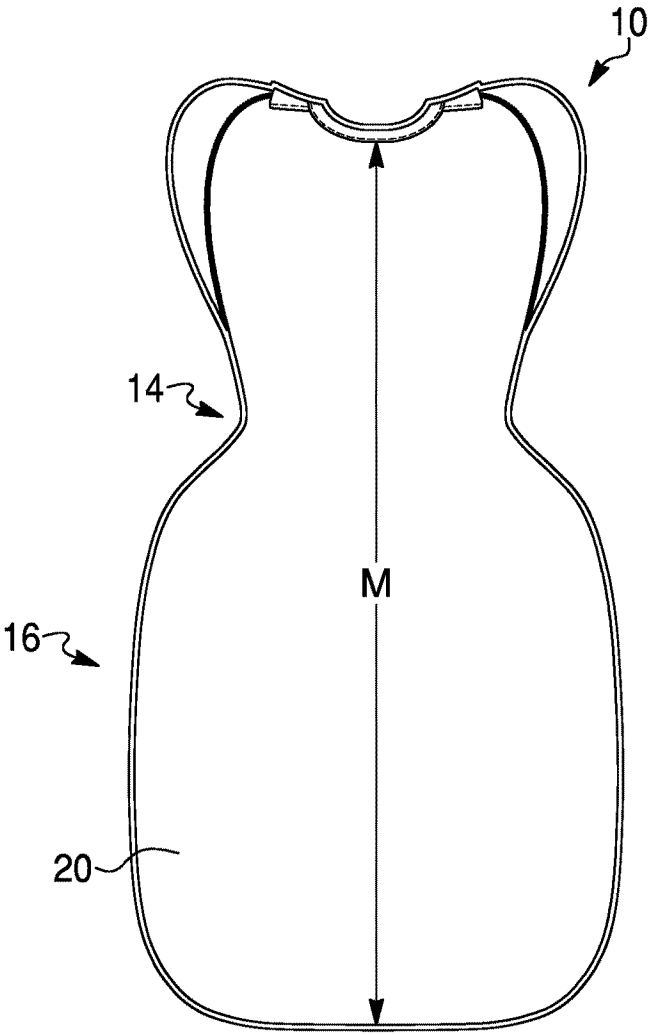
FIGS. 3A-3B depict measurements of the exemplary infant garment of FIGS. 1A-2G.

FIGS. 1A-3B depict an exemplary garment 10. Garment 10 may be used with an infant and may swaddle the infant. Although an infant is referred to herein, it will be appreciated that garment 10 is not limited to infant use and may be used by older children or adults. FIGS. 1A-1G show garment 10 in first, expanded configuration, configured for retaining the infant in an arms-up, elbows bent position, as discussed below. FIGS. 2A-2G show garment 10 in a second, contracted configuration, configured for retaining the infant's arms in an arms-down position with the arms of the infant retained by the infant's sides or across the infant's torso. FIGS. 3A-3B depict garment 10 with select exemplary measurements of garment 10 denoted.

Garment 10 may include an upper portion 12, a waist portion 14, and a lower portion 16. Waist portion 14 may be disposed between upper portion 12 and lower portion 16, and may or may not align with the waist of an infant when an infant is positioned within the garment. Garment 10 may have a front side 18 (as shown in, e.g., FIGS. 1A, 2A) and a back side 20 (as shown in, e.g., FIGS. 1B, 2B). A collar 22 of upper portion 12 may define a neck opening (see FIG. 1C). A shoulder portion 24 may extend outward, away from collar 22. Collar 22 may have any suitable shape, including, e.g., a U-shape, a V-shape, a rounded shape, or an alternative shape. A closure/fastener, such as a zipper 26, may extend from collar 22 toward lower portion 16. Zipper 26 may extend at least partially into lower portion 16, but not entirely to a lower hem 28 of lower portion 16, as is shown in FIGS. 1A, 1D. In other embodiments, zipper 26, or another suitable closure/fastener (e.g., buttons, snaps, buckles, hooks and eyes, hook and loop fasteners, magnets, laces/ties, or pins, etc.) may extend to hem 28, may extend to waist portion 14, or may extend any suitable amount for inserting an infant into garment 10. When zipper 26 is unzipped, zipper 26 may be open at collar 22. A zipper shield 27 may receive a pull of zipper 26 when zipper 26 is in a closed, zipped configuration, in order to keep the pull of zipper 26 from irritating an infant wearing garment 10 or from coming unzipped while being worn, although zipper shield 27 is not necessary. Although zipper 26 is depicted as being approximately in a center of front side 18, it will be appreciated that zipper 26 (or any other suitable closure) may be disposed on any location of garment 10 (e.g., offset to one side of garment 10, on back side 20 of garment 10, or on a side of garment 10 (e.g., between front side 18 and back side 20). Multiple zippers 26 (or any other suitable type of fastener) may be utilized.

Lower portion 16 may flare outward below waist portion 14, such that a hip or knee portion 90, referred to herein as hip portion 90 of lower portion 16 may have a greater width (as discussed in further detail below) than a width of waist portion 14. Hip portion 90 may or may not align with a hip of an infant when contained within garment 10. Below hip portion 90, lower portion 16 may have a relatively constant width until lower portion 16 tapers inward near a lower hem 28 of lower portion 16. Below a taper point 29, a lower-most portion of lower hem 28 may be approximately straight (e.g., horizontal in FIGS. 1A and 1). Although FIGS. 1A-3B depict a garment 10 with a lower portion 16 as described above, garment 10 may instead have any of the lower portions shown, e.g., in FIGS. 10A-10D, or may have a lower portion 16 that tapers to a different extent, is wider or narrower, has a curved instead of straight hem 28, or any other suitable shape for a swaddle.

Upper portion 12 may include a central bodice 50 and two wing portions 30 extending laterally from opposite sides of bodice 50. In the first configuration (FIGS. 1A-1G), wing portions 30 may extend laterally outward (away from collar 22) from opposite sides of bodice 50. In the second configuration (FIGS. 2A-2G), wing portions 30 may be collapsed, e.g., folded or scrunched and tucked, into bodice 50. For example, wing portions 30 may be folded or scrunched and inserted into a concealed pocket (not shown) within bodice 50. Thus, wing portions 30 may be hidden within bodice 50. Alternatively, no inner pocket may be included, and wing portions 30 may simply be collapsed into bodice 50. In still other alternatives, wing portions 30 may be folded backward or forward rather than within bodice 50. In other alternatives, as discussed in further detail below, wing portions 30 may be retained in the second configuration by a closure, such as a zipper 60. Alternative types of closures may include buttons, snaps, buckles, hooks and eyes, hook and loop fasteners, magnets, laces/ties, or pins. Wing portions 30 may include a fabric gusset/panel 36 that extends between an outer perimeter 32 (which may be an outer perimeter of wing portions 30 when extended and, in the first configuration, an outer perimeter of garment 10), and an inner perimeter 34 (which may be an outer perimeter of a portion of bodice 50 and, in the second configuration, an outer perimeter of garment 10 when the wing portions 30 are contracted), on both sides 18, 20 of garment 10. Panel 36 may be attached to bodice 50 on each of sides 18, 20, along inner perimeter 34, between a first junction end 42 (i.e., an upper end) and a second junction end 48 (i.e., a lower end). Accordingly, each wing portion 30 may be defined between first junction end 42 and second junction end 48, and each zipper 60 may extend from first junction end 42 to second junction end 48. In this manner, garment 10 may be transitioned between the first and second configurations by zipping or un-zipping zippers 60 to expand or contract wing portions 30. Positions of first junction end 42 and second junction end 48 shown in the Figures are merely exemplary. It will be appreciated, for example, that second junction end 48 may be disposed at any suitable location. For example, zipper 60 may extend toward waist portion 14, with second junction end being at or near waist portion 14 (or anywhere above waist portion 14). Although two wing portions 30 are described herein, it will be appreciated that upper portion 12 may include only a single wing portion 30 within the scope of the disclosure.

Each wing portion 30 may be similar or symmetrical on front side 18 and back side 20. For example, distances between outer perimeter 32 and inner perimeter 34 may be similar or the same on front side 18 and back side 20. In alternatives, each wing portion 30 may be different on front side 18 and back side 20. For example, a distance between outer perimeter 32 and inner perimeter 34 may differ between front side 18 and back side 20, such that each wing portion 30 may be larger on one of front side 18 than on back side 20. Outer perimeter 32 may be continuous with an outer perimeter of waist portion 14 and lower portion 16, such that each wing portion 30 does not define an opening (e.g., for a hand or arm to pass through). In other words, panel 36 may be configured to expand to extend from a portion of garment 10 in the first configuration while still retaining arms of an infant within garment 10 when zippers 60 are unzipped. Garment 10 may be configured to enclose and retain the arms of an infant within wing portions 30 of garment 10 in the first configuration when zipper 26 is zipped up, and zippers 60 are unzipped to allow panel 36 to extend laterally from bodice 50.

Each zipper 60 may run along inner perimeter 34, between first junction end 42 and second junction end 48, forming a boundary between front side 18 and back side 20. As discussed below, each zipper 60 may be opened to release the respective panel 36 and allow the respective wing portion 30 to expand in the first configuration of garment 10 (FIGS. 1A-1G), and each zipper 60 may be closed to tuck panels 36 within bodice 50 to transition garment 10 into the second configuration (FIGS. 2A-2G), thereby hiding and/or concealing panels 36 within bodice 50. A pull of a zipper 60 may be moved in a first direction to open the respective wing portion 30 and expand the respective panel 36 (e.g., the pull may be moved downward), thereby exposing panels 36. As shown in FIGS. 1A, 1B, 1E, and 1F, when garment 10 in the first, expanded configuration (i.e., wing portions 30 are opened/expanded/exposed), the pull of zipper 60 may be located near second junction end 48. Wing portions 30, including respective panels 36 may be tucked within bodice 50 (e.g., wing portions 30 may be closed/inverted/concealed within bodice 50), and zipper 60 may be moved in a second direction (e.g., upward) to retain wing portions 30 within bodice 50. When garment 10 in the second, contracted configuration, the pull of zipper 60 (as shown in FIGS. 2E and 2F) may be near first junction end 42. Alternatively, the pull of each zipper 60 may be located near first junction end 42 when in the first configuration, and may be located near the second junction end 48 when in the second configuration. Either way, when each zipper 60 is in the second configuration, inner perimeter 34 on front side 18 may be brought together with inner perimeter 34 of back side 20 to enclose wing portions 30 within bodice 50, thereby preventing an infant wearer from having its arms in an arms-up/hands-raised, elbows-bent position. Each shoulder portion 24 may include a zipper pocket 61, which may receive a pull of zipper 60 when a pull of zipper 60 is near shoulder portion 24 (e.g., when garment 10 is in the second, contracted configuration). In alternatives, zipper 60 (or an alternative closure) may enclose bodice 50 while leaving wing portions 30 in an expanded configuration, such that an infant's arms are retained within bodice 50 and cannot extend into wing portions 30 when zipper 60 (or an alternative closure) is closed. In such alternatives, garment 10 would have the same or similar outer perimeter (shown in FIGS. 1A-1G) in each configuration of zipper 60 (or an alternative closure), but an infant's arms would be retained within bodice 50 (in an arms-down position) or permitted to extend into wing portions 30 (in an arms-up/hands-raised, elbows-bent position), depending on whether zipper 60 (or an alternative closure) is open or closed).

A shape of outer perimeter 32 of each wing portion 30 in the first, expanded configuration of FIGS. 1A-1G will now be described. First junction end 42 of each zipper 60 may be at, near, or otherwise proximate to shoulder portion 24. Outer perimeter 32 may extend outward (away from shoulder portion 24 and collar 22 and upward. For example, outer perimeter 32 may extend approximately linearly to an apex 44 (a highest/upper-most portion of FIGS. 1A-1B). Or, apex 44 may be approximately even with shoulder portion 24, or apex 44 may be below shoulder portion 24. Outer perimeter 32 may then curve outward further away from shoulder portion 24/collar 22 and downward to a widest point 46. Between widest point 46 and second junction end 48, outer perimeter 32 may taper inward towards bodice 50. In some aspects, outer perimeter 32 may extend more downward than laterally inward between widest point 46 and second junction end 48.

A shape of inner perimeter 34 (which forms a portion of an outer perimeter of garment 10 in the second configuration of FIGS. 2A-2G) is described below. Inner perimeter 34 may define a junction between wing portions 30 and bodice 50. Inner perimeter 34 may have a widest point 52 approximately halfway between first junction end 42 and second junction end 48. Inner perimeter 34 may extend laterally outward from first junction end 42 to widest point 52. Inner perimeter 34 may extend laterally outward at a decreasing rate between first junction end 42 and widest point 52. For example, a width of inner perimeter 34 may increase more near shoulder portion 24 than near widest point 52. From widest point 52 to second junction end 48, outer perimeter 32 may taper inwards (in a direction more downward than laterally in).

Although the above description discusses the first configuration (FIGS. 1A-1G) and the second configuration (FIGS. 2A-2G), garment 10 also may have a third configuration, in which one wing portion 30 may be expanded, and one wing portion 30 may be contracted. For example, a left wing portion 30 may be expanded (as shown in FIGS. 1A-1G), and a right wing portion 30 may be contracted/tucked into bodice 50 and secured within by closed zipper 60 (as shown in FIGS. 2A-2G). In another example, the right wing portion 30 may be expanded (as shown in FIGS. 1A-1G), and the left wing portion 30 may be contracted/tucked into bodice 50 and secured within by closed zipper 60.

Figure 3A:
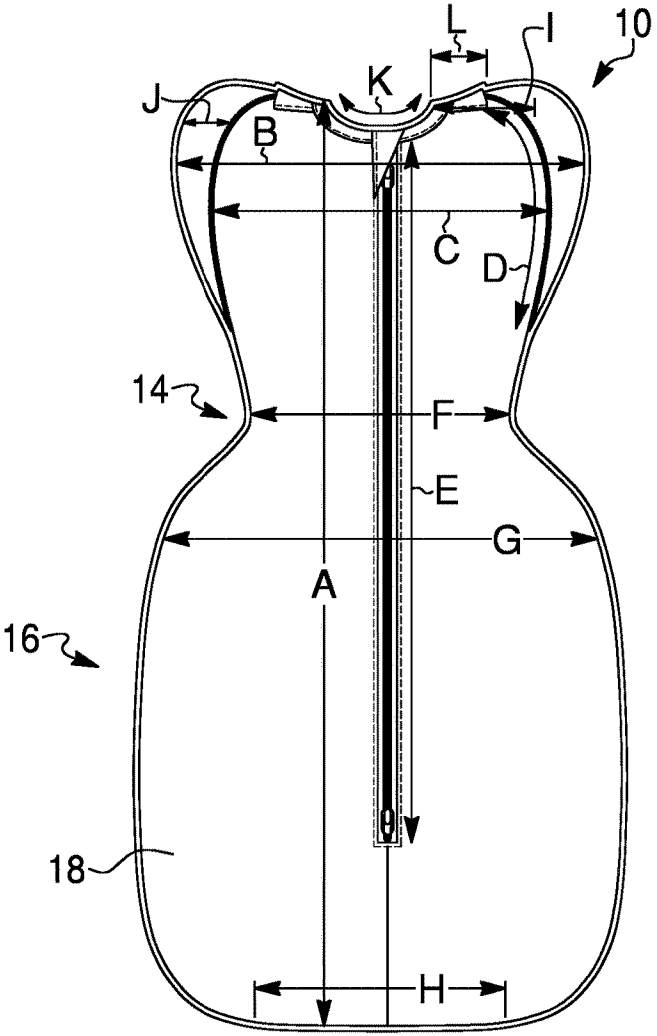

Exemplary measurements of garment 10 are provided below, with reference to FIGS. 3A and 3B. FIG. 3A may be identical to FIG. 1A, but with measurement values denoted. FIG. 3B may be identical to FIG. 1B but with measurement values denoted. Measurements may differ for different sizes of garment 10, e.g., x-small, small, medium, large, and x-large sizes.

In a first example, a garment may be designed to fit an infant between approximately 6.0 kg and approximately 8.5 kg. In some examples, relative proportions of the below measurements may be maintained across different sizes. Alternatively, different sizes of garment 10 may have different measurements. Other exemplary sizes of garment are discussed below. Measurement A in FIG. 3A may extend from a side of collar 22 to lower hem 28 on front side 18 and may be between approximately 55 cm and approximately 71 cm, between approximately 60.0 cm and approximately 67 cm, approximately 64 cm, approximately 63 cm, or approximately 61 cm. In the first configuration, a width B from widest point 46 of one wing portion 30 (e.g., the left wing portion 30) to widest point 46 of the other wing portion 30 (e.g., the right wing portion 30) may be between approximately 23 cm and approximately 39 cm, between approximately 27 cm and approximately 35 cm, approximately 30.0 cm, approximately 31.5 cm, or approximately 33 cm. A portion of width B extending across bodice 50 (not including wing portions 30 on either side of bodice 50) may be between approximately 13 cm and approximately 26 cm, between approximately 15 cm and approximately 28 cm, approximately 19 cm, approximately 21 cm, approximately 22 cm, or approximately 26 cm. A portion of width B extending across each wing portion 30 may be between approximately 1.5 cm and approximately 10 cm, between approximately 2.5 cm and approximately 7 cm, approximately 3.5 cm, approximately 4.5 cm, or approximately 6 cm. Widest point 46 of each wing portion 30 may be located between approximately 3.0 cm and approximately 10.0 cm, between approximately 4.0 cm and approximately 8.0 cm, or approximately 6.0 cm below apex 44 of wing portion 30 (in a downward direction of FIG. 3A). A width C from widest point 52 of one side of bodice 50 (e.g., a left side) to widest point 52 of the other side of bodice 50 (e.g., a right side) may be between approximately 16 cm and approximately 32 cm, between approximately 18 cm and approximately 28 cm, approximately 19 cm, approximately 22 cm, approximately 24 cm, or approximately 26 cm. Width C may correspond to a widest portion of upper portion 12 in the second configuration (i.e., across a chest or torso when zipper 26 is closed). A length D of zipper 60 (used to transition from the first configuration to the second configuration), and thus of wing portion 30, may be between approximately 20 cm and approximately 35 cm, between approximately 23 cm and approximately 30 cm, approximately 25 cm, or approximately 27 cm. A length E of zipper 26 (used to position an infant in garment 10) may be between approximately 40.0 cm and approximately 60.0 cm, between approximately 45 cm and approximately 55 cm, approximately 50.0 cm, or approximately 49 cm). A width F of garment 10 at waist portion 14 (which may be, e.g., a narrowest point of garment 10 below wing portion 30) may be between approximately 15 cm and approximately 26 cm, between approximately 17 cm and approximately 23 cm, approximately 20 cm, or approximately 19 cm. A width G across a hip/knee of garment 10 may be between approximately 25 cm and approximately 41 cm, between approximately 28 cm and approximately 38 cm, approximately 34 cm, approximately 33 cm, or approximately 32 cm. A width H between taper point 29 on one side of lower portion 16 (e.g., a left side) and taper point 29 on an opposite side of lower portion 16 (e.g., a right side) may be between approximately 15 cm and approximately 29 cm, between approximately 20 cm and approximately 24 cm, or approximately 22 cm. A distance I, along an up/down direction of FIG. 3A, from an upper portion of collar 22 to apex 44 may be between approximately 0.50 cm and approximately 6.0 cm, between approximately 1.0 cm an approximately 4.0 cm, approximately 2.5 cm, or approximately 2.0 cm). In other aspects, apex 44 may not extend above an upper portion of collar 22. A width J of wing portion 30 (between outer perimeter 32 and inner perimeter 34) measured at a point approximately 5.0 cm down from apex 44 (in a direction of FIG. 3A) may be between approximately 2.0 cm and approximately 7 cm, between approximately 3.5 cm and approximately 5.5 cm, or approximately 4.5 cm. A circumference/perimeter K of the neck opening defined by collar 22 (when the neck opening is not being worn by an infant) may be between approximately 19 and approximately 30 cm, between approximately 21 cm and approximately 28 cm, or approximately 24 cm. When the garment is being worn and the neck opening being stretched, measurement K may be approximately 25 cm to approximately 45 cm, approximately 30.0 cm to approximately 40.0 cm, or approximately 35 cm. Zipper shield 27 may have a greatest width L (e.g., a width at a top of zipper shield 27) of between approximately 2 cm and approximately 6 cm, between approximately 3 cm and approximately 5 cm, or approximately 4 cm. On back side 20, a length M between a center of collar 22 (e.g., below a binding of collar 22) to lower hem 28 may be between approximately 53 cm and approximately 69 cm, between approximately 58 cm and approximately 64 cm, approximately 61.5 cm, or approximately 61 cm.

In another example, a garment may be designed to fit an infant between approximately 2.2 kg and approximately 3.8 kg. The measurements referred to below use the same reference letters as used above. Where a measurement referenced above is not mentioned below, it will be appreciated that the measurement may have any value identified above or any other suitable value. Measurement A may be between approximately 45 cm and approximately 60 cm, between approximately 47.0 cm and approximately 56 cm, approximately 50.0 cm, approximately 52 cm, or approximately 53 cm. Width B may be between approximately 21 cm to approximately 35 cm, between approximately 24 cm and approximately 33 cm, approximately 26.5 cm, or approximately 29 cm. A portion of width B extending across bodice 50 (not including wing portions 30 on either side of bodice 50) may be between approximately 10 cm and 30 cm, between approximately 13 cm and approximately 22 cm, approximately 16 cm or approximately 19 cm. A portion of width B extending across each wing portion 30 may be between approximately 1.0 cm and 9 cm, between approximately 3.5 cm and approximately 7.5 cm, or approximately 5.5 cm. Width C may be between approximately 13 cm and approximately 29 cm, between approximately 17 cm and approximately 25 cm, approximately 19 cm, approximately 21 cm, or approximately 22 cm. Length D may be between approximately 15 cm to approximately 29 cm, between approximately 19 cm and approximately 25 cm, or approximately 22 cm. Width F may be between approximately 12 cm and approximately 22 cm, between approximately 14 cm and approximately 20 cm, approximately 16 cm, or approximately 17 cm. Width G may be between approximately 18 cm and approximately 32 cm, between approximately 20 cm and approximately 29 cm, approximately 22 cm, approximately 26 cm, or approximately 27 cm. Distance I may be between approximately 0.50 cm and approximately 6.0 cm, between approximately 1.0 cm an approximately 4.0 cm, or approximately 2.0 cm. Width J may be between approximately 2.0 cm and approximately 6 cm, between approximately 3.0 cm and approximately 5.0 cm, or approximately 4.0 cm. Width L may be between approximately 2 cm and approximately 6 cm, between approximately 3 cm and approximately 5 cm, or approximately 4 cm. Length M may be between approximately 43 cm and approximately 57 cm, between approximately 46 cm and approximately 54 cm, approximately 51 cm, or approximately 50.7 cm.

In another example, a garment may be designed to fit an infant between approximately 3.5 kg and approximately 6.0 kg. The measurements referred to below use the same reference letters as used above. Where a measurement referenced above is not mentioned below, it will be appreciated that the measurement may have any value identified above or any other suitable value. Measurement A may be between approximately 50 cm and approximately 62 cm, between approximately 51 cm and approximately 59 cm, approximately 53 cm, approximately 55 cm, or approximately 56 cm. Width B may be between approximately 18 cm to approximately 38 cm, between approximately 23 cm and approximately 32 cm, approximately 27.5 cm, or approximately 28 cm. A portion of width B extending across bodice 50 (not including wing portions 30 on either side of bodice 50) may be between approximately 13 cm and approximately 27 cm, between approximately 15 cm and approximately 22.5 cm, approximately 17 cm, or approximately 20.5 cm. A portion of width B extending across each wing portion 30 may be between approximately 1.0 cm and 9.0 cm, between approximately 3.75 cm and approximately 7.75 cm, or approximately 5.75 cm. Width C may be between approximately 13 cm and approximately 29 cm, between approximately 15 cm and approximately 25 cm, approximately 17 cm, or approximately 20.5 cm. Length D may be between approximately 17 cm to approximately 31 cm, between approximately 21 cm and approximately 27 cm, or approximately 24 cm. Width F may be between approximately 13 cm and approximately 24 cm, between approximately 14 cm and approximately 21 cm, approximately 17 cm, or approximately 18 cm. Width G may be between approximately 20 cm and approximately 38 cm, between approximately 23 cm and approximately 34 cm, approximately 25 cm, approximately 30 cm, or approximately 31 cm. Distance I may be between approximately 0.50 cm and approximately 6.0 cm, between approximately 1.0 cm an approximately 4.0 cm, or approximately 2.0 cm. Width J may be between approximately 2.0 cm and approximately 6.0 cm, between approximately 3.0 cm and approximately 5.0 cm, or approximately 4.0 cm. Width L may be between approximately 2 cm and approximately 6 cm, between approximately 3 cm and approximately 5 cm, or approximately 4 cm. Length M may be between approximately 46 cm and approximately 61 cm, between approximately 50.0 cm and approximately 57 cm, or approximately 53.5 cm.

In another example, a garment may be designed to fit an infant between approximately 8.5 kg and approximately 11 kg. The measurements referred to below use the same reference letters as used above. Where a measurement referenced above is not mentioned below, it will be appreciated that the measurement may have any value identified above or any other suitable value. Measurement A may be between approximately 62 cm and approximately 82 cm, between approximately 65 cm and approximately 77 cm, approximately 68.5 cm, approximately 71 cm, or approximately 72 cm. Width B may be between approximately 25 cm to approximately 45 cm, between approximately 28 cm and approximately 37 cm, approximately 32 cm, or approximately 33.5 cm. A portion of width B extending across bodice 50 (not including wing portions 30 on either side of bodice 50) may be between approximately 15 cm and approximately 28.5 cm, between approximately 17 cm and approximately 26.5 cm, approximately 20.5 cm, or approximately 23.5 cm. A portion of width B extending across each wing portion 30 may be between 2.0 cm and 10 cm, between approximately 4.25 cm and approximately 8.25 cm, or approximately 6.25 cm. Width C may be between approximately 16 cm and approximately 32 cm, between approximately 18.5 cm and approximately 28 cm, approximately 20.5 cm, approximately 23.5 cm, or approximately 25 cm. Length D may be between approximately 20 cm and approximately 32 cm, between approximately 23 cm and approximately 29 cm, or approximately 26 cm. Width F may be between approximately 15 cm and approximately 29 cm, between approximately 19 cm and approximately 25 cm, approximately 21 cm, or approximately 22 cm. Width G may be between approximately 22 cm and approximately 43 cm, between approximately 25 cm and approximately 40 cm, approximately 28.5 cm, approximately 35.5 cm, or approximately 36.5 cm. Distance I may be between approximately 0.50 cm and approximately 6.5 cm, between approximately 1.0 cm an approximately 4.5 cm, or approximately 2.5 cm. Width J may be between approximately 3.0 cm and approximately 8.0 cm, between approximately 5.0 cm and approximately 6.0 cm, or approximately 5.0 cm. Width L may be between approximately 2 cm and approximately 6 cm, between approximately 3 cm and approximately 5 cm, or approximately 4 cm. Length M may be between approximately 59.5 cm and approximately 79.5 cm, between approximately 65 cm and approximately 64 cm, or approximately 69.5 cm.

In another example, a garment may be designed to fit an infant between approximately 11 kg and approximately 14 kg. The measurements referred to below use the same reference letters as used above. Where a measurement referenced above is not mentioned below, it will be appreciated that the measurement may have any value identified above or any other suitable value. Measurement A may be between approximately 70 cm and approximately 91 cm, between approximately 75 cm and approximately 86 cm, approximately 77 cm, approximately 79.5 cm, or approximately 80.5 cm. Width B may be between approximately 27 cm to approximately 47 cm, between approximately 30 cm and approximately 42 cm, approximately 35.5 cm, or approximately 37 cm. A portion of width B extending across bodice 50 (not including wing portions 30 on either side of bodice 50) may be between approximately 17 cm and approximately 30 cm, between approximately 20 cm and approximately 28 cm, approximately 23.5 cm, or approximately 25 cm. A portion of width B extending across each wing portion 30 may be between 2.0 cm and 11 cm, between approximately 4.5 cm and approximately 8.5 cm, or approximately 6.5 cm. Width C may be between approximately 17 cm and approximately 33 cm, between approximately 21 cm and approximately 29 cm, approximately 23.5 cm, approximately 25 cm, or approximately 26 cm. Length D may be between approximately 21 cm and approximately 33 cm, between approximately 24 cm and approximately 30 cm, or approximately 27 cm. Width F may be between approximately 17 cm and approximately 31 cm, between approximately 21 cm and approximately 27 cm, approximately 23 cm, or approximately 24 cm. Width G may be between approximately 25 cm and approximately 47 cm, between approximately 27 cm and approximately 43 cm, approximately 29.5 cm, approximately 26.5 cm, or approximately 40.0 cm. Distance I may be between approximately 0.50 cm and approximately 6.5 cm, between approximately 1.0 cm an approximately 4.5 cm, or approximately 2.5 cm. Width J may be between approximately 3.5 cm and approximately 8.5 cm, between approximately 5.5 cm and approximately 6.5 cm, or approximately 5.5 cm. Width L may be between approximately 2 cm and approximately 6 cm, between approximately 3 cm and approximately 5 cm, or approximately 4 cm. Length M may be between approximately 67.5 cm and approximately 87.5 cm, between approximately 73 cm and approximately 82 cm, or approximately 77.5 cm.

The exemplary ranges of measurements described above may depend, at least in part, on the stretchiness of the fabric from which garment 10 is made, or from which wing portions 30 are made. For example, a garment 10 made of a more stretchy fabric may have measurements that fall on the smaller end of these size ranges or may even be smaller than these ranges as the stretchiness of the fabric may allow the fabric to stretch to measurements within these ranges. By contrast, a garment 10 made of a fabric with less stretchiness or that is not stretchy may have measurements that fall on the larger end of these size ranges or may even be larger than these ranges as the decreased stretchiness or lack of stretchiness may not permit garment 10 to expand to accommodate an infant contained therein, and thus garment 10 may need to be formed larger.

A shape of garment 10, in the first configuration (FIGS. 1A-1G), with an infant positioned therein will now be described. It will be noted that a shape of garment 10 when worn by an infant may depend on a size and shape of the infant. In the first configuration (FIGS. 1A-1G), the infant's torso (an area between the infant's waist and the bottom of the infant's neck) may be generally disposed within bodice 50, with the infant's neck extending through the opening defined by collar 22 (see the opening of FIG. 1C). The infant's shoulders may be positioned near or abutting shoulder portions 24. The infant's waist may be at or near waist portion 14. The infant's hips may be within a wider portion of lower portion 16 (e.g., at or below hip portion 90). As shown in, e.g., FIG. 1A, lower portion 16 widens below waist portion 14 to provide space to the infant's hips and to assist in preventing disorders like hip dysplasia.

The infant's arms may be received within bodice 50 or wing portions 30, depending on whether garment 10 is in the first configuration, the second configuration, or a third configuration, as described above. A material of garment 10, including wing portion 30, may be stretchable in at least one of the warp or weft direction facilitate accommodation of the infant's arms while retaining them therein and allowing some movement towards the face while inhibiting the infant's startle reflex. When garment 10 is in the first configuration (FIG. 1A), the infant's arms may be retained in an arms-up/hands-raised, elbows-bent position so that the hands may be positioned in an upper portion of a wing portion 30, e.g., at or near apex 44 and/or first junction end 42. This positioning of the infant's hand(s) may allow for non-nutritive sucking by the infant of the fabric enclosing the hand(s). The infant's elbows may be positioned within a lower portion of wing portion 30/panel 36. For example, the infant's elbows may be positioned at or near second junction end 48. The infant's arms may stretch fabric (assuming stretchable fabric is used) of wing portion 30 laterally outward (away from zipper 26). In some aspects, the infant's arms may also stretch the fabric downwards (and/or upwards) when retained within wing portions 30 so that when the infant is in garment 10, a lower region of wing portions 30 containing the elbow is pulled down lower than second junction end 48. In this way, a lower region of each wing portion 30 may cup the infant's bent elbow as the fabric of wing portion 30 is stretched down past second junction end 48. Alternatively, wing portions 30 may not be stretchable, and wing portions 30 may be shaped and sized to accommodate an infant's arms in a desired position without stretch. For example, wing portions 30 may be shaped so as to exert forces on the infant's arm to hold it in a position such as an arms-up, elbows-bent position. As described above, wing portions 30 formed of a less-stretchy or not-stretchy fabric may be larger than those formed of a stretchy material, because the less-stretchy fabric or not-stretchy fabric would not be able to stretch to accommodate the infant therein.

In some examples, wing portion 30 may have a narrower width, while a width of bodice 50 may be relatively wider. In alternatives, wing portion 30 may have a wider width, while a width of bodice 50 may be relatively narrower. At widest points 46 of wing portions 30, a width of one of wing portions 30 (a distance between outer perimeter 32 and inner perimeter 34 at widest point 46) may be at least approximately 2.0% of a width of bodice 50 at widest point 46, or at least approximately 5.0% of a width of bodice 50 at widest point 46. For example, a width of one of wing portions 30 at widest point 46 may be between approximately 5.0% and approximately 50%, between approximately 8.0% and approximately 27%, between approximately 10.0%, and approximately 45%, between approximately 11% and approximately 40%, between approximately 25% and approximately 35%, or approximately 13%, approximately 21%, or approximately 32% of a width of bodice 50 at widest point 46. In other words, a width of upper portion 12 at a widest portion of upper portion 12 may be at least approximately 4% greater in the first configuration than in the second configuration, between approximately 10% and approximately 60% greater, between approximately 20% and approximately 54%, approximately 28%, between approximately 30% and approximately 50%, between approximately 36% and approximately 48% greater, or approximately 42% greater. The percentages provided above are merely exemplary. It will be appreciated that a type of fabric (e.g., a stretchability of a fabric) may affect the percentages above. For example, a garment having very stretchable wing portions 30 may require a smaller percentage increase in width in an expanded configuration, because an infant's arm may stretch the fabric so that the arm is accommodated within. If wing portion 30 is constructed of a more rigid fabric (i.e., a fabric without stretch or with less stretch), then a percentage may be higher, because the infant's arm will need to be accommodated without stretching the fabric. This difference in the width of upper portion 12 between the first and second configurations may allow the swaddle to function as an arms-up swaddle in the first configuration and to function as an arms down swaddle in the second configuration. In the first configuration, the garment may be sized so as to accommodate an arms-up configuration (e.g., an arms-up/hands-raised, elbows-bent configuration or a configuration in which the infant's arms are up and outstretched (i.e., the elbows are not bent). By reducing the width of the swaddle to that of bodice 50 in the second configuration—i.e., effectively removing wing portions 30—an infant wearing the swaddle is unable to comfortably bring their hands and arms up to the mouth to facilitate non-nutritive sucking, whereas the added width of wing portions 30 in the first configuration allows the infant to comfortably assume an arms-up, elbows bent position, and the shape of the wings retain the arms in that position.

The ratios/percentages above may depend upon a type of fabric used for wing portions 30 and/or other portions of garment 10, which may be made of the same or different fabric. For example, if garment 10 or wing portions 30 are made of a fabric with a greater stretchability, the ratio/percentage may be on a lower side of the ranges above, because the infant's arms may be able to stretch the fabric more in order to achieve the arms-up, elbows-bent position described above. If garment 10 includes a less stretchable fabric, the ratio/percentage may be greater (e.g., on a higher side of the ranges above) in order to accommodate the infant's arms in the "arms up" position. Although the above discussion of differences in widths between the arms up and arms down configurations is included in reference to garment 10, this discussion applies equally to each embodiment described herein, including those of FIGS. 4A-4G, 5A-5G, 6A-6B, 7A-7F, 8A-8F, 9A-9B, 10A-10D, and 11A-11F.

To position the infant within garment 10 in the first configuration, a caregiver may unzip each zipper 60 (or open another suitable fastening mechanism) to expand wing portions 30 and allow them to extend laterally from opposite sides of bodice 50, if zippers 60 are not already unzipped. A caregiver may then unzip zipper 26 (or open another fastening closing mechanism) so that garment 10 is open. While the figures depict zipper 26 on the front side 18 of garment 10, zipper 26 may be off-centered on front side 18, may be along a side portion of garment 10, or may be on back side 20. The caregiver may place the infant into garment 10 through an opening created by zipper 26 or other fastening mechanism. The caregiver may place the infant's feet near lower hem 28. The caregiver may position the infant's head so that collar 22 surrounds the infant's neck. The caregiver may position the infant's arms such that the infant's hands are near apex 44 and/or first junction end 42 of wing portions 30. The caregiver may then zip zipper 26 (e.g., by moving the pull of zipper 26 upward towards collar 22) and may tuck the pull of zipper 26 into zipper shield 27.

A shape of garment 10, in the second configuration (FIGS. 2A-2G), with an infant positioned therein will now be described. As with first configuration, the infant's torso may be positioned within bodice 50, with the infant's neck extending through the opening defined by collar 22 (FIG. 2C). The infant's shoulders may be positioned near or abutting shoulder portion 24. The infant's waist may be positioned at or near waist portion 14. The infant's hips may be within a wider portion of lower portion 16 (e.g., at or below hip portion 90).

In contrast to the first configuration, the arms of the infant may be positioned across the infant's chest toward the opposite elbows, across the chest with hand(s) pointed toward the opposite shoulder, down at the infant's sides, or with the hands facing directly upward toward the chin. Inner perimeter 34 may contact the infant's arms and/or torso. Bodice 50, defined in part by inner perimeter 34, may hug the infant's upper body, keeping the infant's arms tucked within bodice 50 and limiting or inhibiting non-nutritive sucking. In other words, in the second configuration, the infant may be in an "arms-down" or "arms-in" position. The infant may be able to move the arms between the positions described in this paragraph, e.g., from across the chest towards opposite elbows to across the chest towards opposite shoulders, but may not be able to adopt an "elbows-bent, arms-up" position. In the second configuration, the arms may not pass into wing portions 30, as zippers 60 are closed to retain the wing portions within bodice 50.

To position the infant within garment 10 in the second configuration, a caregiver may zip each zipper 60 (or close another suitable fastening mechanism) to collapse wing portions 30 within opposite sides of bodice 50, if zippers 60 are not already zipped. If inner pockets are included in garment 10 to store wing portions 30 within bodice 50, then a caregiver may position wing portions 30 within the pockets prior to zipping zippers 60. A caregiver may then unzip zipper 26 so that garment 10 is open. While the figures depict zipper 26 on the front side 18 of garment 10, zipper 26 may be off-centered on front side 18, may be along a side portion of garment 10, or may be on back side 20, as described above. The caregiver may place the infant into garment 10 through an opening created by zipper 26 or other fastening mechanism. The caregiver may place the infant's feet near lower hem 28. The caregiver may position the infant's head so that collar 22 surrounds the infant's neck. The caregiver may position the infant's arms down by the infant's sides or across his/her torso in one of the positions described above. The caregiver may then zip zipper 26 (e.g., by moving the pull of zipper 26 upward) and tuck the pull of zipper 26 into zipper shield 27.

Figure 4B:
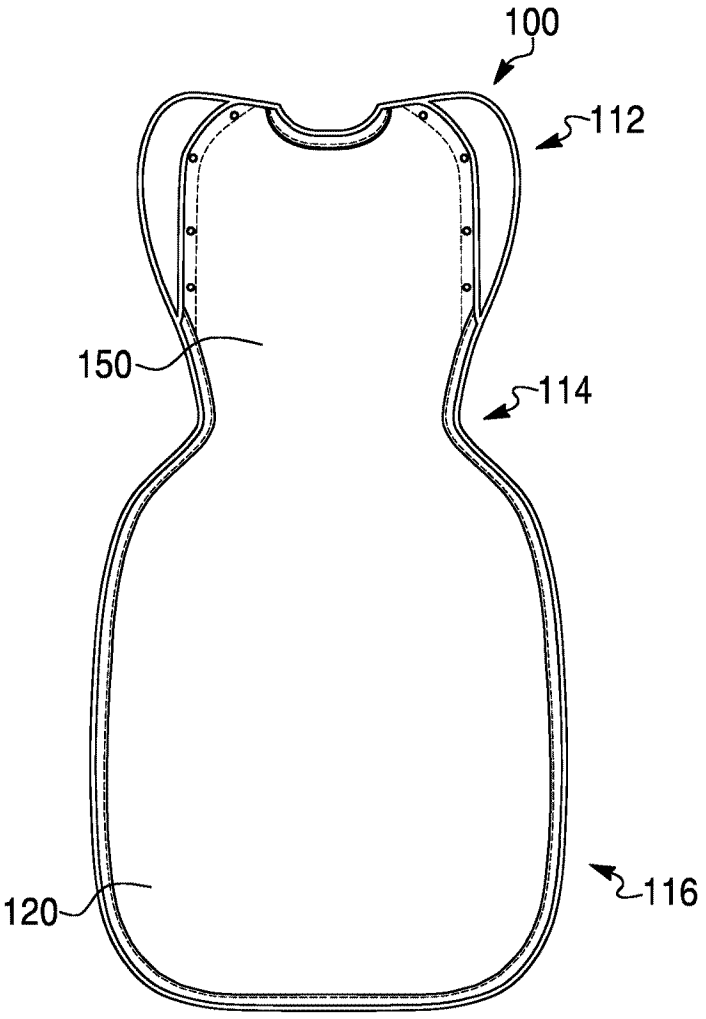
FIGS. 4A-4G depict various views of another exemplary infant garment in a first configuration.
Figure 4A:
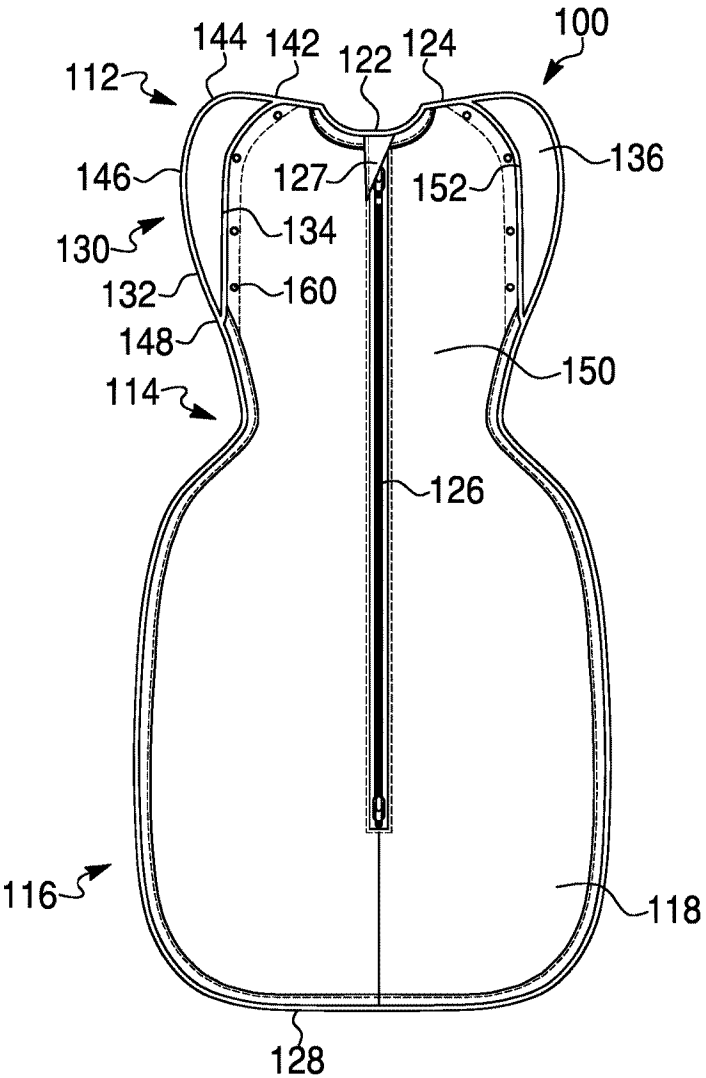
Figure 4D:
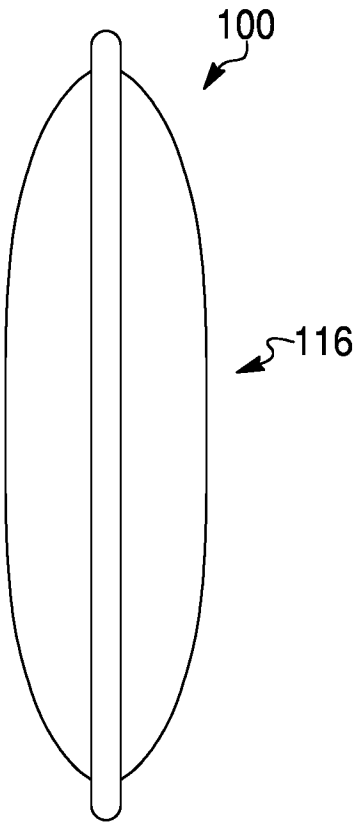
Figure 4C:
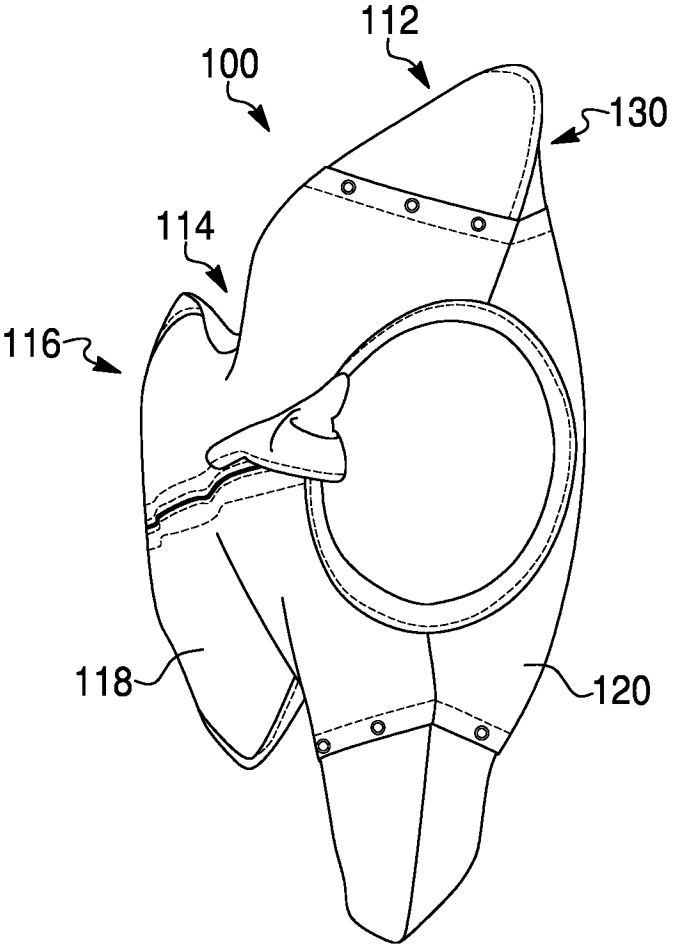
Figure 4E:
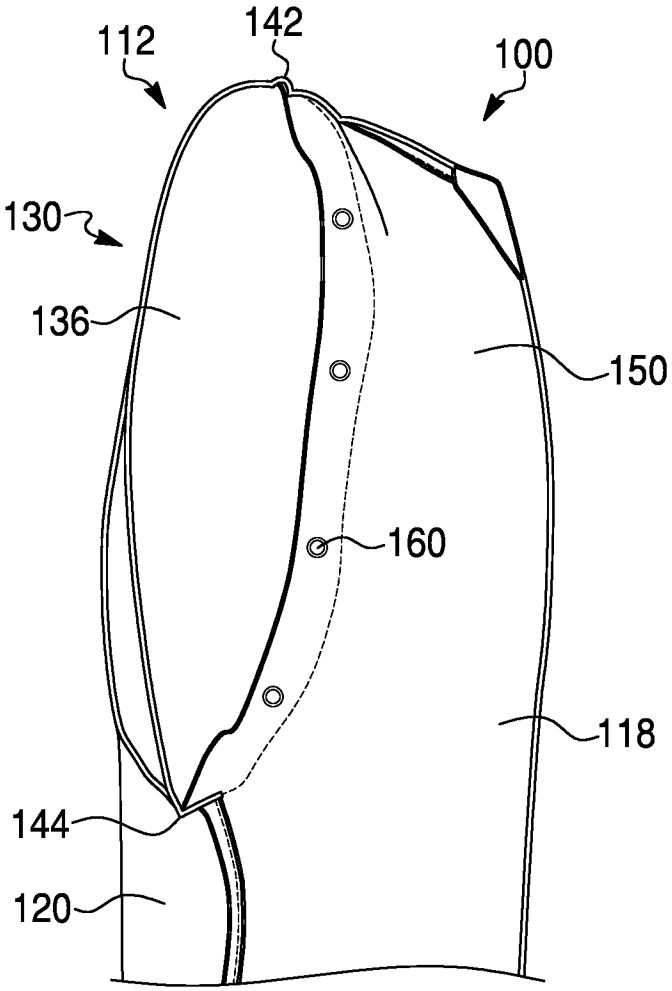
Figure 4F:
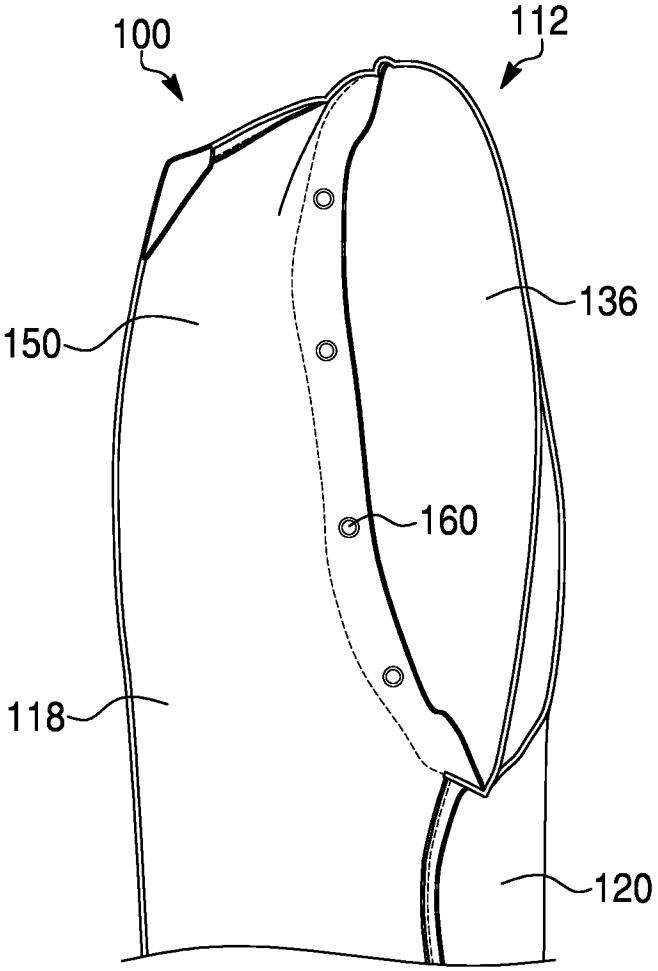
Figure 4G:
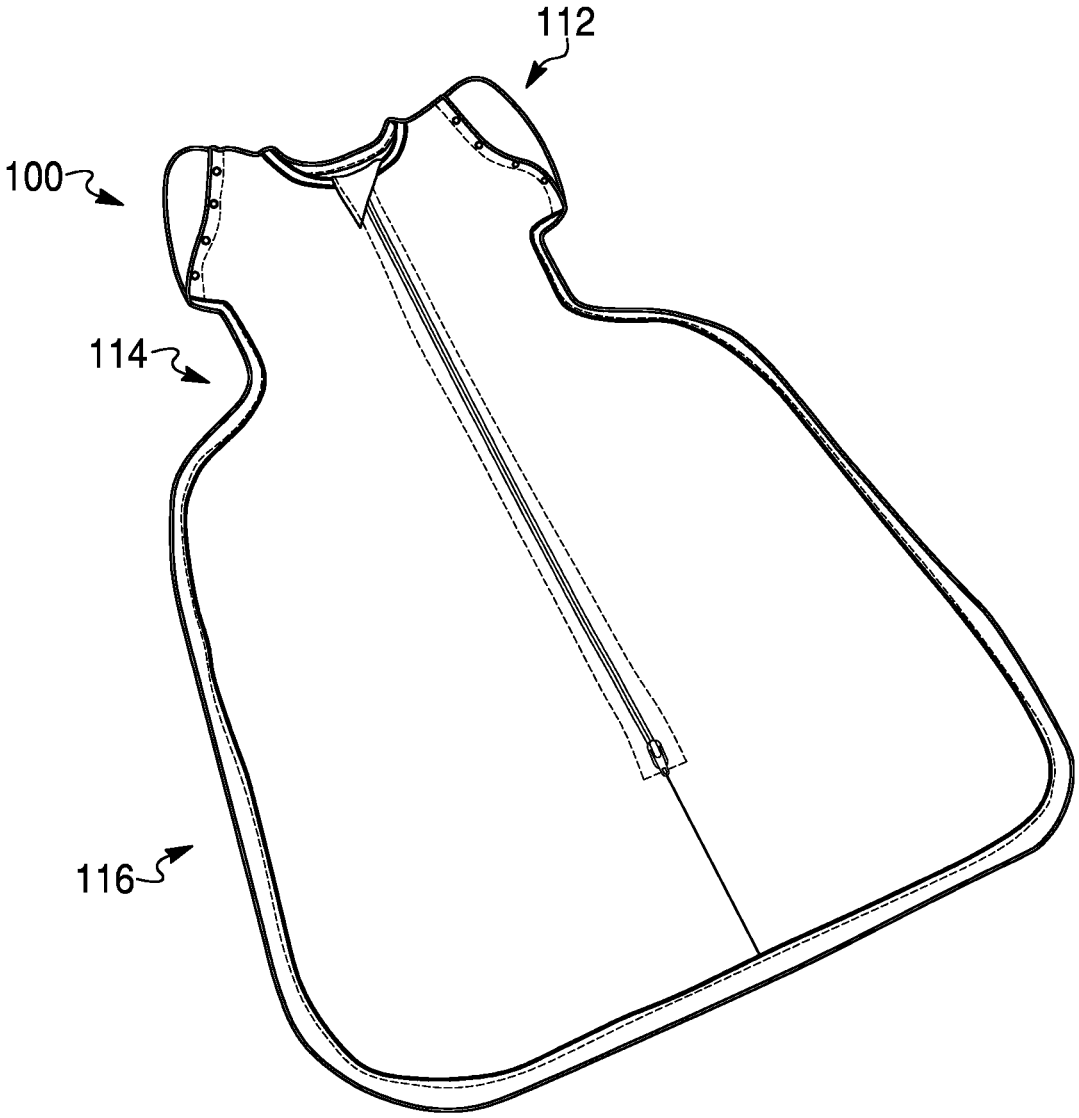
Figure 5B:
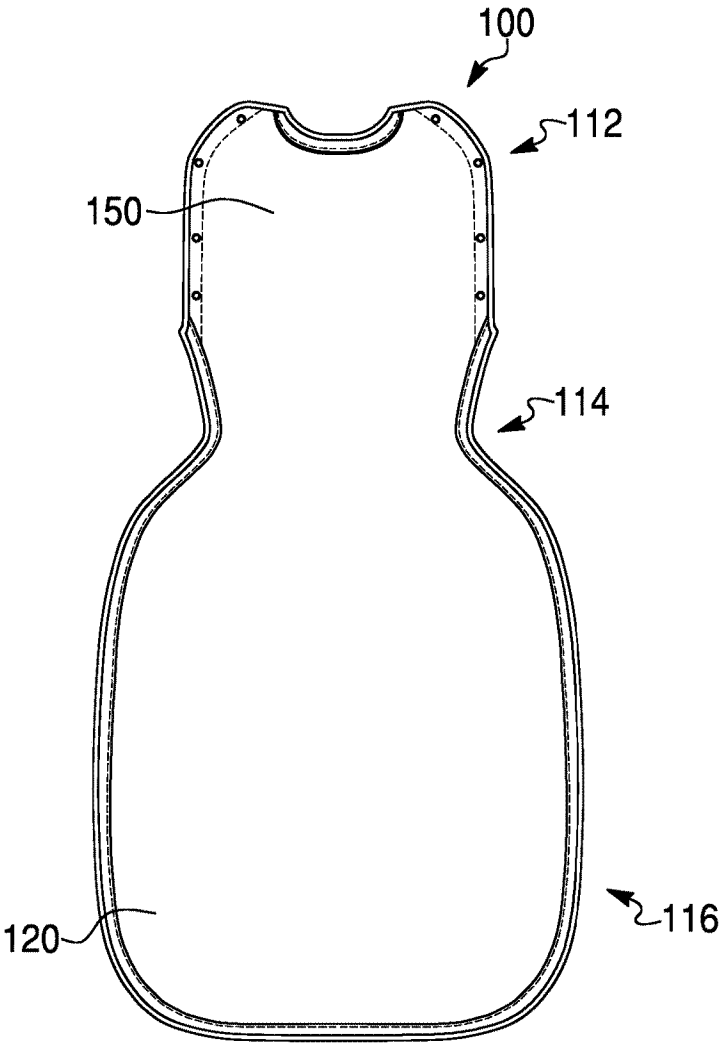
FIGS. 5A-5G depict various views of the exemplary infant garment of FIGS. 4A-4G in a second configuration.
Figure 5A:
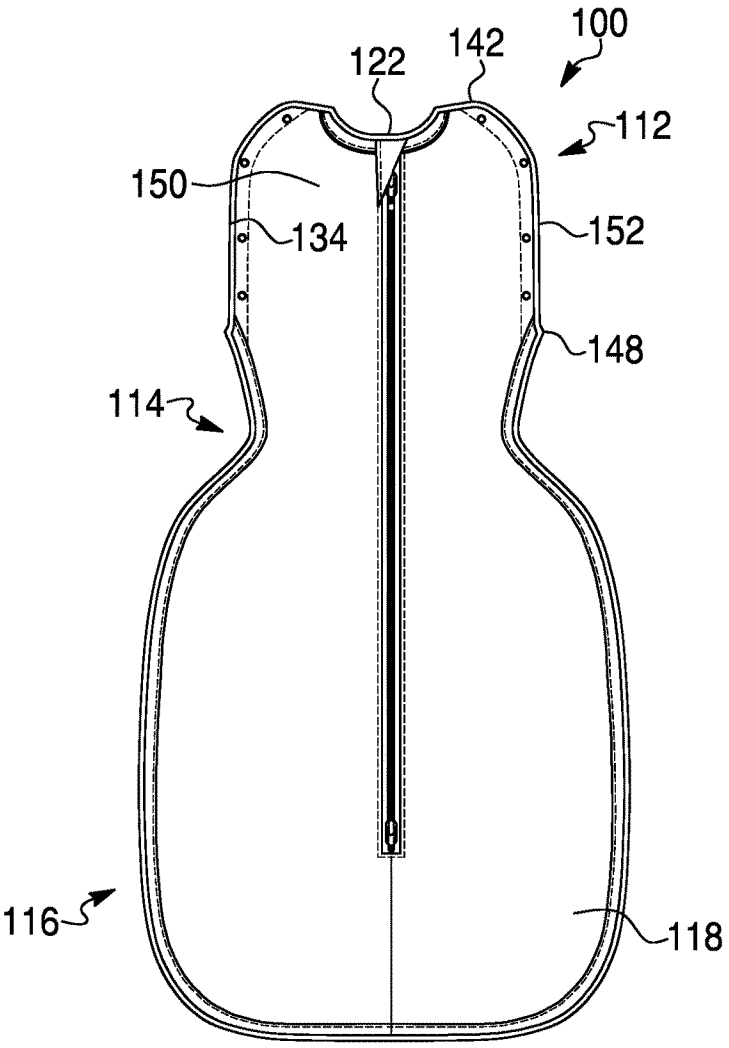
Figure 5D:
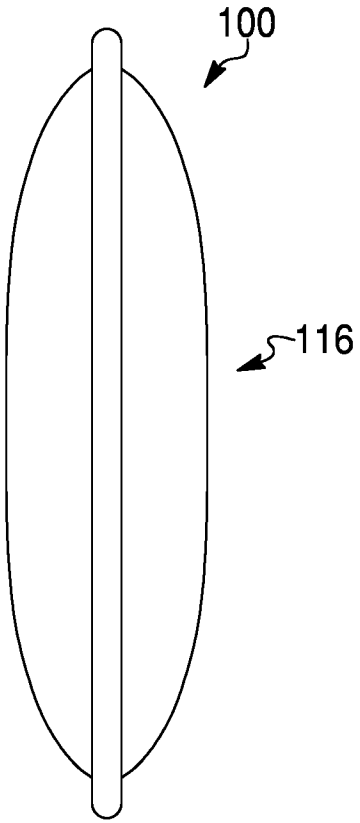
Figure 5C:
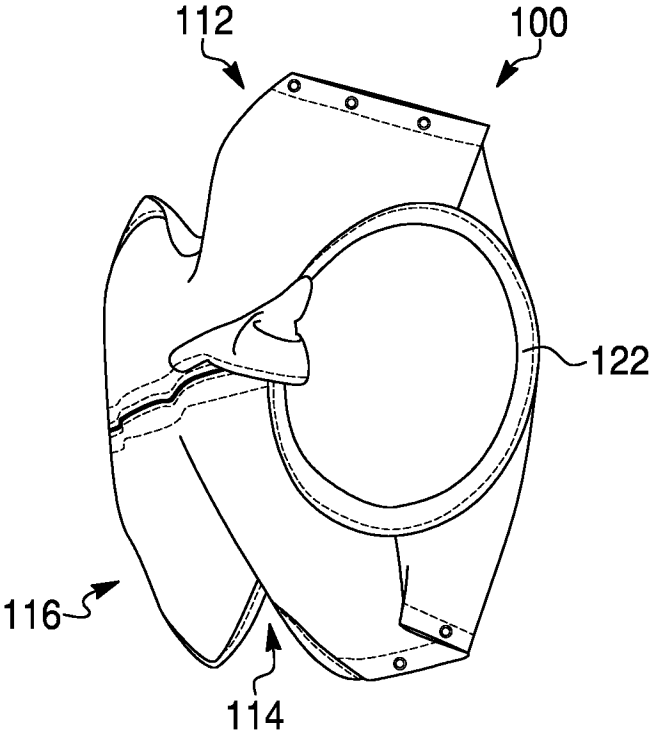
Figure 5F:
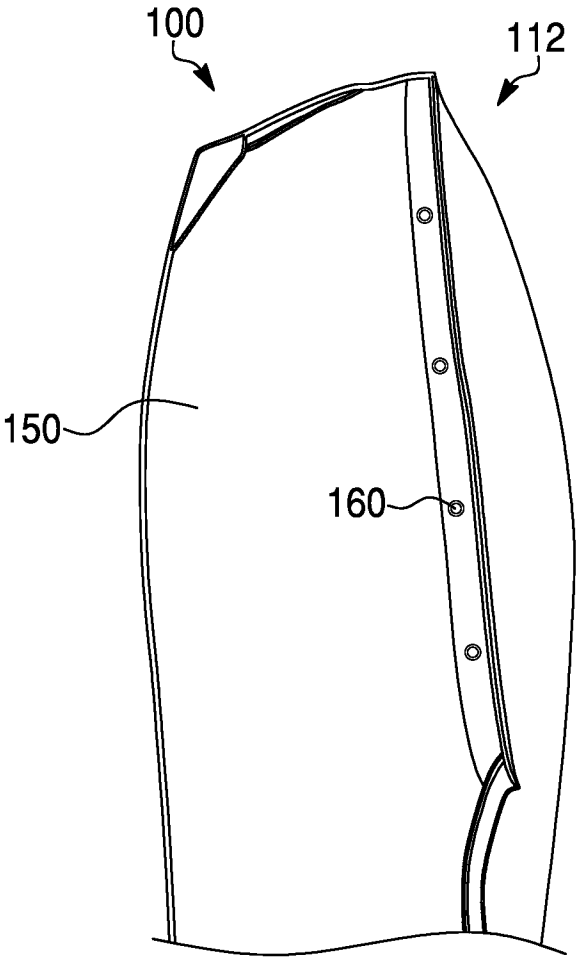
Figure 5E:
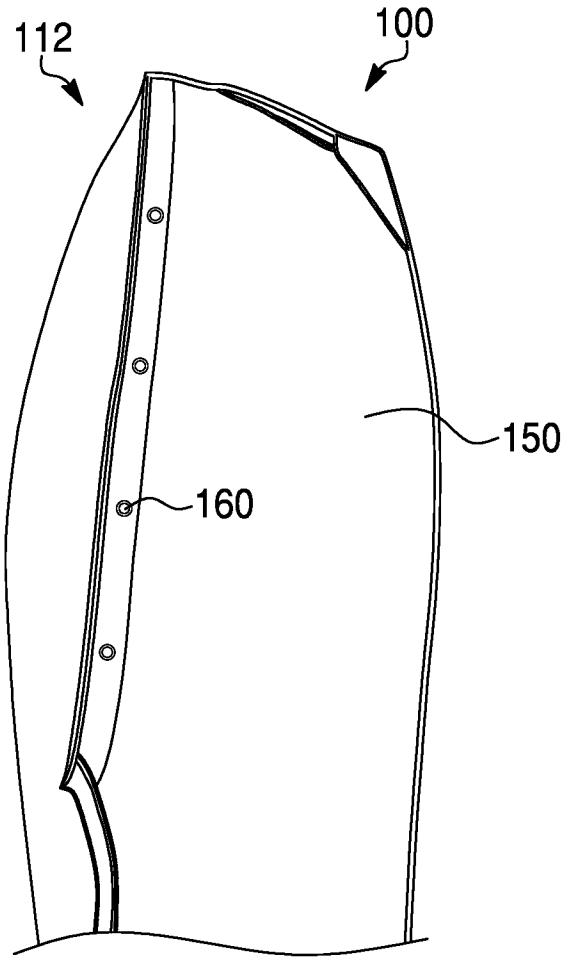
Figure 5G:
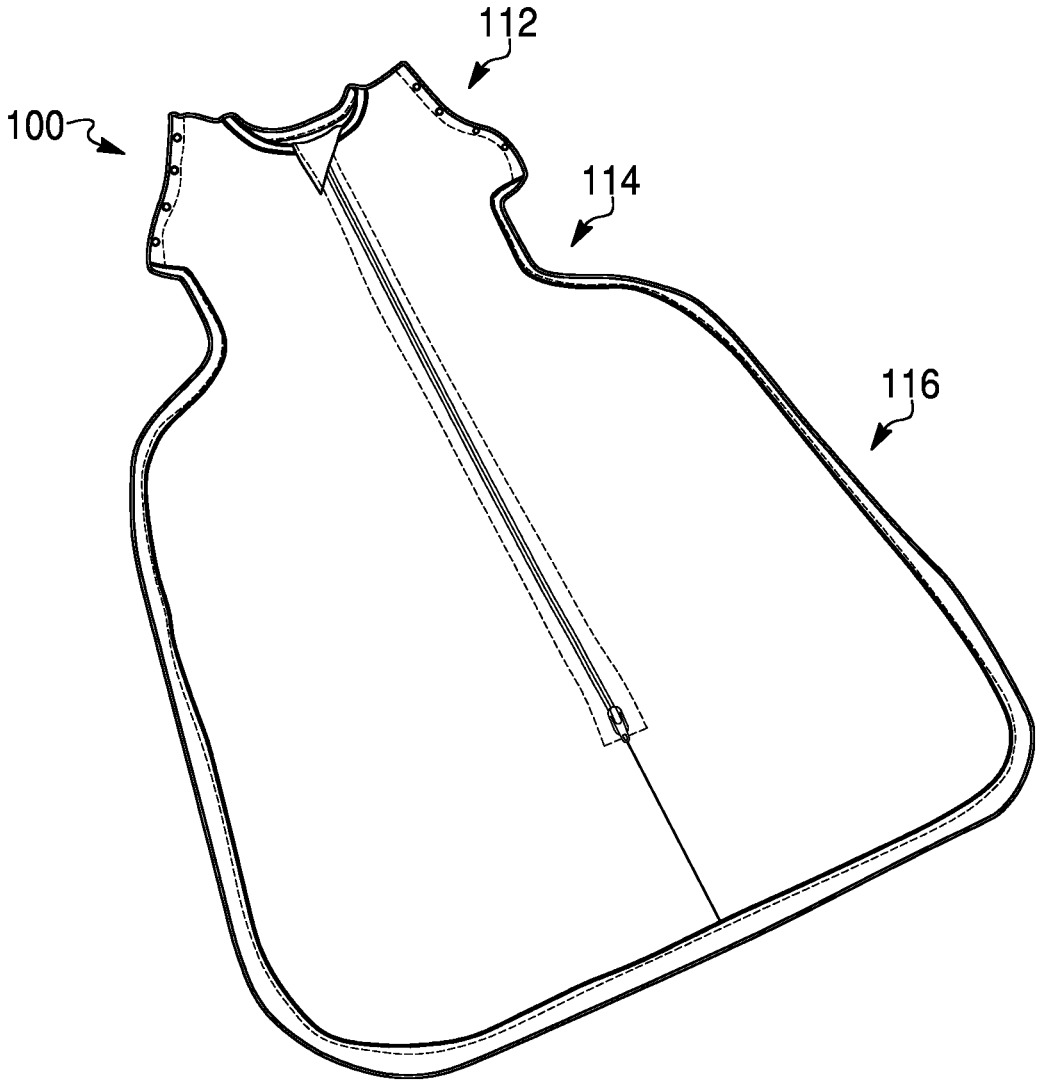
Figure 6B:
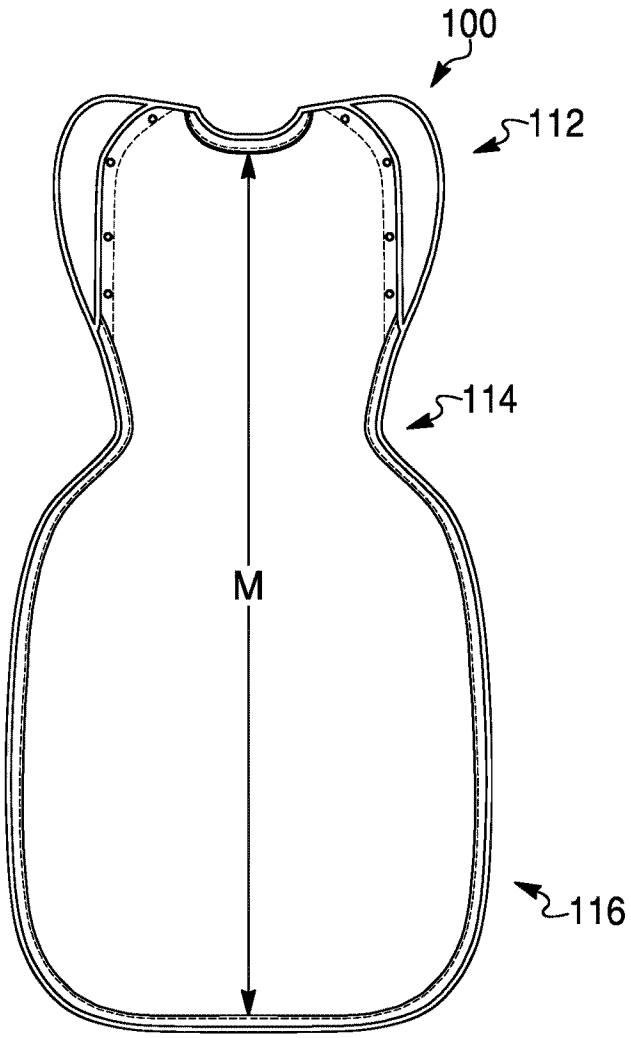
FIGS. 6A-6B depict measurements of the exemplary infant garment of FIGS. 4A-5G.

FIGS. 4A-6B depict another exemplary garment 100. FIGS. 4A-4G show garment 100 in a first configuration (configured for retaining the infant in an arms-up, elbows bent position), FIGS. 5A-5G show garment 100 in a second configuration (configured for retaining the infant's arms in an arms-down position with the arms of the infant retained by the infant's sides or across the infant's torso), and FIGS. 6A-6B show select, exemplary measurements associated with garment 100. Except as specified below, garment 100 may have any of the features of garment 10, and like reference numbers are used to denote like elements, where possible.

An upper portion 112 of garment 100 may include a bodice 150 and two wing portions 130, extending laterally from opposite sides of bodice 150. In the first configuration (FIGS. 4A-4G), wing portions 130 may extend laterally outward (away from collar 122) from opposite sides of bodice 150. In the second configuration (FIGS. 5A-5G), wing portions 130 may be collapsed, e.g., folded or scrunched and tucked, into bodice 150 (or folded backward or forward rather than within bodice 150). For example, wing portions 130 may be folded in or scrunched and inserted into a concealed pocket (not shown) within bodice 150. Alternatively, no inner pocket may be included, and wing portion 30 may simply be collapsed into bodice 50. As discussed in further detail below, wing portions 130 may be retained in the second configuration by a closure, such as a plurality of fasteners (e.g., snaps or buttons) 160, as shown in FIGS. 5A, 5B. Wing portions 130 may include a fabric gusset/panel 136 that extends between an outer perimeter 132 (which may be an outer perimeter of wing portions 130 when extended and, in the first configuration, an outer perimeter of garment 100), and an inner perimeter 134 (which may be an outer perimeter of a portion of bodice 150 and, in the second configuration, an outer perimeter of garment 100 when the wing portions 130 are contracted). Inner perimeter 134 may form a junction between wing portion 130 and bodice 150. Panel 136 may be attached to bodice 150 along inner perimeter 134, between a first junction end 142 (i.e., an upper end) and a second junction end 148 (i.e., a lower end). Accordingly, each wing portion 130 may be defined between first junction end 142 and second junction end 148, and fasteners 160, discussed below, may extend from first junction end 142 to second junction end 148. In this manner, garment 100 may be transitioned between the first and second configurations by fastening or unfastening fasteners 160 to expand or contract wing portions 130.

Each wing portion 130 may be similar or symmetrical on a front side 118 and a back side 120 of garment 100. For example, distances between outer perimeter 132 and inner perimeter 134 may be the same on front side 118 and back side 120. In alternatives, each wing portion 130 may be different on front side 118 and back side 120. For example, a distance between outer perimeter 132 and inner perimeter 134 may differ between front side 118 and back side 120, such that each wing portion 130 may be larger on one of front side 118 than on back side 120. In the first configuration, outer perimeter 132 may be continuous with an outer perimeter of waist portion 114 and lower portion 116, such that wing portion 130 does not define an opening (e.g., for a hand or arm to pass through). In other words, panel 136 may be configured to expand from a portion of garment 10 in the first configuration while still retaining arms of an infant within garment 100 when a plurality of fasteners 160 (described below) are unfastened. Garment 100 may be configured to enclose and retain the arms of an infant within wing portions 130 of garment 100 in the first configuration when zipper 126 is zipped up, and fasteners 160 are unfastened to allow panels 136 to extend laterally from bodice 150

The plurality of fasteners 160 (e.g., snaps or buttons) may be positioned along inner perimeter 134, between first junction end 142 and second junction end 148, forming a boundary between front side 118 and side portion 120. As discussed below, fasteners 160 of a respective wing portion 130 may be opened to release each panel 136 and allow each wing portion 130 to expand in the first configuration of garment 100 (FIGS. 4A-4G), and fasteners 160 may be closed to tuck panels 136 within bodice 50 to transition garment 100 into the second configuration (FIGS. 5A-5G). Although FIGS. 4E, 4F, 5E, and 5F depict four fasteners 60, it will be appreciated that that number is merely exemplary, and any suitable number of fasteners may be utilized A shape of outer perimeter 132 of each wing portion 130 in the first, expanded configuration of FIGS. 4A-4G will now be described. The shape of outer perimeter 132 may be similar to or the same as the shape of outer perimeter 32 of garment 10. First junction end 142 of each wing portion 130 may be at or near shoulder 124. Outer perimeter 132 may extend outward (away from shoulder 124 and collar 122 and upward. For example, outer perimeter 132 may extend approximately linearly to an apex 144 (a highest/upper-most portion of FIGS. 1A-1B). Or, apex 144 may be approximately even with shoulder 124, or apex 144 may be below shoulder 124. Outer perimeter 132 may then curve outward further away from shoulder 124/collar 122 and downward to a widest point 146. Between widest point 146 and second junction end 148, outer perimeter 132 may taper inward towards bodice 150. In some aspects, outer perimeter 132 may extend more downward than laterally inward between widest point 146 and second junction end 148.

A shape of inner perimeter 134 (which forms a portion of an outer perimeter of garment 100 in the second configuration of FIGS. 5A-5G) is described below. Inner perimeter 134 may extend laterally outward and downward from first junction end 142 to a widest section 152. Between first junction end 142 and widest section 152, inner perimeter 134 may extend laterally outward at a decreasing rate. For example, a width of inner perimeter 134 may increase more near shoulder 124 than near widest section 152. Widest section 152 may have an approximately constant width, such that inner perimeter 134 may extend approximately downward at widest section 152. For example, inner perimeter 134 may extend approximately downward to second junction end 148.

Although the above description discusses the first configuration (FIGS. 4A-4G) and the second configuration (FIGS. 5A-2G), garment 100 also may have a third configuration, in which one wing portion 130 may be expanded, and one wing portion 130 may be contracted. For example, a left wing portion 130 may be expanded (as shown in FIGS. 4A-4G), and a right wing portion 130 may be contracted/tucked into bodice 150 (as shown in FIGS. 5A-5G) or folded backward/forward and secured within/onto/relative to bodice 150 by fasteners 160. In another example, the right wing portion 130 may be expanded (as shown in FIGS. 4A-4G), and the left wing portion 130 may be contracted/tucked into bodice 150 and secured within bodice 150 by fasteners 160. In further alternative configuration(s), wing portion(s) 130 may be partially expanded/contracted by opening/closing some of fasteners 160 of each respective wing portion 130.

Figure 6A:
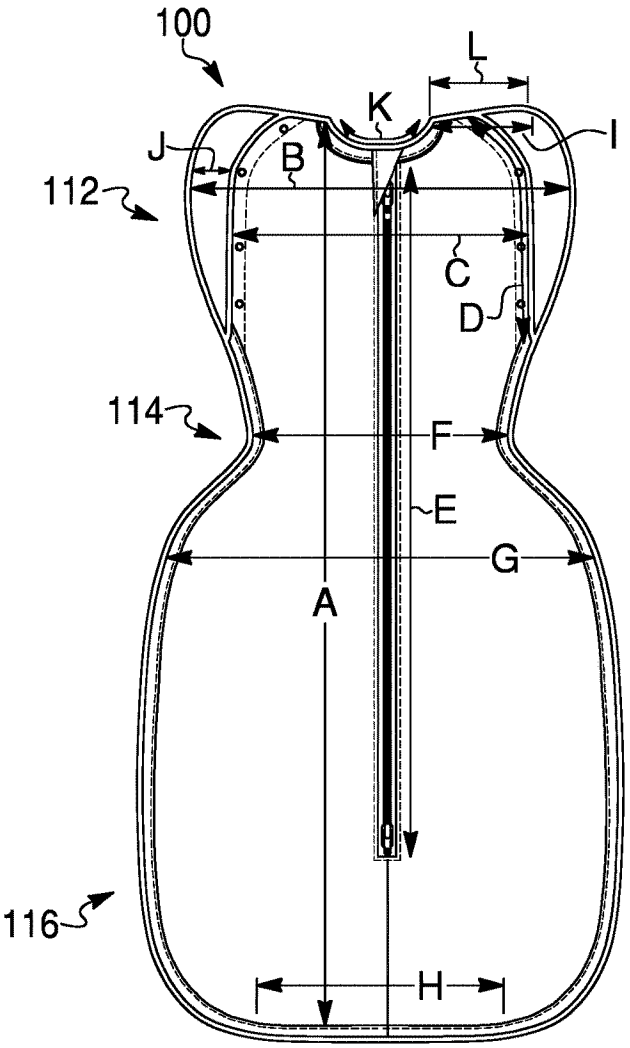

FIG. 6A may be identical to FIG. 4A but with measurement values denoted. FIG. 6B may be identical to FIG. 4B but with measurement values denoted. Measurements may differ for different sizes of garment 100, e.g., x-small, small, medium, large, and x-large sizes. The measurements below may apply to a garment designed to fit an infant between approximately 6.0 kg and approximately 8.5 kg, for example. The values of measurements may be similar or identical to the values of measurements A-M of FIGS. 3A-3B and are therefore not provided below. Where relevant, structures of garment 100 corresponding to measurements A-M that differ from structures of garment 10 are denoted below. If not noted below, the measurements refer to the same structures as garment 10 and are identical. As with garment 10, in some examples, relative proportions of the below measurements of garment 100 may be maintained for different sizes of garment 100. Alternatively, different sizes of garment 100 may have different measurements. Measurement B in FIG. 6A refers to a width from widest point 146 of one wing portion 130 (e.g., the left wing portion 130) to widest point 146 of the other wing portion 130 (e.g., the right wing portion 130). A portion of width B extending across bodice 150 (not including wing portions 130 on either side of bodice 150) may be between approximately 16 cm and approximately 26 cm, between approximately 18 cm and approximately 24 cm, or approximately 21 cm. A portion of width B extending across each wing portion 130 may be between approximately 2.0 cm and approximately 7 cm, between approximately 3.5 cm and approximately 5.5 cm, or approximately 4.5 cm. Widest point 146 of each wing portion 130 may be located between approximately 3 cm and approximately 10 cm, between approximately 4 cm and approximately 8 cm, or between approximately 6 cm below apex 144 of wing portion 30 (in a downward direction of FIG. 6A). Measurement C may refer to a width from widest section 152 of one side of bodice 150 (e.g., a left side) to widest section 152 of the other side of bodice 150 (e.g., a right side). Measurement C may correspond to a width of a widest portion of upper portion 112 in the second configuration. Measurement D may correspond to a length of a junction between wing portion 130 and bodice 150, from first junction end 142 to second junction end 148, along fasteners 160.

A shape of garment 100, in the first configuration (FIGS. 4A-4G), with an infant positioned therein will now be described. It will be noted that a shape of garment 100 when worn by an infant may depend on a size and shape of the infant. In the first configuration (FIGS. 4A-4G), the infant's torso (an area between the infant's waist and the bottom of the infant's neck) may be generally disposed within bodice 150, with the infant's neck extending through the opening defined by collar 122 (see the opening of FIG. 4C). The infant's shoulders may be positioned near or abutting shoulders 124. The infant's waist may be at or near waist portion 14. The infant's hips may be within a wider portion of lower portion 16. As shown in, e.g., FIG. 4A, lower portion 16 widens below waist portion 14 to provide space to the infant's hips and to assist in preventing disorders like hip dysplasia.

The infant's arms may be received within bodice 150 and/or wing portions 130, depending on whether garment 100 is in the first configuration, the second configuration, or a third configuration, as described above. A material of garment 100, including wing portion 130, may be stretchable in at least one of the warp or weft direction to facilitate accommodation of the infant's arms while retaining them therein and allowing some movement towards the face while inhibiting the infant's startle reflex. When garment 100 is in the first configuration (FIG. 4A), the infant's hands may be positioned in an upper portion of a wing portion 130, e.g., at or near apex 144 and/or first junction end 142. This positioning of the infant's hand(s) may allow for non-nutritive sucking by the infant of the fabric enclosing the hand(s). The infant's elbows may be positioned within a lower portion of wing portion 130/panel 136. For example, the infant's elbows may be positioned at or near second junction end 148. The infant's arms may stretch fabric (assuming stretchable fabric is used) of wing portion 130 laterally outward (away from zipper 126). In some aspects, the infant's arms may also stretch the fabric downwards when retained within wing portions 130 so that when the infant is in garment 100, a lower region of wing portions 130 containing the elbow is pulled down lower than second junction end 148. In this way, a lower region of each wing portion 130 may cup the infant's bent elbow as the fabric of wing portion 130 is stretched down past second junction end 148.

At widest points 146 of wing portions 130, a width of each wing portion 130 (a distance between outer perimeter 132 and inner perimeter 134 at widest point 146) may be at least approximately 2.0% of a width of bodice 50 at widest point 46, or at least approximately 5.0% of a width of bodice 50 at widest point 46. For example, a width of one of wing portions 30 at widest point 46 may be between approximately 5.0% and approximately 50%, between approximately 8.0% and approximately 27%, between approximately 10.0%, and approximately 45%, between approximately 11% and approximately 40%, between approximately 25% and approximately 35%, or approximately 13%, approximately 21%, or approximately 32% of a width of bodice 150 at widest point 146. The ratios/percentages above may depend upon a type of fabric used for wing portions 130 and/or other portions of garment 100, which may be made of the same or different fabric. For example, if garment 100/wing portions 130 are made of a fabric with a greater stretchability, the ratio/percentage may be on a lower side of the ranges above, because the infant's arms may be able to stretch the fabric more in order to achieve the arms-up, elbows-bent position described above. If garment 100 includes a less stretchable fabric, the ratio/percentage may be greater (e.g., on a higher side of the ranges above) in order to accommodate the infant's arms in the "arms up" position.

To position the infant within garment 100 in the first configuration, a caregiver may unfasten some or all of fasteners 160 (or open another suitable fastening mechanism) to expand wing portions 130 and allow them to extend laterally from opposite sides of bodice 150, if fasteners 160 are not already unfastened. A caregiver may then unzip zipper 126 (or open another fastening closing mechanism) so that garment 100 is open. While the figures depict zipper 126 on the front side 118 of garment 100, zipper 126 may be off-centered on front side 118, may be along a side portion of garment 100, or may be on back side 120, as described above. The caregiver may place the infant into garment 100 through an opening created by zipper 126 or other fastening mechanism. The caregiver may place the infant's feet near lower hem 128. The caregiver may position the infant's head so that collar 122 surrounds the infant's neck (FIG. 5C). The caregiver may position the infant's arms such that the infant's hands are near apex 144 and/or first junction end s142 of wing portions 130. The caregiver may then zip zipper 126 (e.g., by moving the pull of zipper 126 upward towards collar 122) and tuck the pull of zipper 126 into zipper shield 127.

A shape of garment 100, in the second configuration (FIGS. 5A-5G), with an infant positioned therein will now be described. As with first configuration, the infant's torso may be positioned within bodice 150, with the infant's neck extending through the opening defined by collar 122. The infant's shoulders may be positioned near or abutting shoulders 124. The infant's waist may be positioned at or near waist portion 114. The infant's hips may be within a wider portion of lower portion 16.

In contrast to the first configuration, the arms of the infant may be positioned across the infant's chest toward the opposite elbows, across the chest with hand(s) pointed toward the opposite shoulder, down at the infant's sides, or with the hands facing directly upward toward the chin but unable to access/reach the mouth. Inner perimeter 134 may contact the infant's arms and/or torso. Bodice 150, defined in part by inner perimeter 134, may hug the infant's upper body, keeping the infant's arms tucked within bodice 150 and limiting or inhibiting non-nutritive sucking. In other words, in the second configuration, the infant may be in an "arms-down" or "arms-in" position. The infant may be able to move the arms between the positions described in this paragraph, e.g., from across the chest towards opposite elbows to across the chest towards opposite shoulders but may not be able to adopt an "elbows-bent, arms-up" position. In the second configuration, the arms may not pass into wing portions 130, as fasteners 160 are fastened to retain the wing portions within bodice 150.

To position the infant within garment 100 in the second configuration, a caregiver may fasten (e.g., snap or button) fasteners 160 (or close another suitable fastening mechanism) to collapse wing portions 130 within opposite sides of bodice 150, if fasteners 160 are not already fastened. If inner pockets are included in garment 100 to store wing portions 130 within bodice 150, then a caregiver may position wing portions 130 within the pockets prior to fastening fasteners 160. A caregiver may then unzip zipper 126 so that garment 100 is open. While the figures depict zipper 126 on the front side 118 of garment 100, zipper 126 may be off-centered on front side 118, may be along a side portion of garment 100, or may be on back side 120. The caregiver may place the infant into garment 100 through an opening created by zipper 126 or other fastening mechanism. The caregiver may place the infant's feet near lower hem 128. The caregiver may position the infant's head so that collar 122 surrounds the infant's neck. The caregiver may position the infant's arms down by the infant's sides or across his/her torso in one of the positions described above. The caregiver may then zip zipper 126 (e.g., by moving the pull of zipper 126 upward) and tuck the pull of zipper 126 into zipper shield 127.

Figure 7B:
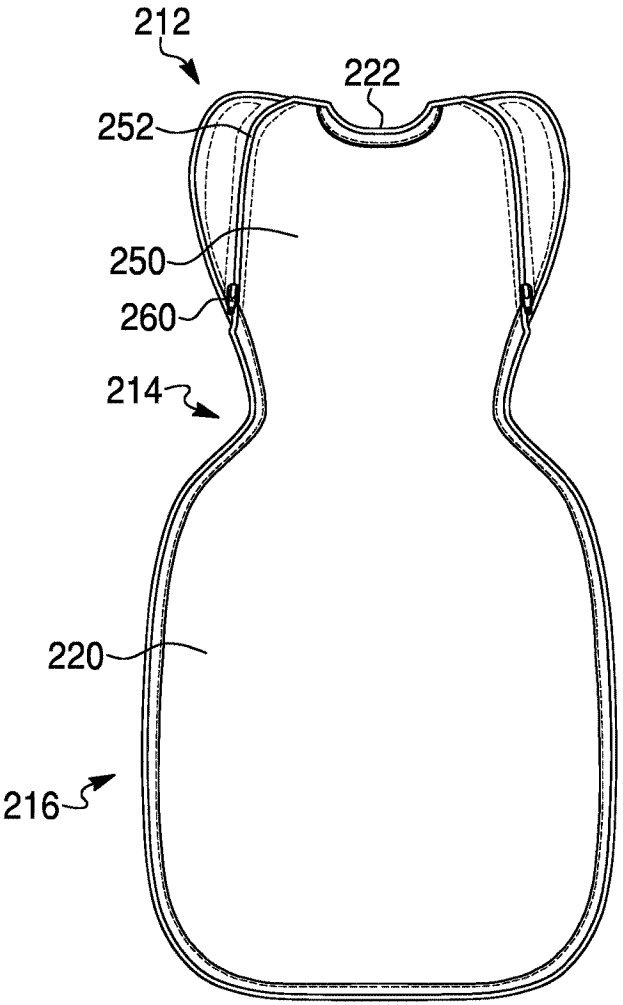
FIGS. 7A-7G depict various views of another exemplary infant garment in a first configuration.
Figure 7A:
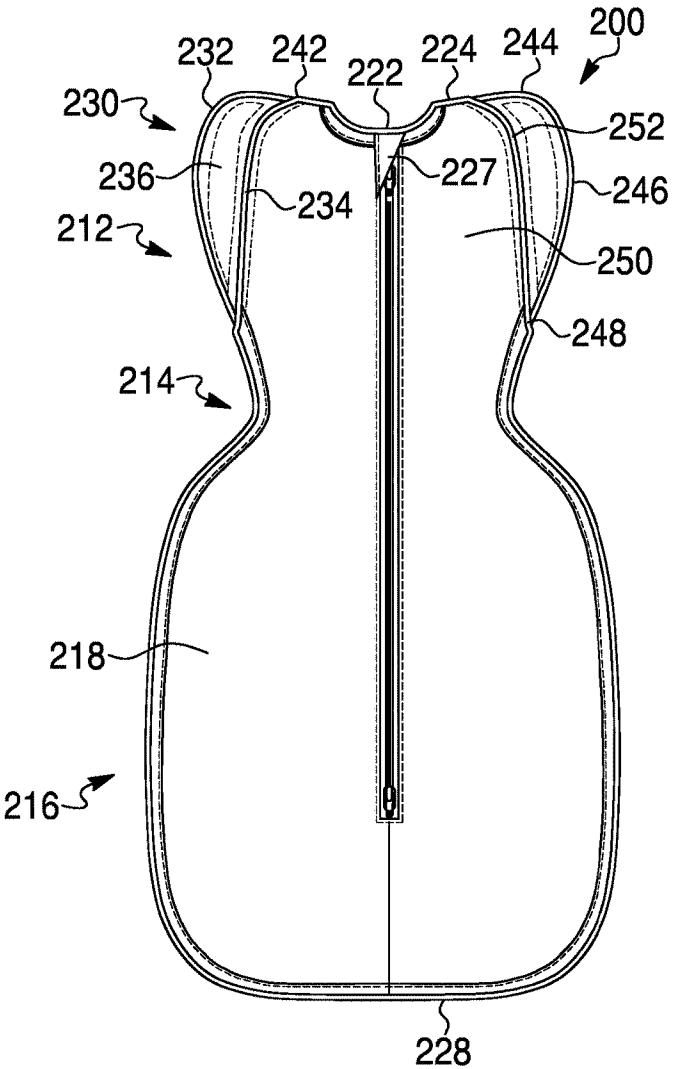
Figure 7D:
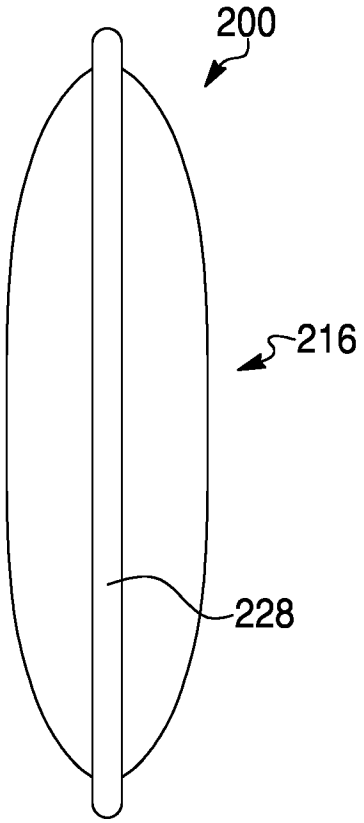
Figure 7C:
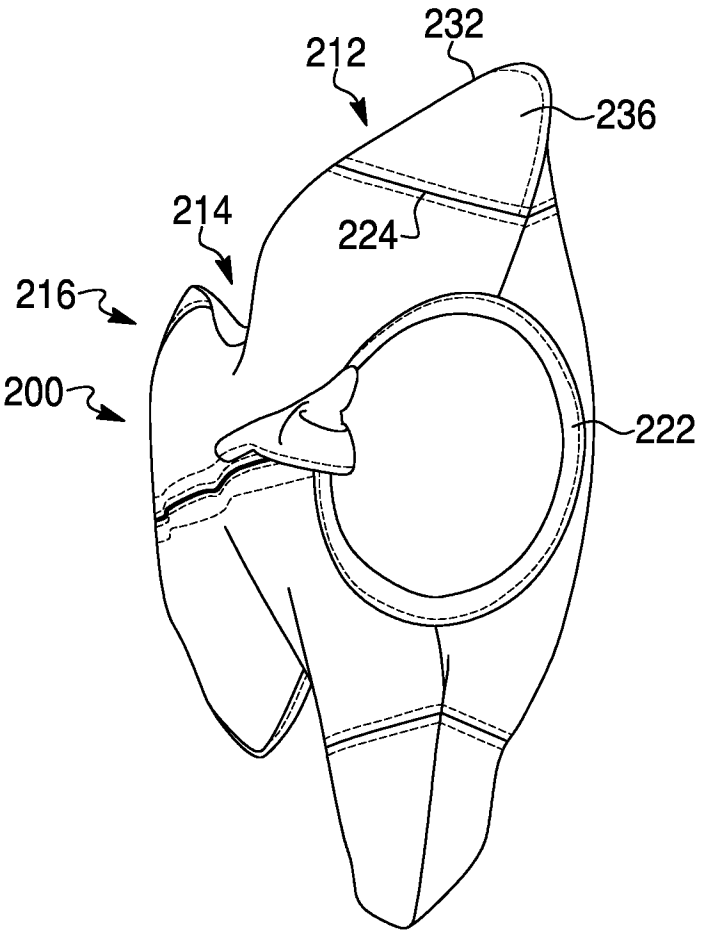
Figure 7F:
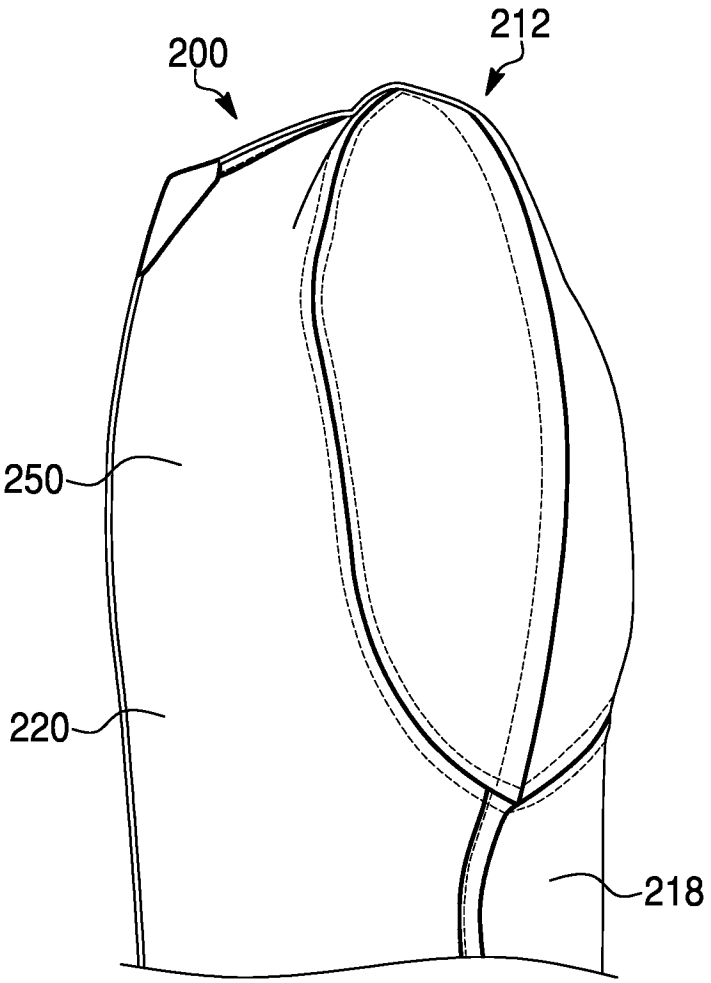
Figure 7E:
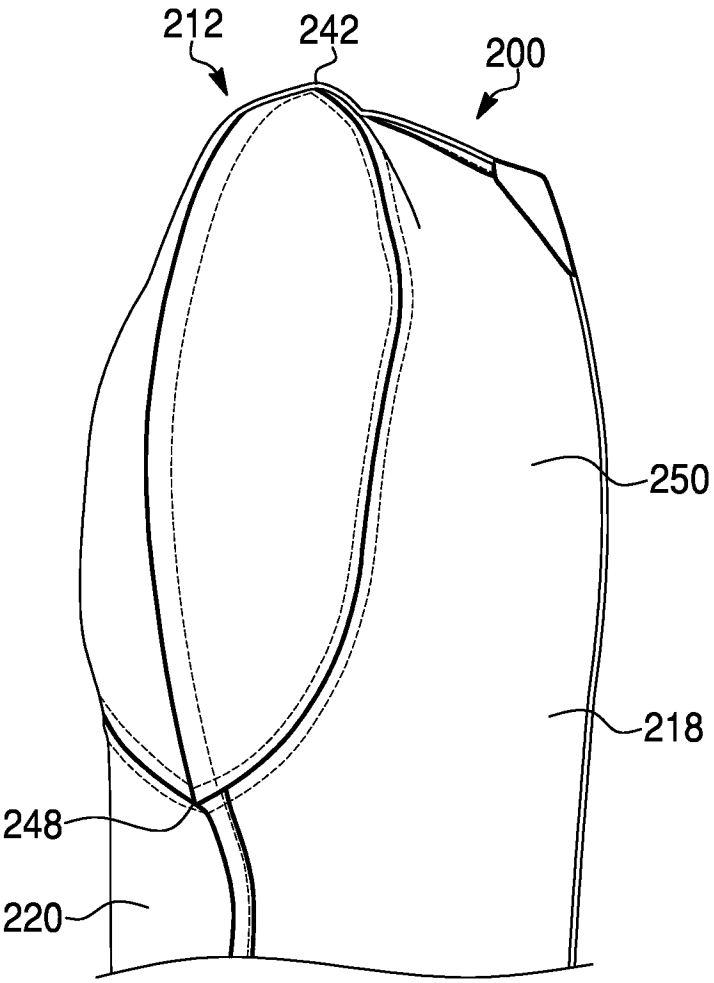
Figure 7G:
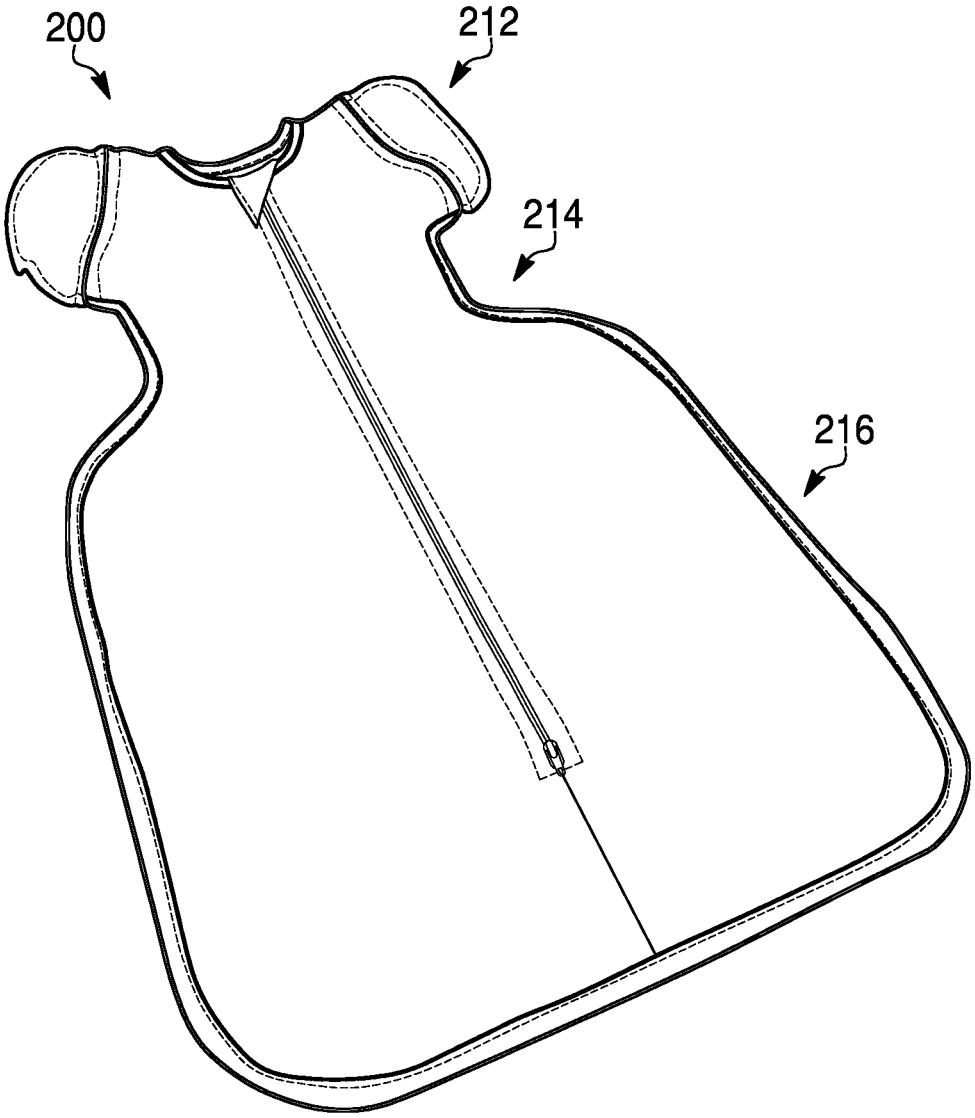
Figure 8B:
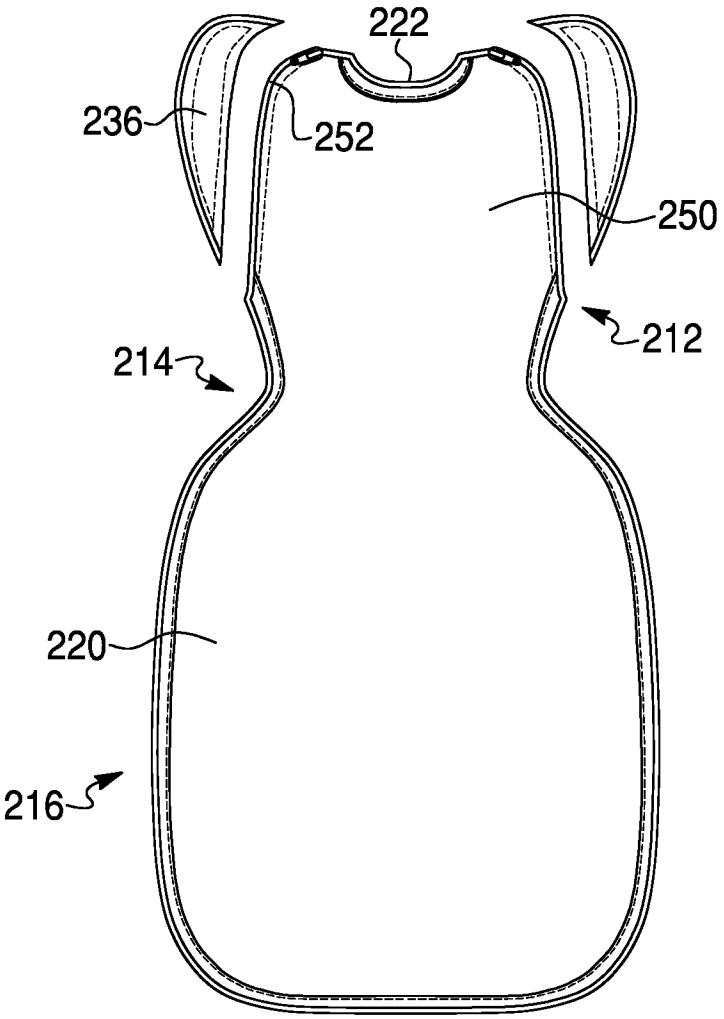
FIGS. 8A-8G depict various views of the exemplary infant garment of FIGS. 7A-7G in a second and third configurations.
Figure 8A:
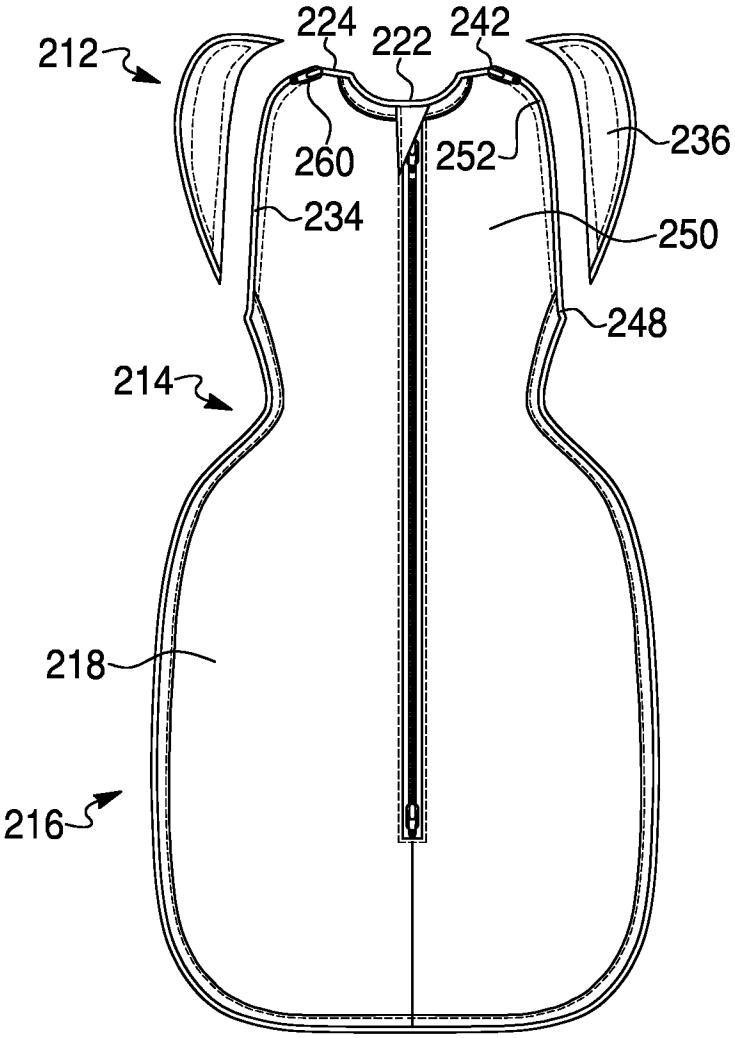
Figure 8D:
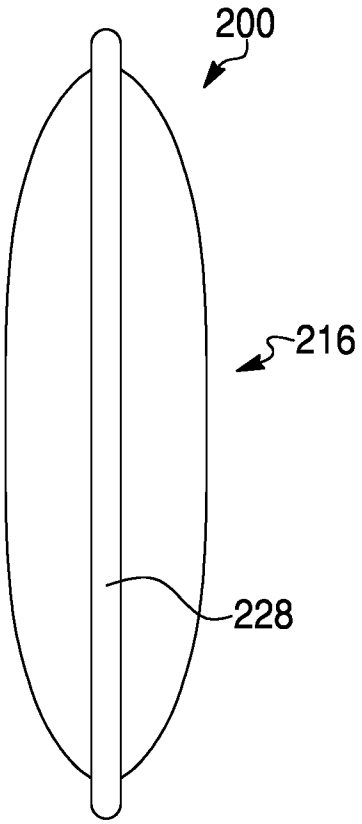
Figure 8C:
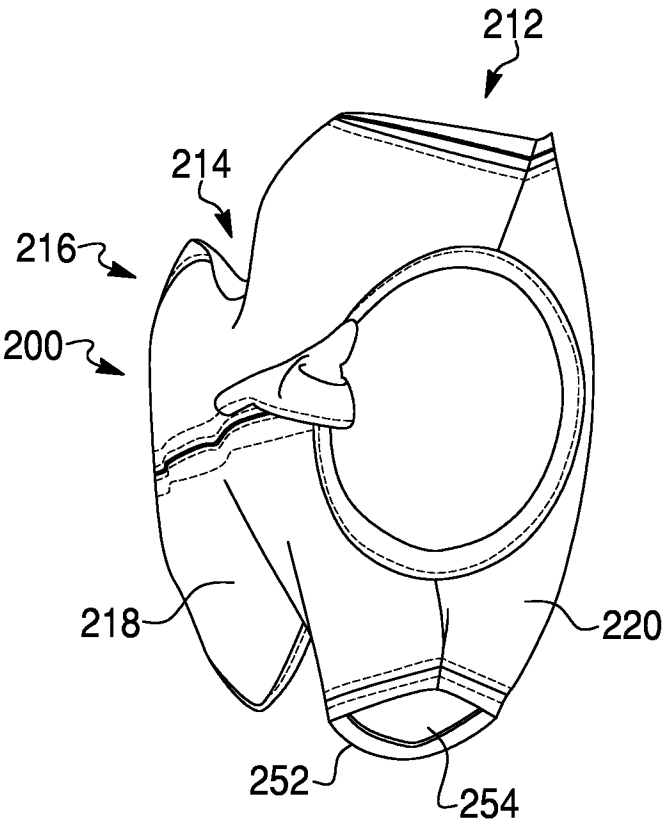
Figure 8F:
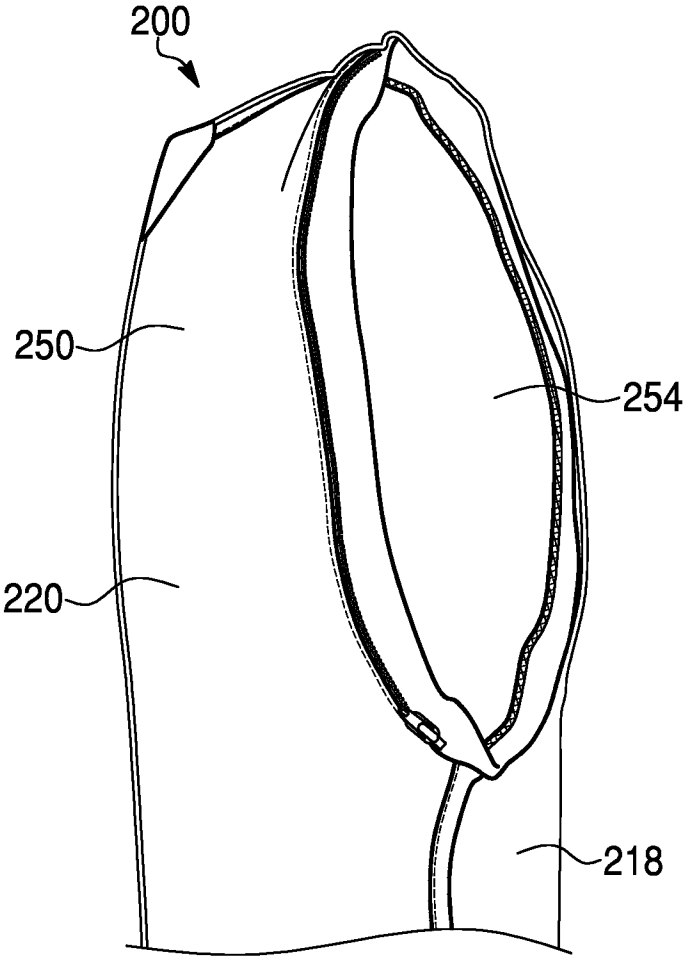
Figure 8E:
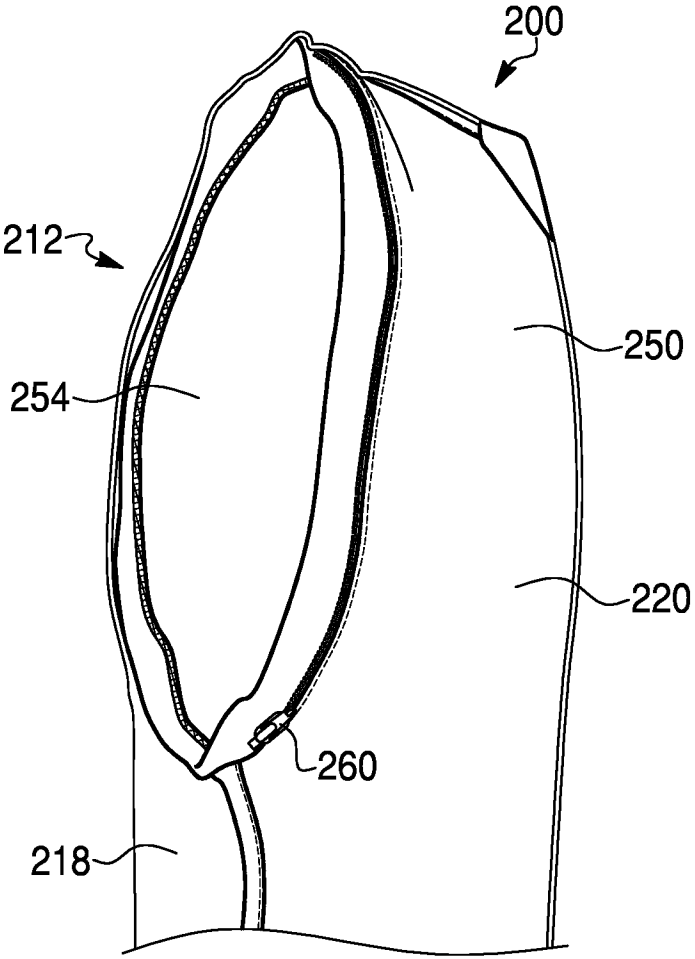
Figure 8G:
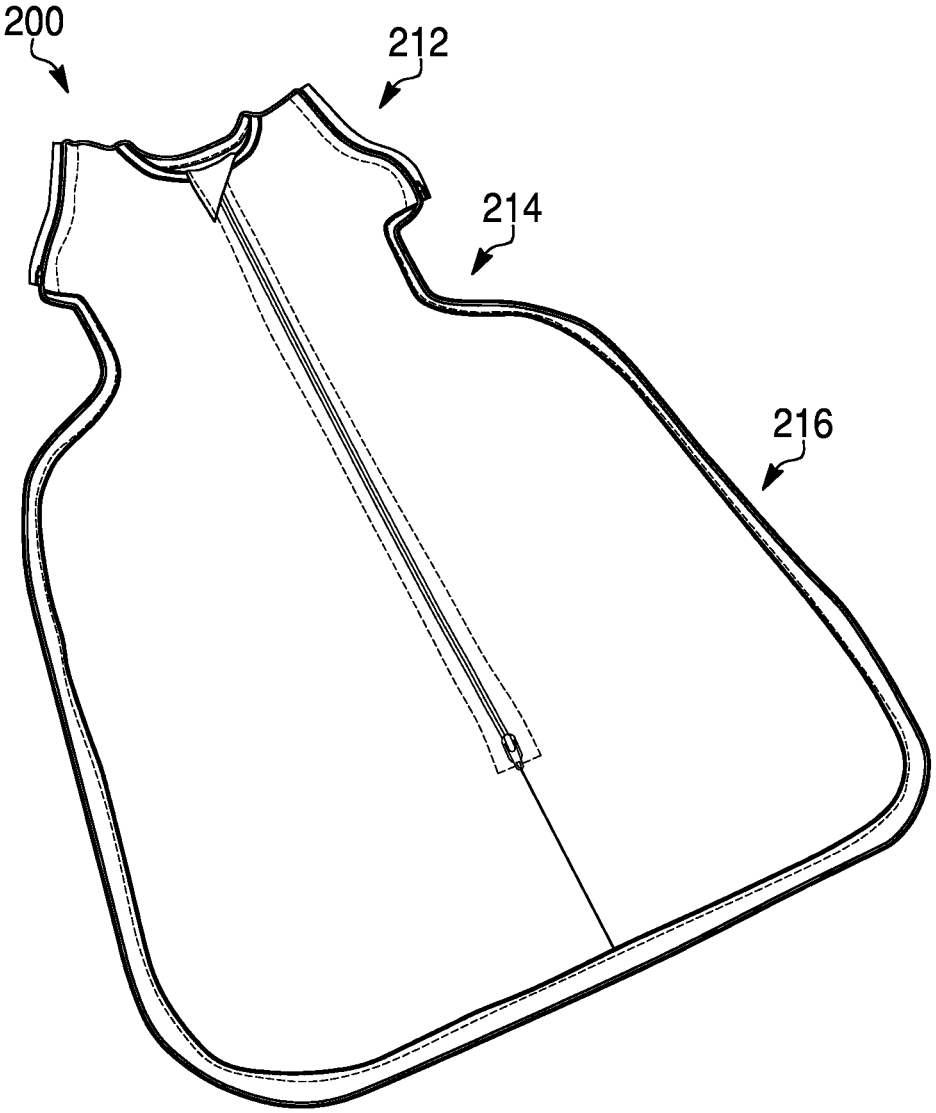
Figure 9B:
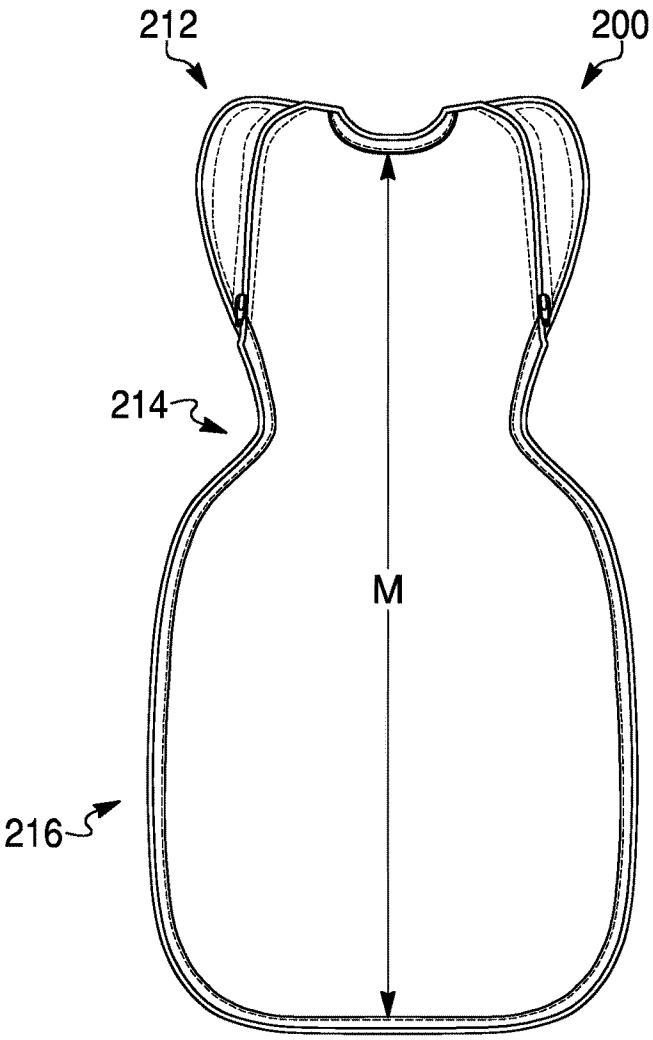
FIGS. 9A-9B depict measurements of the exemplary infant garment of FIGS. 7A-8G.

FIGS. 7A-9B depict another exemplary garment 200. FIGS. 7A-7G show garment 200 in a first configuration (configured for retaining the infant in an arms-up, elbows bent position), FIGS. 8A-8B show garment 200 in a second configuration (configured for retaining the infant's arms in an arms-down position with the arms of the infant retained by the infant's sides or across the infant's torso), FIGS. 8C-8E show garment 200 in a third configuration (for allowing the infant's arms to pass through openings of garment 200), and FIGS. 9A-9B show select, exemplary measurements associated with garment 200. Except as specified below, garment 200 may have any of the features of garments 10 or 100, and like reference numbers are used to denote like elements, where possible.

An upper portion 212 of garment 200 may include a bodice 250 and two wing portions 230, extending laterally from opposite sides of bodice 250. In the first configuration (FIGS. 7A-7G), wing portions 230 may extend laterally outward (away from collar 222) from opposite sides of bodice 250. In the second configuration, wing portions 230 may be detached from bodice 250 and a resulting opening 254 of bodice 250 (FIG. 8C, 8E, 8F) may be closed with closures/fasteners. As discussed in further detail below, wing portions 230 may be attached to bodice 250 via closures/fasteners, such as a zipper 260. In a third configuration, openings 254 may remain open so as to allow an infant's arms to extend through openings 254. FIGS. 8A-8G depict garment 200 in either the second configuration or the third configuration. Such a swaddle may allow an infant to transition between the arms-up and arms-down configuration, or instead position its arms outside of the swaddle, depending on the configuration of the swaddle. This swaddle design may allow a caregiver to modify the swaddle based on infant preferences and/or may extend the use life of the swaddle by allowing for continued use of the swaddle (i.e., in the third, arms-out configuration) once an infant is beyond the swaddling phase.

Wing portions 230 may include a fabric gusset/panel 236 that extends between an outer perimeter 232 (which may be an outer perimeter of wing portions 230 when attached and, in the first configuration, an outer perimeter of garment 200), and an inner perimeter 234 (which may be an outer perimeter of a portion of bodice 250 and, in the second configuration, an outer perimeter of garment 200 when the wing portions 130 are detached). Inner perimeter 234 may define a closable opening 254 (FIG. 8F) when wing portion 230 has been detached from bodice 250. Inner perimeter 234 may form a junction between wing portion 230 and bodice 250 on both of sides 218, 220. Panel 236 may be attached to bodice 250 along inner perimeter 234, between a first junction end 242 (i.e., an upper end) and a second junction end 248 (i.e., a lower end). Accordingly, each wing portion 230 may be defined between first junction end 242 and second junction end 248 when attached, and each zipper 260 (or other fastening mechanism) may extend from first junction end 242 to second junction end 248. In this manner, garment 200 may be transitioned between the first and third configurations by zipping or un-zipping zippers 260 to attach or detach wing portions 230.

Wing portion 230 may be symmetrical on a front side 218 and a back side 220 of garment 200. For example, distances between outer perimeter 232 and inner perimeter 234 may be the same on front side 218 and back side 220 in the first configuration. In alternatives, each wing portion 230 may differ on front side 218 and back side 220. For example, a distance between outer perimeter 232 and inner perimeter 234 may be different between front side 218 and back side 220, such that each wing portion 230 may be larger on one of front side 218 than on back side 220. Outer perimeter 232 may be continuous with an outer perimeter of waist portion 214 and lower portion 216 when in the first or second configurations, such that wing portion 130 does not define an opening (e.g., for a hand or arm to pass through). In other words, panel 236 may be configured to attach to and extend from a portion of garment 200 in the first configuration while still retaining arms of an infant within garment 200 when zippers 260 are zipped to connect wing portion 230 to bodice 250 (FIGS. 7E, 7F). Garment 200 may be configured to enclose and retain the arms of an infant within wing portions 230 of garment 200 in the first configuration when zipper 226 is zipped up in the first configuration. In other words, wing portion 230 may cover opening 254 when attached, preventing an infant's hand or arm from extending out of garment 200.

One or more closures/fasteners, such as a zipper 260 (having any of the properties of zipper 60) may join wing portion 230 to bodice 250 in the first configuration, along front side 218 and back side 220. As discussed below, each zipper 260 may be opened to detach each respective wing portion 230 from bodice 250 (FIGS. 8A-8G), and each zipper 260 may be closed to attach each respective wing portion 230 to bodice 250 (FIGS. 7A-7G). In the second configuration (FIGS. 8A-8B), openings 254 (see FIGS. 8E-8F) of bodice 250 that are in communication with interiors of wing portions 230 in the first configuration may be closed with the same or different closures/fasteners as those used to attach wing portions 230. For example, bodice 250 may include a portion of zipper 260 that includes a zipper pull and extends along front side 218 to back side 220, encircling a perimeter of opening 254. This portion may mate with a portion of zipper 260 on wing portion 230, when attached. When wing portion 230 is not attached, a first end and a second end of zipper 260 on bodice 250 may be adjacent to one another on opposite sides of garment 200, e.g., front and back sides. This may allow the zipper pull, when positioned at one end of zipper 260, to receive the opposite end of the zipper 260. In this way, zipper 260 may be able to zip front side 218 to back side 220 along inner perimeter 234 to close opening 254. Accordingly, the same portion of zipper 260 may be used to either engage with a zipper portion on wing portion 230 to attach a wing portion 230, or may engage with itself to close opening 254 in the second configuration. Alternatively, bodice 250 may include a second zipper (not shown) that may zip to close openings 254. In another alternative example, a first side of wing portion 230 (e.g., a front side) may include a plurality of buttons, and a second side of wing portion 230 (e.g., a back side) may include a plurality of buttonholes. Bodice 250 may include corresponding buttons/buttonholes for mating with the buttons/buttonholes of wing portion 230. When wing portion 230 is removed, the buttons of bodice 250 may be mated with the buttonholes of bodice 250 to close opening 254. Similarly, wing portion 230 may include male snaps on one side and female snaps on another side. Bodice 250 may include snaps that may mate with the snaps of wing portion 230 in the first configuration and may be used to close opening 254 in the second configuration.

A shape of outer perimeter 232 of each wing portion 230 in the first, expanded configuration of FIGS. 7A-7G will now be described. The shape of outer perimeter 232 may be similar to or the same as the shape of outer perimeters 32, 132 of garments 10, 100. First junction end 242 may be at or near shoulder 224. Outer perimeter 232 may extend outward (away from shoulder 224 and collar 222) and upward. For example, outer perimeter 232 may extend approximately linearly to an apex 244 (a highest/upper-most portion of FIGS. 7A-7B). Alternatively, apex 244 may be approximately even with shoulder 224, or apex 244 may be below shoulder 224. Outer perimeter 232 may then curve outward further away from shoulder 224/collar 222 and downward to a widest point 246. Between widest point 246 and second junction end 248, outer perimeter 232 may taper laterally inward towards bodice 250. In some aspects, outer perimeter 232 may extend more downward than laterally inward between widest point 246 and second junction end 248.

A shape of inner perimeter 234 (which forms a portion of an outer perimeter of garment 200 in the second configuration of FIGS. 8A-8B) is described below. Inner perimeter 234 may extend laterally outward and downward from first junction end 242 to a widest section 252. Between first junction end 242 and widest section 252, inner perimeter 234 may extend laterally outward at a decreasing rate. For example, a width of inner perimeter 234 may increase more near shoulder 224 than near widest section 252. Widest section 252 may have an approximately constant width, such that inner perimeter 234 may extend approximately downward at widest section 252. For example, inner perimeter 234 may extend approximately downward to second junction end 248.

Although the above description discusses the first configuration (FIGS. 7A-7G) and the second/third configurations (FIGS. 8A-8G), garment 200 also may have a fourth configuration, in which one wing portion 230 may be attached, and one wing portion 230 may be detached. For example, a left wing portion 230 may be attached, and a right wing portion 230 may be detached. In another example, the right wing portion 230 may be attached, and the left wing portion 230 may detached. Alternatively, different combinations of wing portions 230 and open/closed openings 254 may be utilized to achieve a desired position of an infant.

Figure 9A:
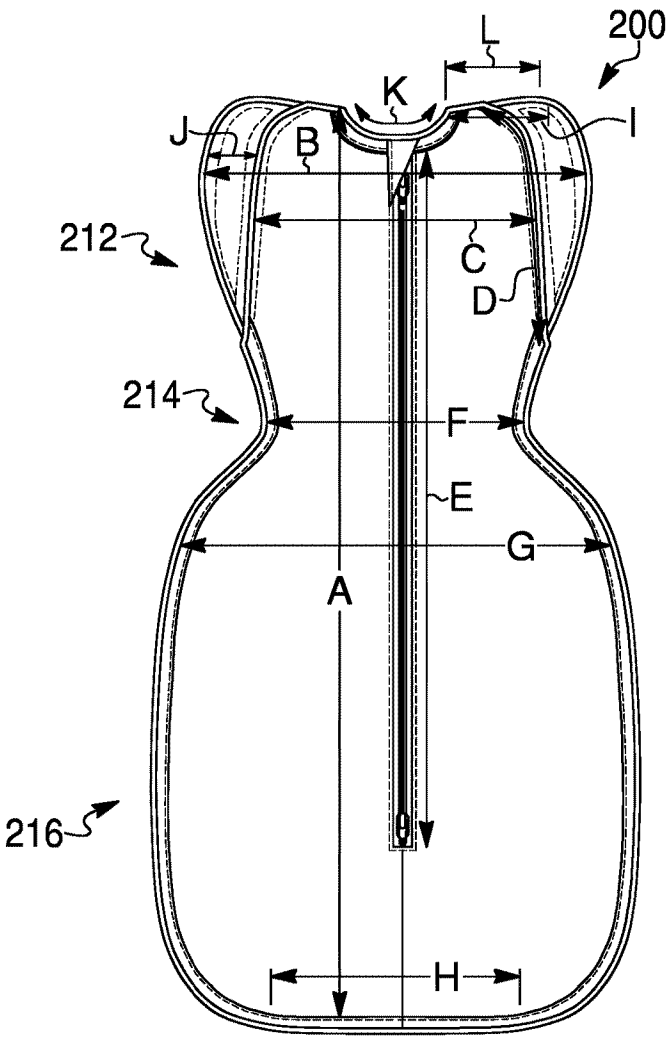

FIG. 9A may be identical to FIG. 7A but with measurement values denoted. FIG. 9B may be identical to FIG. 7B but with measurement values denoted. Measurements may differ for different sizes of garment 200, e.g., x-small, small, medium, large, and x-large sizes. The measurements below may apply to a garment designed to fit an infant between approximately 6.0 kg and approximately 8.5 kg, for example. The values of measurements A-M may be identical or similar to the values of measurements A-M of FIGS. 3A-3B and are therefore not provided below. Where relevant, structures of garment 200 corresponding to measurements A-M that differ from structures of garment 10 or 100 are denoted below. If not noted below, the measurements refer to the same structures as garment 10 or 100. As with garment 10 or 100, in some examples, relative proportions of the below measurements of garment 200 may be maintained for different sizes of garment 200. Alternatively, different sizes of garment 200 may have different measurements.

Measurement B in FIG. 9A refers to a width from widest point 246 of one wing portion 230 (e.g., the left wing portion 230) to widest point 246 of the other wing portion 230 (e.g., the right wing portion 230). A portion of width B extending across bodice 250 (not including wing portions 230 on either side of bodice 250) may be between approximately 16 cm and approximately 26 cm, between approximately 18 cm and approximately 24 cm, or approximately 21 cm. A portion of width B extending across each wing portion 230 may be between approximately 2.0 cm and approximately 7 cm, between approximately 3.5 cm and approximately 5.5 cm, or approximately 4.5 cm. Widest point 246 of each of wing portion 230 may be located between approximately 3 cm and approximately 10 cm, between approximately 4 cm and approximately 8 cm, or approximately 6 cm below apex 244 of wing portion 230 (in a downward direction of FIG. 9A). Measurement C may refer to a width from widest section 252 of one side of bodice 250 (e.g., a left side) to widest section 252 of the other side of bodice 250 (e.g., a right side). Measurement C may correspond to a width of a widest portion of upper portion 212 in the second configuration. Measurement D may correspond to a length of a zipper 260 between wing portion 230 and bodice 250. Measurement D may be between approximately 44 cm and approximately 64 cm, between approximately 49 cm and approximately 59 cm, or approximately 54 cm, as zipper 260 may extend around the periphery of opening 254 along both front side 218 to back side 220. A length of a zipper for securing openings 254 in the second configuration when wing portion 230 is removed and zipper 260 is zipped back onto itself may be between approximately 20 cm and approximately 35 cm, between approximately 25 cm and approximately 30 cm, or approximately 27 cm. This length may correspond with the length from first junction end 242 to second junction end 248. In other words, the length of the zipper for closing openings 254 in the second configuration when the zipper is doubled back on itself may be approximately half of the length of zipper 226 when it is fully extended along the periphery of an opening 254 to engage with a corresponding zipper portion on a wing portion 230.

A shape of garment 200, in the first configuration (FIGS. 7A-7G), with an infant positioned therein will now be described. It will be noted that a shape of garment 200 when worn by an infant may depend on a size and shape of the infant. In the first configuration (FIGS. 7A-7G), the infant's torso (an area between the infant's waist and the bottom of the infant's neck) may be generally disposed within bodice 250, with the infant's neck extending through the opening defined by collar 222 (see the opening of FIG. 7C). The infant's shoulders may be positioned near or abutting shoulder 224. The infant's waist may be at or near waist portion 214. The infant's hips may be within a wider portion of lower portion 216. As shown in, e.g., FIG. 7A, lower portion 216 widens below waist portion 214 to provide space to the infant's hips and to assist in preventing disorders like hip dysplasia.

The infant's arms may be received within bodice 250, wing portions 230, and/or through openings 254, depending on whether garment 100 is in the first configuration, the second configuration, or a third configuration, as described above. A material of garment 200, including wing portion 230, may be stretchable in at least one of the warp or weft direction to facilitate accommodation of accommodate the infant's arms in the first and second configurations while retaining them therein and allowing some movement towards the face while, while inhibiting the infant's startle reflex. When garment 200 is in the first configuration (FIG. 7A), the he infant's hand may be positioned in an upper portion of a wing portion 230, e.g., at or near apex 244 and/or first junction end 242. This positioning of the infant's hand(s) may allow for non-nutritive sucking by the infant of the fabric enclosing the hand(s). The infant's elbows may be positioned within a lower portion of wing portion 230/panel 236. For example, the infant's elbows may be positioned at or near second junction end 248. The infant's arms may stretch fabric (assuming stretchable fabric is used) of wing portion 230 laterally outward (away from zipper 226). In other words, in the second configuration, the infant may be in an "arms up" position. In some aspects, the infant's arms may also stretch the fabric downwards when retained within wing portions 230 so that when the infant is in garment 200, a lower region of wing portions 230 containing the elbow is pulled down lower than second junction end 248. In this way, a lower region of each wing portion 230 may cup the infant's bent elbow as the fabric of wing portion 230 is stretched down past second junction end 248.

At widest points 246 of wing portions 230, a width of each wing portion 230 (a distance between outer perimeter 232 and inner perimeter 234 at widest point 246) may be greater than approximately 2.0% of a width of bodice 50 at widest point 46, or 5.0% of a width of bodice 50 at widest point 46. For example, a width of one of wing portions 30 at widest point 46 may be between approximately 5.0% and approximately 50%, between approximately 8.0% and approximately 27%, between approximately 10.0%, and approximately 45%, between approximately 11% and approximately 40%, between approximately 25% and approximately 35%, or approximately 13%, approximately 21%, or approximately 32% of a width of bodice 250 at widest point 246. The ratios/percentages above may depend upon a type of fabric used for wing portions 230 and/or other portions of garment 200, which may be made of the same or different fabric. For example, if garment 200 or wing portions 230 are made of a fabric with a greater stretchability, the ratio/percentage may be on a lower side of the ranges above, because the infant's arms may be able to stretch the fabric more in order to achieve the arms-up, elbows-bent position described above. If garment 200 includes a less stretchable fabric, the ratio/percentage may be greater (e.g., on a higher side of the ranges above) in order to accommodate the infant's arms in the "arms up" position.

To position the infant within garment 200 in the first configuration, a caregiver may zip zipper 260 (or open another suitable fastening mechanism) of bodice 250 to a complementary zipper portion on a corresponding wing portion 230. Zipper 260 may secure a wing portion 230 to bodice 250 around a perimeter of opening 254 so that an infant's arms may extend out from bodice 250, through a respective opening 254, and into a respective wing portion 230. When attached, each wing portion 230 may extend laterally from opposite sides of bodice 250. A caregiver may then unzip zipper 226 (or open another fastening closing mechanism) so that garment 200 is open. While the figures depict zipper 226 on the front side 218 of garment 200, zipper 226 may be off-centered on front side 218, may be along a side portion of garment 200, or may be on back side 220. The caregiver may place the infant into garment 200 through an opening created by zipper 226 or other fastening mechanism. The caregiver may place the infant's feet near lower hem 228. The caregiver may position the infant's head so that collar 222 surrounds the infant's neck. The caregiver may position the infant's arms such that the infant's hands are in an upper portion of wing portions 230, e.g., near apex 244 and/or first junction ends 242 of wing portions 230. The caregiver may then zip zipper 226 (e.g., by moving the pull of zipper 226 upward) and tuck the pull of zipper 226 into zipper shield 227.

A shape of garment 200, in the second configuration (FIGS. 8A-8B), with an infant positioned therein will now be described. As with first configuration, the infant's torso may be positioned within bodice 250, with the infant's neck extending through the opening defined by collar 222. The infant's shoulders may be positioned near or abutting shoulder 224. The infant's waist may be positioned at or near waist portion 214. The infant's hips may be within a wider portion of lower portion 216.

In contrast to the first configuration, the arms of the infant may be positioned across the infant's chest toward the opposite elbows, across the chest with hand(s) pointed toward the opposite shoulder, down at the infant's sides, or with the hands facing directly upward toward the chin but unable to access/reach the mouth. Inner perimeter 234 may contact the infant's arms and/or torso. Bodice 250, defined in part by inner perimeter 234, may hug the infant's upper body, keeping the infant's arms tucked within bodice 250 and limiting or inhibiting non-nutritive sucking. In other words, in the second configuration, the infant may be in an "arms-down" or "arms-in" position. The infant may be able to move the arms between the positions described in this paragraph, e.g., from across the chest towards opposite elbows to across the chest towards opposite shoulders but may not be able to adopt an elbows-bent, arms-up position. In the second configuration, wing portions 230 are detached, and the arms may not pass through openings 254, as zippers 260 are zipped back on themselves to close openings 254 by securing front side 218 to back side 220.

To position the infant within garment 200 in the second configuration, a caregiver may not attach wing portions 230 and may instead zip each zipper 260 (or close another suitable fastening mechanism) so that zippers 260 double back on themselves to secure front side 218 to back side 220 to close each opening 254. A caregiver may then unzip zipper 226 so that garment 200 is open. While the figures depict zipper 226 on the front side 218 of garment 200, zipper 226 may be off-centered on front side 218, may be along a side portion of garment 200, or may be on back side 220. The caregiver may place the infant into garment 200 through an opening created by zipper 226 or other fastening mechanism. The caregiver may place the infant's feet near lower hem 228. The caregiver may position the infant's head so that collar 222 surrounds the infant's neck. The caregiver may position the infant's arms down by the infant's sides or across his/her torso in one of the positions described above. The caregiver may then zip zipper 226 (e.g., by moving the pull of zipper 226 upward) and tuck the pull of zipper 226 into zipper shield 227.

In the third configuration of garment 200, the infant may extend his or her arms through openings 254, such that garment 200 may not retain the infant's arms within bodice 250. To position the infant within garment 200 in the third configuration, a caregiver may not attach wing portions 230 and may not zip zippers 260, allowing openings 254 to remain open. A caregiver may then unzip zipper 226 so that front side 218 of garment 200 is open. The caregiver may place the infant into garment 200 through an opening created by zipper 226. The caregiver may place the infant's feet near lower hem 228. The caregiver may position the infant's head so that collar 222 surrounds the infant's neck. The caregiver may position the infant's arms through openings 254. The caregiver may then zip zipper 226 (e.g., by moving the pull of zipper 226 upward) and tuck the pull of zipper 226 into zipper shield 227.

FIGS. 10A-10D depict alternative configurations for lower portions of infant garments, such as garments 10, 100, 200. Although garments will be discussed separately with respect to FIGS. 10A-10D, it will be appreciated that the features described herein may be used with any of the garments disclosed above or below. And although the garments of FIGS. 10A-10D may be described as having features of garment 10, it will be appreciated that the garments of FIGS. 10A-10D may additionally or alternatively have features of garments 100, 200.

Figure 10C:
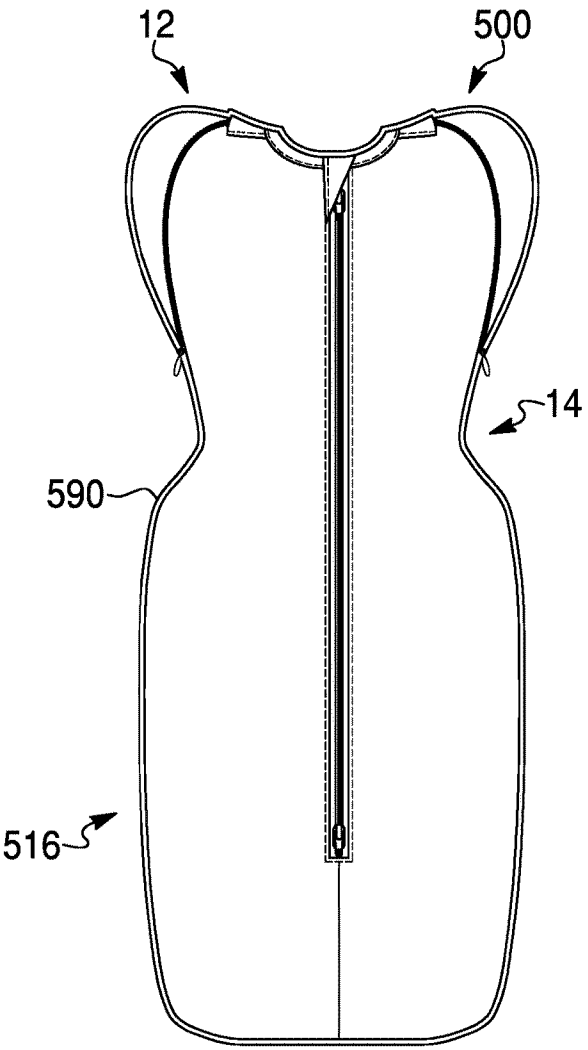
FIGS. 10A-10D depict exemplary infant garments having alternative bottom portions for use with the exemplary infant garments of FIGS. 1A-9B and 11A-11F.
Figure 10B:
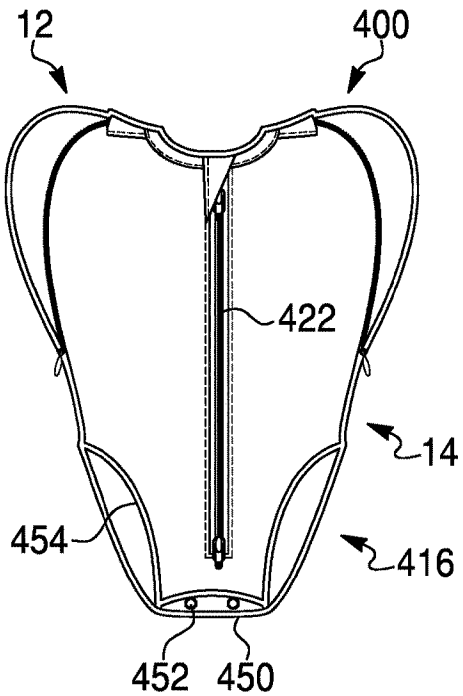
Figure 10A:
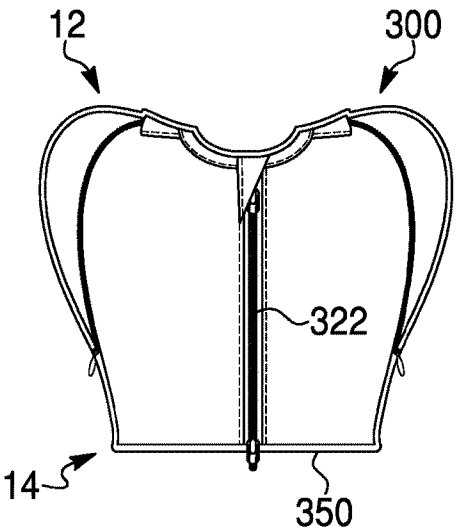

As shown in FIG. 10A, a garment 300 may include upper portion 12 and waist portion 14, as in garment 10. However, garment 300 may not include a lower portion and may terminate in a hem 350 near waist portion 14. Hem 350 may define an opening through which a lower portion of an infant's body may extend. A zipper 322 may be used to open/close garment 300. As shown in FIG. 10A, zipper 322 may include two pulls, allowing for opening of zipper 322 from above (to insert an infant feet-first into garment 300) or below (to pass garment 300 over the infant's head). As compared with zipper 26, zipper 322 may be shorter to accommodate a shorter size of garment 300. In some aspects, zipper 322 may extend through hem 350 so that garment 300 may be completely opened in the front.

FIG. 10B depicts a garment 400, which may include upper portion 12 and waist portion 14, as with garment 10. Garment 400 also may include a lower portion 416, which may define two leg openings 454. A lower hem 450 may extend between leg openings 454 and may be secured by closures (e.g., snaps) 452. A zipper 422 may have any of the features of zippers 22, 322 and may be shorter than zipper 26 and longer than zipper 322.

FIG. 10C depicts a garment 500, which may include upper portion 12 and waist portion 14, as with garment 10. As compared to lower portion 16 of garment 10, a lower portion 516 of garment 500 may be narrower. A hip 590 of lower portion 516 may extend outward less than a hip 90 of garment 10. Thus, lower portion 516 may provide relatively less room to an infant's legs than lower portion 16 of garment 10.

Figure 10D:
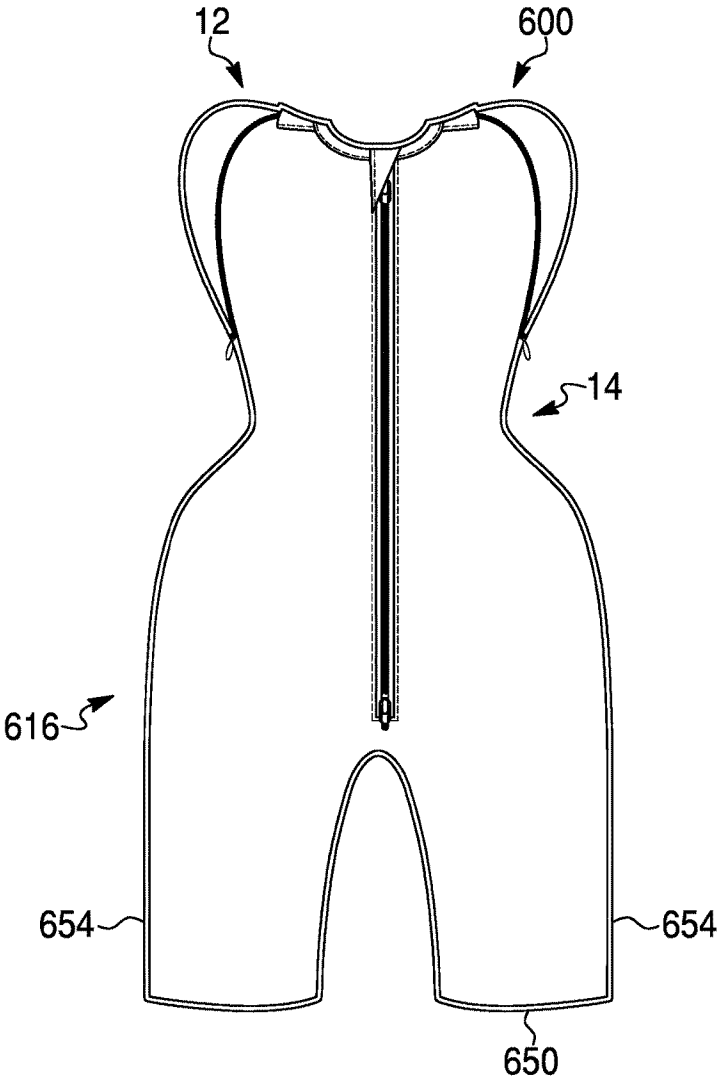

FIG. 10D depicts a garment 600, which may include upper portion 12 and waist portion 14, as with garment 10. A lower portion 616 of garment 10 may define two legs 654. Legs 654 may receive an infant's legs. As shown in FIG. 10D, a bottom hem 650 of legs 654 may be open. Alternative, bottoms of legs 654 may define receptacles for receiving the infant's feet. Legs 654 may be dimensioned so as to fit like pants on an infant, so as to fit like shorts on an infant, or so as to fit like cropped pants on an infant, i.e., between full pant length and shorts.

FIGS. 11A-11F depict variations to shapes of wing portions for use with any of the garments discussed herein. The features of FIGS. 11A-11F may be combined with the features of any of the garments of FIGS. 1A-10D. And, although the garments of FIGS. 10A-10D may be described as having features of garment 10, it will be appreciated that the garments of FIGS. 11A-11F may additionally or alternatively have features of any of the garments disclosed herein. An inner perimeter of the garments described below may be the same as inner perimeter 34 of garment 10, but the outer perimeters may have different shapes. It will be appreciated that the wing portions disclosed herein may be used to retain an infant's arms in a variety of configurations in a first configuration of a garment. For example, an infant's arms may be retained in an arms-up, elbows-bent configuration, with the infant's hands positioned proximate to the infant's shoulders/chin/mouth, allowing for non-nutritive sucking. In alternatives, an infant's arms may be retained in an arms-up configuration, with the elbows slightly bent (or unbent), such that the infant's hands extend upward to/toward the infant's head (e.g., above the infant's ear). In other alternatives, an infant's arms may be retained in an arms-up or arms-out configuration, with the elbows slightly bend (or unbent), such that the infant's hands are positioned outstretched to the side of the infant.

Figure 11A:
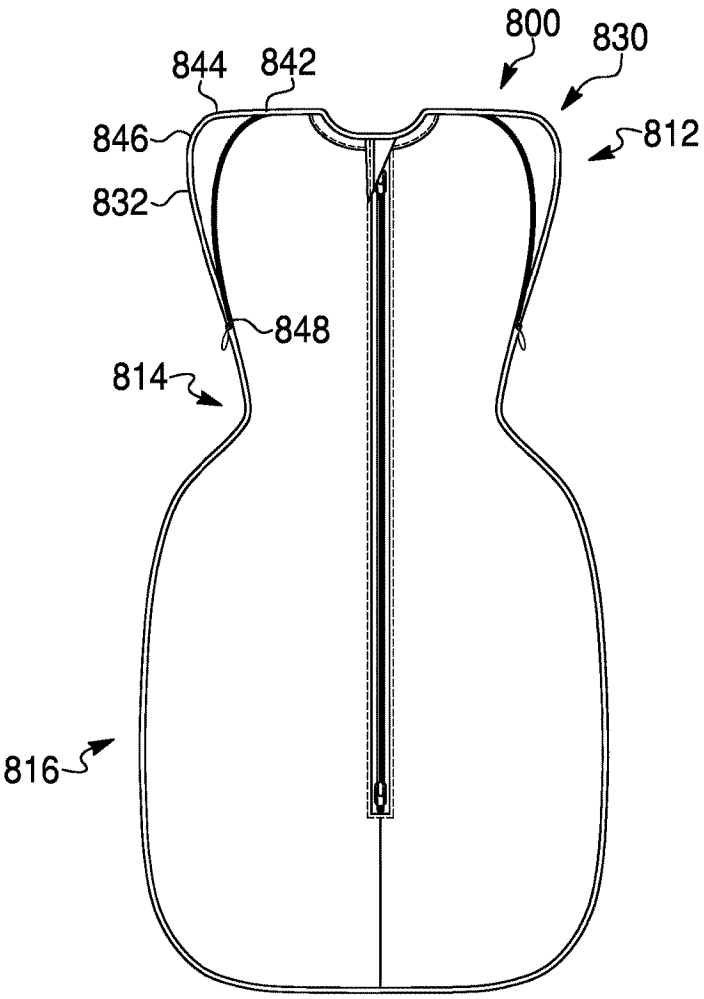
FIGS. 11A-11F depict exemplary infant garments having alternative top portions for use with the exemplary infant garments of FIGS. 1A-10D.

Garment 800 of FIG. 11A may include an upper portion 812, a waist portion 814, and a lower portion 816. A wing portion 830 may include any of the features of wing portion 30, 130, 230 except as described herein. From a first junction end 842, an outer perimeter 832 of wing portion 830 may extend substantially horizontally outward in FIG. 11A along a straight portion 844 (which may be a highest portion of wing portion 830). Outer perimeter 832 may curve downward to widest point 846, before tapering downward to second junction end 848. Thus, wing portion 830 may differ from wing portion 30 in that wing portion 830 may extend horizontally along straight portion 844, instead of curving upward to apex 44 of wing portion 30.

Figure 11C:
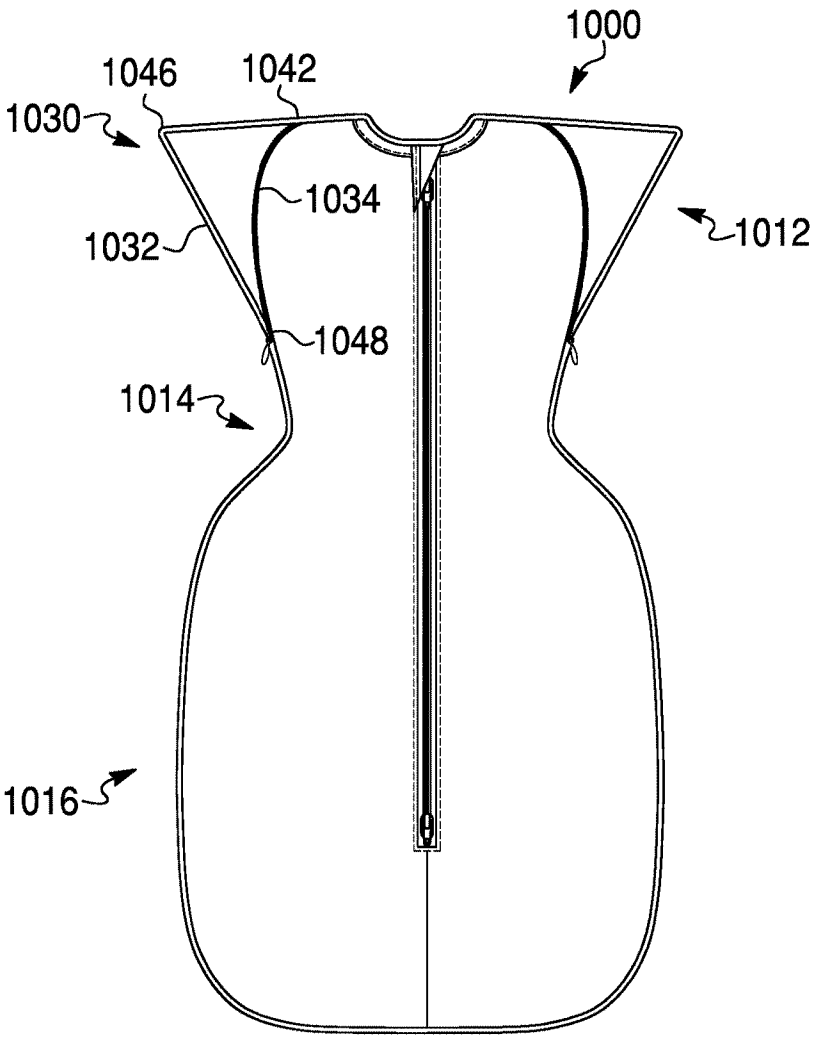
Figure 11B:
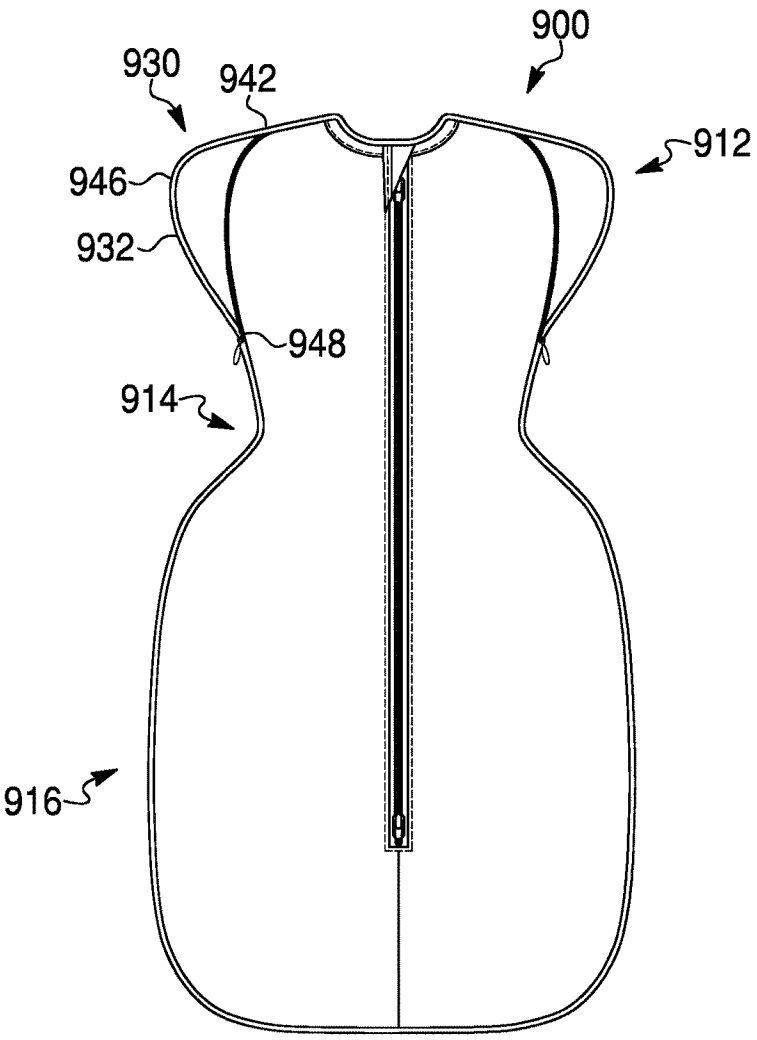

Garment 900 of FIG. 11B may include an upper portion 912, a waist portion 914, and a lower portion 916. A wing portion 930 may include any of the features of wing portion 30, 130, 230 except as described herein. From a first junction end 942, an outer perimeter 932 of wing portion 930 may taper gradually downward to a widest point 846, before tapering downward to second junction end 948. Thus, wing portion 930 may differ from wing portion 30 in that wing portion 930 may taper downward to widest point 946, instead of curving upward to apex 44 of wing portion 30.

Garment 1000 of FIG. 11C may include an upper portion 1012, a waist portion 1014, and a lower portion 1016. A wing portion 1030 may include any of the features of wing portion 30, 130, 230 except as described herein. Wing portion 1030 may include a pointed widest point 1046. As shown in FIG. 11C, outer perimeter 1032 may extend approximately horizontally from first junction end 1042 to widest point 1046. A distance between widest point 1046 and an inner perimeter 1034 of garment 1000 (a width of wing portion 1030) may be greater than a width of corresponding wing portions of other embodiments described herein. Outer perimeter 1032 may taper approximately linearly between widest point 1046 and second junction end 1048. Alternatively, outer perimeter 1032 may extend upward or downward to widest point 1046. Although outer perimeter 1032 is depicted as having two approximately linear legs, outer perimeter 1032 may alternatively include curved portions, as for other wing portions described herein.

Figure 11E:
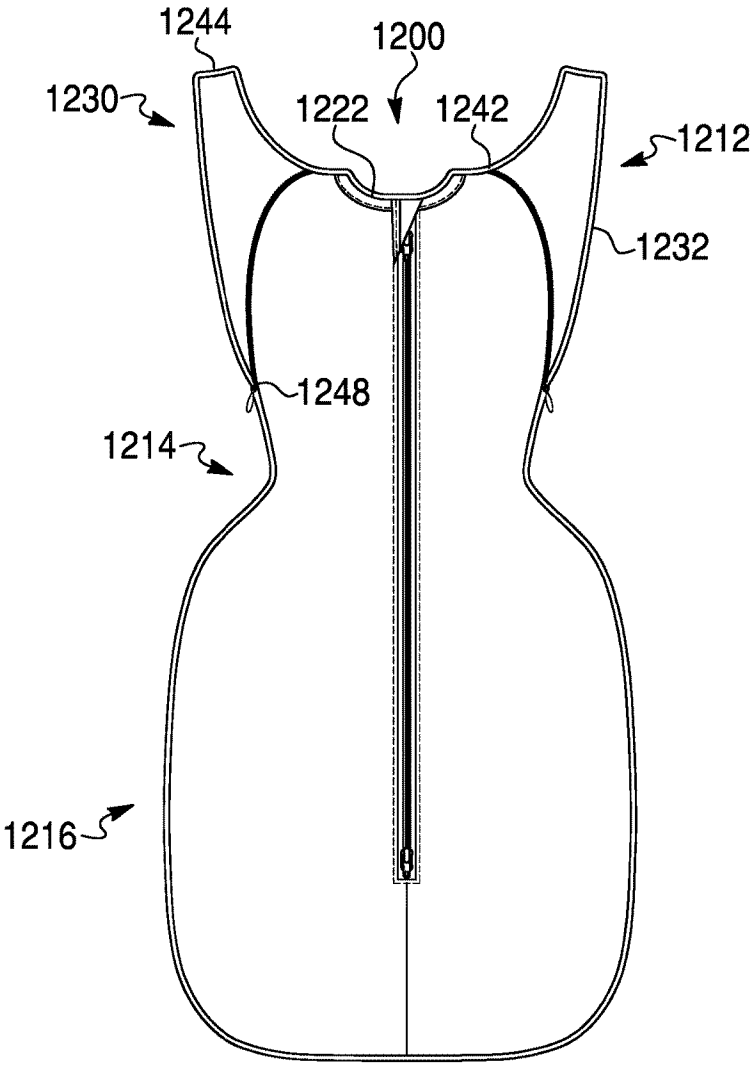
Figure 11D:
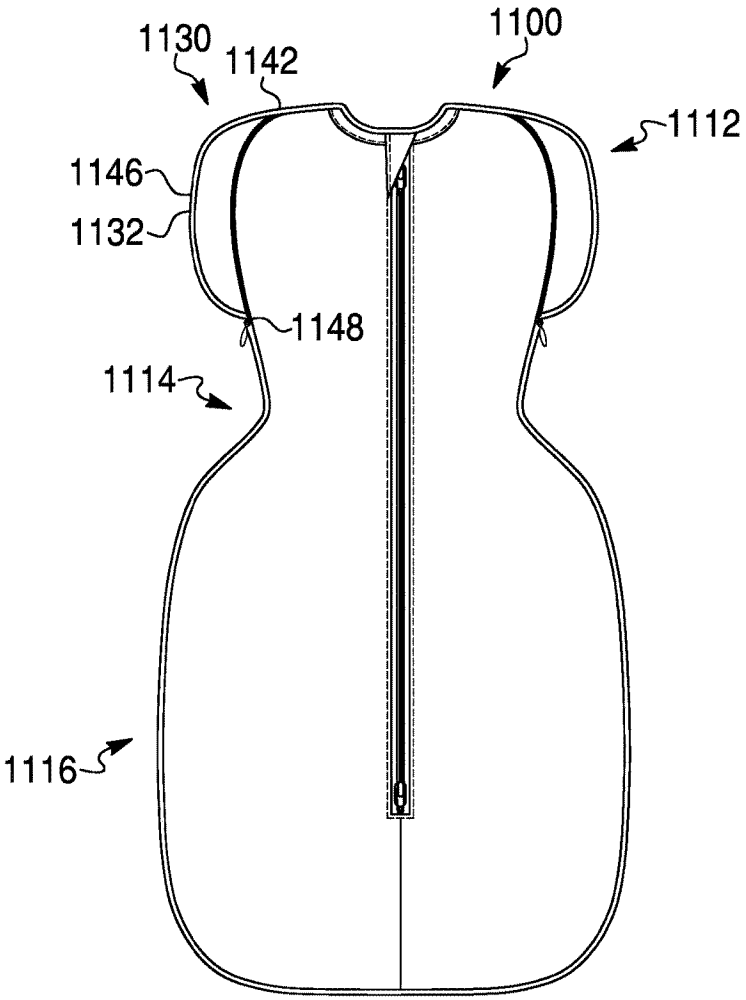

Garment 1100 of FIG. 11D may include an upper portion 1112, a waist portion 1114, and a lower portion 1116. A wing portion 1130 of garment 1100 may be configured to accommodate an entire arm of an infant. Similarly to garment 900, wing portion 1130 may taper slightly downward from a first junction end 1142 to a widest portion 1146. Widest portion 1146 may have a relatively constant width (outer perimeter 1132 may extend approximately vertically along widest portion 1146. Widest portion 1146 may then taper inward to first junction end 1148. As compared to wing portions such as wing portions 30 and 1030, wing portion 1130 may have a greater volume near widest portion 1146. This increased volume may allow for more of/all of an infant's arm to fit within wing portion 1130. In any of the examples described herein, various amounts of an infant's arm may be accommodated in a wing portion. For example, certain wing portions may accommodate only a lower portion of an infant's arm (e.g., portions of the arm below the elbow (including the wrist and hand), other wing portions may accommodate an entirety of the infant's arm, may accommodate the elbow and lower portions of the infant's arm, and/or may accommodate the infant's lower arm and part of the infant's upper arm.

Garment 1200 of FIG. 11E may include an upper portion 1212, a waist portion 1214, and a lower portion 1216. A wing portion 1230 of garment 1200 may have an extended profile as compared to the other wing portions described herein. Wing portion 1230 may be akin to a sleeve with a closed end in some configurations, or a sleeve with an open end in other configurations, which may allow a hand to pass through. An outer perimeter 1232 of wing portion 1230 may extend sharply upward from first junction end 1242 to an apex 1244. As compared to apex 44, apex 1244 may be higher relative to collar 1222. From apex 1244, outer perimeter 1232 may taper gradually inward to second junction end 1248. A shape of wing portion 1230 may allow an infant to extend his or her arms further upward in the arms-up position. A fabric of wing portion 1230 may have properties that retain the infant's hand/arm pointing upward, inhibiting the infant from lowering his/her hand/arm down by the infant's side. Although the infant may be able to lower his/her hand/arm, wing portion 1230 may encourage the infant to retain his/her arm pointing upward and discourage lowering of the hand/arm down by the infant's side.

Exemplary measurements of garment 1200 may include any of the measurements disclosed herein. Additionally or alternatively, for a garment designed to fit an infant between approximately 6.0 kg and approximately 8.5 kg, a length between a side of collar 1222 and first junction end 1242 may be between approximately 3.0 cm and approximately 9.0 cm, between approximately 4.0 cm and approximately 8.0 cm, or approximately 6.0 cm. A length between first junction end 1242 and apex 1244 may be between approximately 20.0 cm and approximately 40.0 cm, between approximately 25 cm and approximately 35 cm, or approximately 28.5 cm. For a garment designed to fit an infant between approximately 2.2 kg and approximately 3.8 kg, a length between a side of collar 1222 and first junction end 1242 may be between approximately 2.0 cm and approximately 8.0 cm, between approximately 3.0 cm and approximately 9.0 cm, or approximately 5.0 cm. A length between first junction end 1242 and apex 1244 may be between approximately 15 cm and approximately 35 cm, between approximately 20.0 cm and approximately 30.0 cm, or approximately 23.5 cm. For a garment designed to fit an infant between approximately 3.5 kg and approximately 6.0 kg, a length between a side of collar 1222 and first junction end 1242 may be between approximately 2.5 cm and approximately 8.5 cm, between approximately 3.5 cm and approximately 9.5 cm, or approximately 5.5 cm. A length between first junction end 1242 and apex 1244 may be between approximately 17.5 cm and approximately 37.5 cm, between approximately 22.5 cm and approximately 32.5 cm, or approximately 26.0 cm. For a garment designed to fit an infant between approximately 8.5 kg and approximately 11.0 kg and/or a garment designed to fit an infant between approximately 11.0 kg and approximately 14.0 kg, a length between a side of collar 1222 and first junction end 1242 may be between approximately 3.5 cm and approximately 9.5 cm, between approximately 4.5 cm and approximately 10.5 cm, or approximately 6.5 cm. A length between first junction end 1242 and apex 1244 may be between approximately 22.5 cm and approximately 42.5 cm, between approximately 27.5 cm and approximately 37.5 cm, or approximately 31.5 cm. A size of wing portion 1230 (e.g., a distance from first junction end 1242 and apex 1244) may be up to approximately 175%, up to approximately 150%, or up to approximately 125% of a width of a bodice of garment 1200.

Figure 11F:
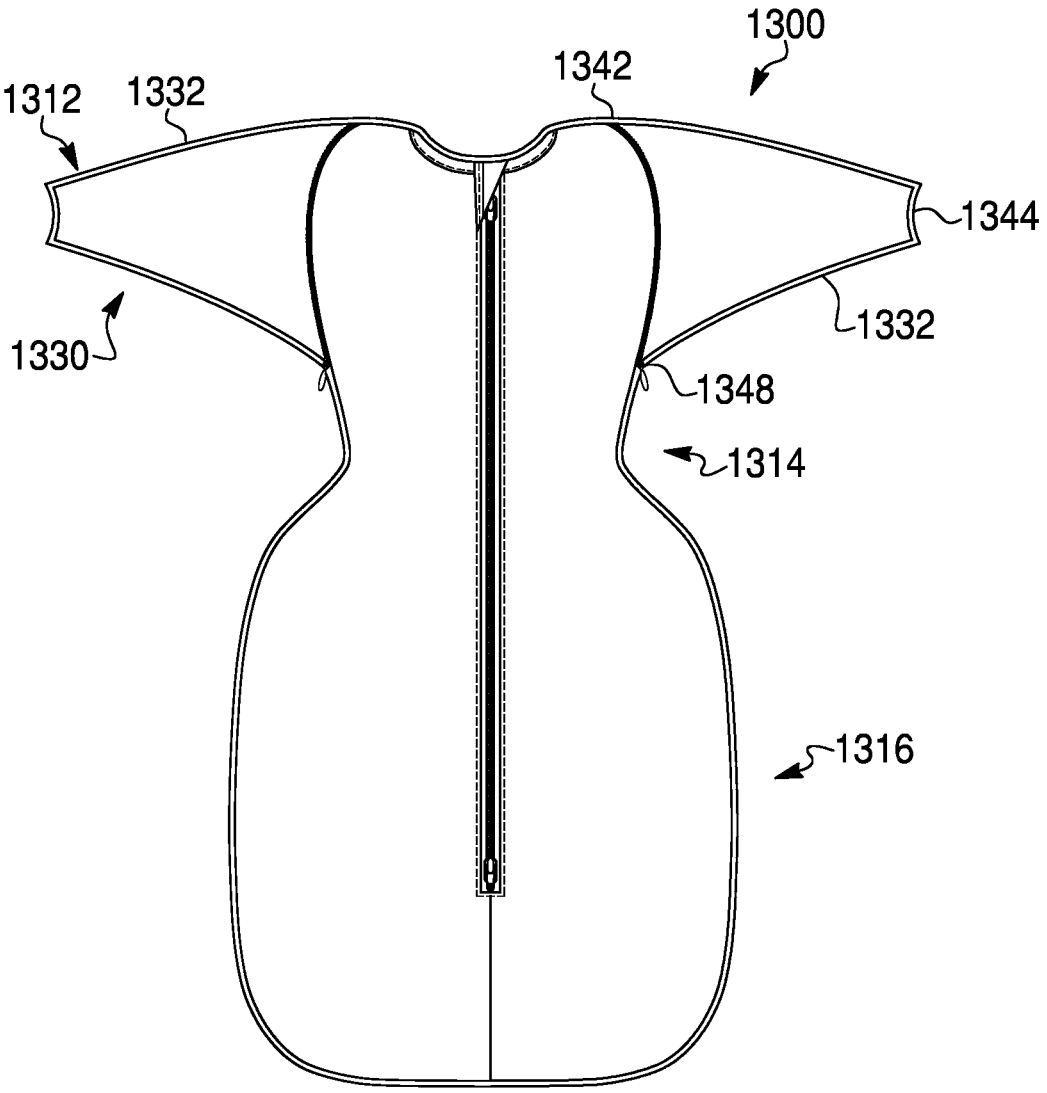

A garment 1300 of FIG. 11F may include an upper portion 1312, a waist portion 1314, and a lower portion 1316. A wing portion 1330 of garment 1300 may be somewhat similar to wing portion 1230 of garment 1200, except as specified herein. Similarly to wing portion 1230, wing portion 1330 may be akin to a sleeve with a closed end in some configurations, or a sleeve with an open end in other configurations, which may allow a hand to pass through. An outer perimeter 1332 of wing portion 1330 may extend laterally outward from first junction 1342 to a laterally widest portion 1344. Outer perimeter 1332 may extend downward at a shallow angle between first junction 1342 and laterally widest portion 1344. From laterally widest portion 1344, outer perimeter 1332 may extend laterally inward to a second junction end 1348. Between laterally widest portion 1344 and second junction end 1348, outer perimeter 1332 may taper somewhat (e.g., shallowly) downward. A shape of wing portion 1330 may allow an infant to extend his or her arms outward. A fabric of wing portion 1330 may have properties that retain the infant's hand/arm pointing outward, inhibiting the infant from lowering his/her hand/arm down by the infant's side. Although the infant may be able to lower his/her hand/arm, wing portion 1330 may encourage the infant to retain his/her arm pointing outward (e.g., approximately straight) and discourage lowering of the hand/arm down by the infant's side.

Although FIGS. 11A-11F each depict garments with similar bottom portions, the upper portions of FIGS. 11A-11F may be paired with any suitable bottom portion, such as the bottom portions depicted in FIGS. 10A-10D. While the embodiments discussed above are shown as having two wing portions configured to expand and contract, any of the disclosed examples may include only one wing portion configured to expand and contract. For example, the garment may include one wing portion that is permanently in the arms-up position and another wing portion with a contractable gusset that may be transitioned between the arms-up and arms-down configurations. In such configurations, one arm of an infant may be retained in/permitted to be in an arms-up position, while the other arm may be expanded or contracted to transition the arm in either the arms-up or arms-down position. In another example, the garment may include only one wing portion, which may be transitioned between the arms-up and arms-down configurations. In such a configuration, only one arm of an infant may be transitioned between the arms-up and arms-down configurations. The other arm of the infant may be retained in an arms-down position in such configuration.

It should be understood that although the present disclosure has been made with reference to preferred embodiments, exemplary embodiments, and optional features, modifications and variations of the concepts herein disclosed may be resorted to by those skilled in the art, and that such modifications and variations are considered to be within the scope of this disclosure as defined by the appended claims. The specific embodiments and examples provided herein are examples of useful embodiments of the present disclosure and are non-limiting and illustrative only. It will be apparent to one skilled in the art that the present disclosure may be carried out using a large number of variations of the devices, device components, methods, and steps set forth in the present description. As will be recognized by one of skill in the art, methods and devices useful for the present methods can include a large number of various optional compositions and processing elements and steps.

What is claimed is:

1. An article of infant apparel, comprising:

a bodice portion including a neck opening;

a pair of wing portions, wherein each wing portion of the pair of wing portions is attached to a side of the bodice portion; and a pair of closures, each closure located at a junction between the bodice portion and one of the pair of wing portions;

wherein, in a first configuration, the pair of closures is open, and each of the wing portions is expanded, such that the wing portions extend laterally from opposite sides of the bodice portion and define a fully enclosed portion of an outer perimeter of the article of infant apparel, wherein, in a second configuration, the pair of closures is closed, and each of the wing portions is collapsed into and retained within an interior of the bodice portion by a respective closure of the pair of closures, such that the junction defines a portion of the outer perimeter of the article of infant apparel, and wherein, with the article of infant apparel in the first configuration and the wing portions extended laterally outward, a first width of the article of infant apparel is between approximately 20% and approximately 50% greater than a second width of the bodice portion of the article of infant apparel in the second configuration, wherein a widest point of each wing portion is approximately 3.0 cm to approximately 10.0 cm below a highest point of the respective wing portion.

2. The article of infant apparel of claim 1, wherein each closure includes at least one of a zipper, a snap, a button, or hook-and-loop material.

3. The article of infant apparel of claim 1, further comprising:

a waist portion; and a lower portion;

wherein, in the first configuration, the outer perimeter of the article of infant apparel is continuous and closed from a first side of the neck opening, along a widest point of a first wing portion of the pair of wing portions, along the waist portion and the lower portion, along a widest point of a second wing portion of the pair of wing portions, and to a second side of the neck opening.

4. The article of infant apparel of claim 1, wherein each wing portion includes an upper portion and a lower portion, wherein, in the first configuration, the upper portion extends further laterally from a respective side of the bodice portion than the lower portion does, and each wing portion tapers inward from the upper portion to the lower portion.

5. The article of infant apparel of claim 1, wherein each of the wing portions extends from a first junction end to a second junction end on a respective side of the bodice portion, and wherein each of the pair of closures extends from the first junction end to the second junction end on the respective side of the bodice portion.

6. The article of infant apparel of claim 5, wherein the second junction end is near a waist portion of the article of infant apparel.

7. The article of infant apparel of claim 6, wherein, with the wing portions extended laterally outward in the first configuration, an outer perimeter of each wing portion extends outward from the first junction end between the wing portion and the bodice portion to an upper-most portion of the wing portion, downward and outward from the upper-most portion of the wing portion to a widest point of the wing portion, and downward and inward from the widest point of the wing portion to the second junction end.

8. The article of infant apparel of claim 1, wherein, with the wing portions extended laterally outward, the first width between widest points of the wing portions is approximately 24 cm to approximately 33 cm.

9. The article of infant apparel of claim 8, wherein, with the wing portions extended laterally outward, measured along a line between the widest points of the wing portions, each of the wing portions has a third width of approximately 3.5 cm to approximately 7.5 cm, the third width of the wing portions being measured between an outer perimeter of the bodice portion and the widest point of a respective wing portion.

* * * * *